US007829162B2

(12) United States Patent
Eskra et al.

(10) Patent No.: US 7,829,162 B2
(45) Date of Patent: Nov. 9, 2010

(54) THERMAL TRANSFER RIBBON

(75) Inventors: Jennifer Eskra, Pendleton, NY (US); Pamela A. Geddes, Alden, NY (US); Daniel J. Harrison, Pittsford, NY (US); Claire A. Jalbert, Buffalo, NY (US); Barry L. Marginean, Scottsville, NY (US); John Przybylo, West Seneca, NY (US)

(73) Assignee: international imagining materials, inc, Amherst, NY (US)

( * ) Notice: Subject to any disclaimer, the term of this patent is extended or adjusted under 35 U.S.C. 154(b) by 734 days.

(21) Appl. No.: 11/895,841

(22) Filed: Aug. 28, 2007

(65) Prior Publication Data

US 2008/0090726 A1 Apr. 17, 2008

Related U.S. Application Data

(60) Provisional application No. 60/840,732, filed on Aug. 29, 2006.

(51) Int. Cl.
*B41M 5/40* (2006.01)

(52) U.S. Cl. ..... 428/32.69; 428/32.63; 428/32.64; 428/32.8; 428/32.87; 428/200; 428/207; 428/210; 428/212; 428/325; 400/241; 400/241.1; 400/241.4

(58) Field of Classification Search ..... 428/32.63, 428/32.64, 32.69, 32.8, 32.87, 200, 207, 428/210, 212, 325; 400/241, 241.1, 241.4
See application file for complete search history.

(56) References Cited

U.S. PATENT DOCUMENTS 2,681,317 A 6/1954 Grossman
2,763,785 A 9/1956 Switzer
3,057,806 A 10/1962 Switzer
3,230,221 A 1/1966 Kaveggia (Continued)

FOREIGN PATENT DOCUMENTS

EP 1619039 A2 1/2006

*Primary Examiner*—Betelhem Shewareged
(74) *Attorney, Agent, or Firm*—Howard J. Greenwald

(57) ABSTRACT

A thermal transfer printing medium that contains a thermal transfer layer which contains a first taggant and colorant, wherein: the first taggant comprises a fluorescent compound with an excitation wavelength selected from the group consisting of wavelengths of less than 400 nanometers, wavelengths of greater than 700 nanometers. When the thermal transfer layer is printed onto a white polyester substrate with a gloss of at least about 84, a surface smoothness Rz value of 1.2, and a reflective color represented by a chromaticity (a) of 1.91 and (b) of −6.79 and a lightness (L) of 95.63, when expressed by the CIE Lab color coordinate system, and when such printing utilizes a printing speed of 2.5 centimeters per second and a printing energy of 3.2 joules per square centimeter, a printed substrate with certain properties is produced. The printed substrate has a reflective color represented by a chromaticity (a) of from −15 to 15 and (b) from −18 to 18, and the printed substrate has a lightness (L) of less than about 35, when expressed by the CIE Lab color coordinate system. When the printed substrate is illuminated with light source that excites the first taggant with an excitation wavelength selected from the group consisting of wavelengths of less than 400 nanometers, wavelengths greater than 700 nanometers, the printed substrate produces a light fluorescence with a wavelength of from about 300 to about 700 nanometers.

23 Claims, 6 Drawing Sheets

U.S. PATENT DOCUMENTS

| | | | |
|---|---|---|---|
| 3,388,198 | A | 6/1968 | Sims |
| 3,400,036 | A | 9/1968 | Hemrick |
| 3,412,104 | A | 11/1968 | Dwight |
| 3,452,075 | A | 6/1969 | Dressler |
| 3,481,663 | A | 12/1969 | Greenstein |
| 3,493,410 | A | 2/1970 | Morita |
| 3,549,405 | A | 12/1970 | Schrenk |
| 3,560,238 | A | 2/1971 | Rothery |
| 3,576,707 | A | 4/1971 | Schrenk |
| 3,615,972 | A | 10/1971 | Morehouse, Jr. |
| 3,639,166 | A | 2/1972 | Fellows |
| 3,663,278 | A | 5/1972 | Blose |
| 3,698,930 | A | 10/1972 | Fleurquin |
| 3,733,371 | A | 5/1973 | Kose |
| 3,745,097 | A | 7/1973 | Chessin |
| 3,900,323 | A | 8/1975 | MacLeish |
| 3,914,360 | A | 10/1975 | Gunderman |
| 3,928,226 | A | 12/1975 | McDonough |
| 3,944,661 | A | 3/1976 | Colodney |
| 3,945,956 | A | 3/1976 | Garner |
| 3,960,755 | A | 6/1976 | Beachem |
| 3,969,433 | A | 7/1976 | Kose |
| 3,980,887 | A | 9/1976 | Mattis |
| 4,044,231 | A | 8/1977 | Beck |
| 4,113,648 | A | 9/1978 | Ferri |
| 4,138,516 | A | 2/1979 | Marrs |
| 4,151,666 | A | 5/1979 | Raphael |
| 4,166,043 | A | 8/1979 | Uhlmann |
| 4,179,546 | A | 12/1979 | Garner |
| 4,183,989 | A | 1/1980 | Tooth |
| 4,184,872 | A | 1/1980 | Davis |
| 4,200,679 | A | 4/1980 | Klein |
| 4,207,378 | A | 6/1980 | Klein |
| 4,304,700 | A | 12/1981 | Shimp |
| 4,304,873 | A | 12/1981 | Klein |
| 4,325,611 | A | 4/1982 | Huggins |
| 4,359,399 | A | 11/1982 | Boyars |
| 4,367,170 | A | 1/1983 | Uhlmann |
| 4,424,990 | A | 1/1984 | White |
| 4,472,479 | A | 9/1984 | Hayes |
| 4,497,851 | A | 2/1985 | de Vroom |
| 4,500,116 | A | 2/1985 | Ferro |
| 4,536,218 | A | 8/1985 | Ganho |
| 4,562,056 | A | 12/1985 | Hottori |
| 4,610,923 | A | 9/1986 | Schrock |
| 4,620,941 | A | 11/1986 | Yoshikawa |
| 4,627,997 | A | 12/1986 | Ide |
| 4,628,007 | A | 12/1986 | Ledsham |
| 4,631,222 | A | 12/1986 | Sander |
| 4,652,395 | A | 3/1987 | Marcina |
| 4,657,697 | A | 4/1987 | Chiang |
| 4,669,830 | A | 6/1987 | Hottori |
| 4,684,271 | A | 8/1987 | Wellman |
| 4,720,356 | A | 1/1988 | Chu |
| 4,721,769 | A | 1/1988 | Rubner |
| 4,736,425 | A | 4/1988 | Jalon |
| 4,744,685 | A | 5/1988 | Mecke |
| 4,750,817 | A | 6/1988 | Sammells |
| 4,816,344 | A | 3/1989 | Chiang |
| 4,830,671 | A | 5/1989 | Frihart |
| 4,842,382 | A | 6/1989 | Demirvont |
| 4,857,438 | A | 8/1989 | Loerzer |
| 4,873,078 | A | 10/1989 | Edmundson |
| 4,880,667 | A | 11/1989 | Welch |
| 4,891,352 | A | 1/1990 | Byers |
| 4,891,505 | A | 1/1990 | Jalon |
| 4,894,283 | A | 1/1990 | Wehr |
| 4,895,465 | A | 1/1990 | Mecke |
| 4,898,486 | A | 2/1990 | Mecke |
| 4,902,722 | A | 2/1990 | Melber |
| 4,923,749 | A | 5/1990 | Talvalkar |
| 4,938,617 | A | 7/1990 | Mecke |
| 4,950,641 | A | 8/1990 | Hann |
| 4,980,220 | A | 12/1990 | Boultinghouse |
| 4,992,204 | A | 2/1991 | Kluger |
| 5,017,428 | A | 5/1991 | Mecke |
| 5,044,707 | A | 9/1991 | Mallik |
| 5,047,291 | A | 9/1991 | Talvalkar |
| 5,084,359 | A | 1/1992 | Talvalkar |
| 5,089,318 | A | 2/1992 | Shetty |
| 5,098,350 | A | 3/1992 | Sackschewsky |
| 5,135,569 | A | 8/1992 | Mathias |
| 5,135,812 | A | 8/1992 | Phillips |
| 5,194,638 | A | 3/1993 | Frihart |
| 5,204,937 | A | 4/1993 | Minnaja |
| 5,212,558 | A | 5/1993 | Obata |
| 5,217,647 | A | 6/1993 | Tono |
| 5,229,320 | A | 7/1993 | Ugajin |
| 5,244,861 | A | 9/1993 | Campbell |
| 5,278,590 | A | 1/1994 | Phillips |
| 5,279,655 | A | 1/1994 | Takazawa |
| 5,288,381 | A | 2/1994 | Cogan |
| 5,301,044 | A | 4/1994 | Wright |
| 5,328,887 | A | 7/1994 | Janssens |
| 5,352,672 | A | 10/1994 | Staetz |
| 5,369,077 | A | 11/1994 | Harrison |
| 5,389,129 | A | 2/1995 | Jordan |
| 5,393,354 | A | 2/1995 | Bishop |
| 5,451,449 | A | 9/1995 | Shetty |
| 5,455,326 | A | 10/1995 | Parker |
| 5,461,136 | A | 10/1995 | Krutak |
| 5,466,658 | A | 11/1995 | Harrison |
| 5,486,022 | A | 1/1996 | Crane |
| 5,512,521 | A | 4/1996 | Fu |
| 5,514,860 | A | 5/1996 | Berson |
| 5,516,590 | A | 5/1996 | Olmstead |
| 5,525,403 | A | 6/1996 | Kawabata |
| 5,527,758 | A | 6/1996 | Uyttendaele |
| 5,536,627 | A | 7/1996 | Wang |
| 5,536,756 | A | 7/1996 | Kida |
| 5,552,231 | A | 9/1996 | Talvalkar |
| 5,559,075 | A | 9/1996 | Leenders |
| 5,569,347 | A | 10/1996 | Obata |
| 5,571,624 | A | 11/1996 | Phillips |
| 5,573,693 | A | 11/1996 | Lorence |
| 5,582,953 | A | 12/1996 | Uyttendaele |
| 5,583,631 | A | 12/1996 | Lazzerini |
| 5,601,931 | A | 2/1997 | Hoshino |
| 5,604,078 | A | 2/1997 | Campbell |
| 5,605,766 | A | 2/1997 | Arimura |
| 5,627,128 | A | 5/1997 | Bowman |
| 5,627,169 | A | 5/1997 | Miledi |
| 5,635,283 | A | 6/1997 | Lovison |
| 5,639,126 | A | 6/1997 | Dames |
| 5,645,632 | A | 7/1997 | Pavlin |
| 5,652,195 | A | 7/1997 | Horsten |
| 5,665,462 | A | 9/1997 | Dewar |
| 5,665,472 | A | 9/1997 | Tanaka |
| 5,668,890 | A | 9/1997 | Winkelman |
| 5,672,428 | A | 9/1997 | Muschelweicz |
| 5,681,379 | A | 10/1997 | Talvalkar |
| 5,682,194 | A | 10/1997 | Uyttendaele |
| 5,697,649 | A | 12/1997 | Dames |
| 5,698,020 | A | 12/1997 | Salz |
| 5,700,584 | A | 12/1997 | Suematsu |
| 5,702,520 | A | 12/1997 | Boaz |
| 5,716,717 | A | 2/1998 | Yeung |
| 5,734,411 | A | 3/1998 | Michielsen |
| 5,741,590 | A | 4/1998 | Kobsa |
| 5,748,204 | A | 5/1998 | Harrison |
| 5,751,484 | A | 5/1998 | Goodman |
| 5,751,845 | A | 5/1998 | Dorff |
| 5,753,590 | A | 5/1998 | Harrison |
| 5,759,729 | A | 6/1998 | Martin |

5,759,752 A 6/1998 Uyttendaele
5,760,394 A 6/1998 Welle
5,763,511 A 6/1998 Chan
5,768,004 A 6/1998 Cogan
5,776,280 A 7/1998 Puckett
5,783,106 A 7/1998 Reddy
5,786,587 A 7/1998 Colgate, Jr.
5,795,844 A 8/1998 Evans
5,803,503 A 9/1998 Kaule
5,820,991 A 10/1998 Cabo
5,821,028 A 10/1998 Maejima
5,830,824 A 11/1998 Lum
5,843,579 A 12/1998 Roth
5,844,230 A 12/1998 Lalonde
5,866,637 A 2/1999 Lorenz
5,873,932 A 2/1999 Fujita
5,879,438 A 3/1999 Fujita
5,879,587 A 3/1999 Yale
5,879,588 A 3/1999 Yale
5,888,013 A 3/1999 Slobodkin
5,888,283 A 3/1999 Mehta
5,891,294 A 4/1999 Shih
5,891,476 A 4/1999 Reo
5,895,511 A 4/1999 Tikhonova
5,897,885 A 4/1999 Petticrew
5,912,064 A 6/1999 Azuma
5,914,174 A 6/1999 Gupta
5,919,404 A 7/1999 Fujita
5,932,502 A 8/1999 Longobardo
5,932,643 A 8/1999 Kenny
5,939,207 A 8/1999 Fensore
5,945,376 A 8/1999 Burns
5,949,050 A 9/1999 Fosbenner
5,952,107 A 9/1999 Roth
5,959,761 A 9/1999 Perrott
5,962,152 A 10/1999 Nakamura
5,965,212 A 10/1999 Dobson
5,965,244 A 10/1999 Tang
5,968,856 A 10/1999 Schweiger
5,975,696 A 11/1999 Kohan
5,977,263 A 11/1999 Phillips
5,981,058 A 11/1999 Shih
5,985,076 A 11/1999 Misuda
5,988,968 A 11/1999 Hansmeier
5,989,947 A 11/1999 Dilger
5,997,227 A 12/1999 Bundy
5,999,047 A 12/1999 Zhang
6,004,486 A 12/1999 Chan
6,004,718 A 12/1999 Shinohara
6,007,744 A 12/1999 Nacker
6,008,157 A 12/1999 Takeuchi
6,013,409 A 1/2000 Chou
6,024,950 A 2/2000 Takada
6,025,200 A 2/2000 Kaish
6,031,021 A 2/2000 Kenny
6,031,556 A 2/2000 Tutt
6,034,193 A 3/2000 Henry
6,040,267 A 3/2000 Mano
6,040,269 A 3/2000 Imoto
6,045,646 A 4/2000 Yoshikawa
6,045,859 A 4/2000 Klein
6,051,097 A 4/2000 Higuchi
6,051,171 A 4/2000 Takeuchi
6,057,028 A 5/2000 Tan
6,060,214 A 5/2000 Ehrhart
6,071,585 A 6/2000 Roth
6,075,223 A 6/2000 Harrison
6,075,927 A 6/2000 Sakai
6,077,594 A 6/2000 Roth
6,077,797 A 6/2000 Sperlich
6,080,479 A 6/2000 Sogabe
6,083,427 A 7/2000 Henry
6,083,610 A 7/2000 Hirose
6,083,872 A 7/2000 Adkins
6,086,700 A 7/2000 Valentini
6,086,846 A 7/2000 Burow
6,096,246 A 8/2000 Chan
6,103,389 A 8/2000 Tanaka
6,106,910 A 8/2000 Tan
6,108,456 A 8/2000 Yamamoto
6,113,725 A 9/2000 Kronzer
6,114,088 A 9/2000 Wolk
6,114,437 A 9/2000 Brown
6,117,572 A 9/2000 Tidrow
6,120,637 A 9/2000 Barry
6,121,356 A 9/2000 Lundberg
6,124,236 A 9/2000 Mitchell, Jr.
6,124,239 A 9/2000 Chapman
6,127,516 A 10/2000 Bard
6,132,642 A 10/2000 Kane
6,146,773 A 11/2000 Kaule
6,149,747 A 11/2000 Lorenz
6,171,525 B1 1/2001 Effer
6,174,400 B1 1/2001 Krutak, Sr.
6,210,777 B1 4/2001 Vermeulen
6,212,504 B1 4/2001 Hayosh
6,225,361 B1 5/2001 Nakajima
6,231,973 B1 5/2001 Suematsu
6,235,394 B1 5/2001 Shimazawa
6,235,618 B1 5/2001 Jeong-Sook
6,235,800 B1 5/2001 Kyuno
6,245,416 B1 6/2001 Roth
6,255,948 B1 7/2001 Wolpert
6,277,589 B1 8/2001 Seibert
6,303,228 B1 10/2001 Watanabe
6,314,906 B1 11/2001 Tesfaye
6,329,668 B1 12/2001 Razeghi
6,375,737 B2 4/2002 Shih
6,376,056 B1 4/2002 Krauter
6,448,068 B2 9/2002 Seibert
6,451,236 B1 9/2002 Sallavanti
6,468,636 B1 10/2002 Hirano
6,481,353 B1 11/2002 Geddes
6,491,324 B1 12/2002 Schmitz
6,492,458 B1 12/2002 Pavlin
6,506,476 B1 1/2003 Kaule
6,509,384 B2 1/2003 Kron
6,528,318 B1 3/2003 Miragliotta
6,541,788 B2 4/2003 Petroff
6,562,442 B2 5/2003 Sogabe
6,565,770 B1 5/2003 Mayer
6,573,527 B1 6/2003 Sugiyama
6,584,903 B2 7/2003 Jacobs
6,596,555 B2 7/2003 Bensahel
6,602,585 B2 8/2003 Graney
6,610,131 B2 8/2003 Harris
6,610,351 B2 8/2003 Shchegolikhin
6,616,964 B1 9/2003 Hampp
6,623,589 B2 9/2003 Sogabe
6,629,792 B1 10/2003 Geddes
6,633,370 B2 10/2003 Lawandy
6,639,039 B1 10/2003 Fries
6,644,917 B2 11/2003 Zhao
6,645,885 B2 11/2003 Chua
6,647,649 B2 11/2003 Hunt
6,666,596 B2 12/2003 Burns
6,686,074 B2 2/2004 Muth
6,692,031 B2 2/2004 McGrew
6,694,885 B2 2/2004 Geddes
6,708,618 B1 3/2004 Tsai
6,722,271 B1 4/2004 Geddes
6,734,105 B2 5/2004 Kim
6,752,432 B1 6/2004 Richardson
6,766,734 B2 7/2004 Geddes
6,774,014 B1 8/2004 Lee
6,794,265 B2 9/2004 Lee 6,796,733 B2 9/2004 Geddes
6,802,992 B1 10/2004 Wieczoreck
6,834,589 B2 12/2004 Harris
6,841,092 B2 1/2005 Paeschke
6,853,471 B2 2/2005 Sommer
6,854,386 B2 2/2005 Geddes
6,859,477 B2 2/2005 Deppe
6,864,297 B2 3/2005 Nutt
6,899,827 B2 5/2005 Lauf
6,908,240 B1 6/2005 Johnson
6,908,505 B2 6/2005 Lawandy
6,918,535 B1 7/2005 Brosow
6,926,764 B2 8/2005 Bleikolm
6,930,606 B2 8/2005 Crane
6,933,325 B2 8/2005 Zheng
6,989,525 B2 1/2006 Howard
6,991,260 B2 1/2006 Fan
7,008,795 B2 3/2006 Yerazunis
7,019,755 B2 3/2006 Krueger
7,022,628 B2 4/2006 Kim
7,033,527 B2 4/2006 Kim
7,037,606 B2 5/2006 Heim
7,040,663 B1 5/2006 Plaschka
7,044,386 B2 5/2006 Berson
7,055,691 B2 6/2006 Safian
7,065,285 B2 6/2006 Chen
7,094,364 B2 8/2006 Potyrailo
7,129,506 B2 10/2006 Ross
7,256,398 B2 8/2007 Ross
2001/0021417 A1 9/2001 Child
2001/0041084 A1 11/2001 Burns
2001/0041351 A1 11/2001 Seibert
2002/0025490 A1 2/2002 Shchegolikhin
2002/0104632 A1 8/2002 Jimenez
2002/0129523 A1 9/2002 Hunt
2003/0038174 A1 2/2003 Jones
2003/0099849 A1 5/2003 Wu
2003/0107639 A1 6/2003 Field
2003/0109049 A1 6/2003 Miragliotta
2003/0118440 A1 6/2003 Zhao
2003/0173406 A1 9/2003 Bi
2003/0180482 A1 9/2003 Narita
2003/0200889 A1 10/2003 Geddes
2004/0003742 A1 1/2004 Geddes
2004/0057873 A1 3/2004 Yerazunis
2004/0058058 A1 3/2004 Shchegolikhin
2004/0067360 A1 4/2004 Steenblik
2004/0098891 A1 5/2004 Hunt
2004/0136765 A1 7/2004 Geddes
2004/0149154 A1 8/2004 Geddes
2004/0176486 A1 9/2004 Glorioso
2004/0176487 A1 9/2004 Svedberg
2004/0227112 A1 11/2004 Howard
2004/0249005 A1 12/2004 Kron
2005/0092408 A1 5/2005 Lauf
2005/0128280 A1 6/2005 Johnson
2005/0129445 A1 6/2005 Johnson
2005/0129446 A1 6/2005 Johnson
2005/0145120 A1 7/2005 Geddes
2005/0150412 A1 7/2005 Geddes
2005/0153113 A1* 7/2005 Hseih et al. ..... 428/201
2005/0166770 A1 8/2005 Ibarra
2005/0179012 A1 8/2005 Kwon
2005/0181511 A1 8/2005 Mun
2005/0189255 A1 9/2005 Safian
2005/0227068 A1 10/2005 Dugan
2006/0000569 A1 1/2006 Kron
2006/0014045 A1 1/2006 Einhorn
2006/0037222 A1 2/2006 Hunt
2006/0038979 A1 2/2006 Natan
2006/0090598 A1 5/2006 Goia
2006/0090600 A1 5/2006 Goia
2006/0102307 A1 5/2006 Kron
2006/0207385 A1 9/2006 Goia

* cited by examiner

THERMAL TRANSFER RIBBON

CROSS-REFERENCE TO RELATED PATENT APPLICATIONS

This patent application claims priority based upon U.S. patent application 60/840,732, filed on Aug. 29, 2006. The entire disclosure of this provisional patent application is hereby incorporated by reference into this specification.

FIELD OF THE INVENTION

A thermal transfer ribbon adapted to print an overt, covert or forensic level security mark onto a substrate.

BACKGROUND OF THE INVENTION

U.S. Pat. No. 6,174,400 of Krutak et al. describes near infrared fluorescent security thermal transfer printing and marking ribbons. In this patent, the "prior art" is discussed, and it is disclosed that " . . . thermal transfer ribbons incorporating invisible marking compound which are not visible to the unaided human eye . . . " are not known. In such patent, the inventors disclose that, with regard to the infrared preferred embodiment (in which a near infrared fluorescer [NIFR] is incorporated into an ink composition), "When the positive image was viewed with a near IR camera designed for display of contrast images of the near IR fluorescence on a video monitor, a very faint image could be discerned . . . . The weakness of the image is due to carbon black absorption of most of the activating laser light and near IR fluorescence generated before it can exit the image surface. Use of black dye compositions, which do not absorb strongly in the near IR in place of the carbon black pigment results in stronger contrast images."

The use of such " . . . black dye composition which do not absorb strongly in the near IR . . . " is still problematic inasmuch as such compositions generally still absorb in the visible range and, when used in combination with near infrared fluorescing taggants, produces a poor response from such taggants. It is an object of one embodiment of this invention to provide a system that enables strong black marks to be produced but also enables taggants in such system to respond well to excitation outside of the visible range to produce strong visible fluorescence.

SUMMARY OF THE INVENTION

A thermal transfer printing medium comprised of a thermal transfer layer, wherein: (a) said thermal transfer layer is comprised of a first taggant, wherein said first taggant comprises a fluorescent compound with a first excitation wavelength; (b) said first excitation wavelength is selected from the group consisting of wavelengths of less than 400 nanometers, wavelengths of greater than 700 nanometers, and mixtures thereof; (c) said thermal transfer layer is comprised of a first colorant; (d) said thermal transfer layer has a light transmittance of at least about 10 percent when illuminated by light having said first excitation wavelength of said first taggant; (e) when said thermal transfer layer is printed onto a white polyester substrate with a gloss of at least about 84, a surface smoothness Rz value of 1.2, and a reflective color represented by a chromaticity (a) of 1.91 and (b) of −6.79 and a lightness (L) of 95.63, when expressed by the CIE Lab color coordinate system, and when such printing utilizes a printing speed of 2.5 centimeters per second and a printing energy of 3.2 joules per square centimeter, a printed substrate is produced wherein: 1. said printed substrate has a reflective color represented by a chromaticity (a) of from −15 to 15 and (b) from −18 to 18, and said printed substrate has a lightness (L) of less than about 35, when expressed by the CIE Lab color coordinate system; and 2. when said printed substrate is illuminated with light source that excites said first taggant with said first excitation wavelength, said printed substrate produces a light fluorescence with a wavelength in the range of from about 300 to about 700 nanometers.

BRIEF DESCRIPTION OF THE DRAWINGS

The invention will be described by reference to the specification and the following drawings, in which like numerals refer to like elements, and wherein.

DESCRIPTION OF THE PREFERRED EMBODIMENTS

Figure 1:
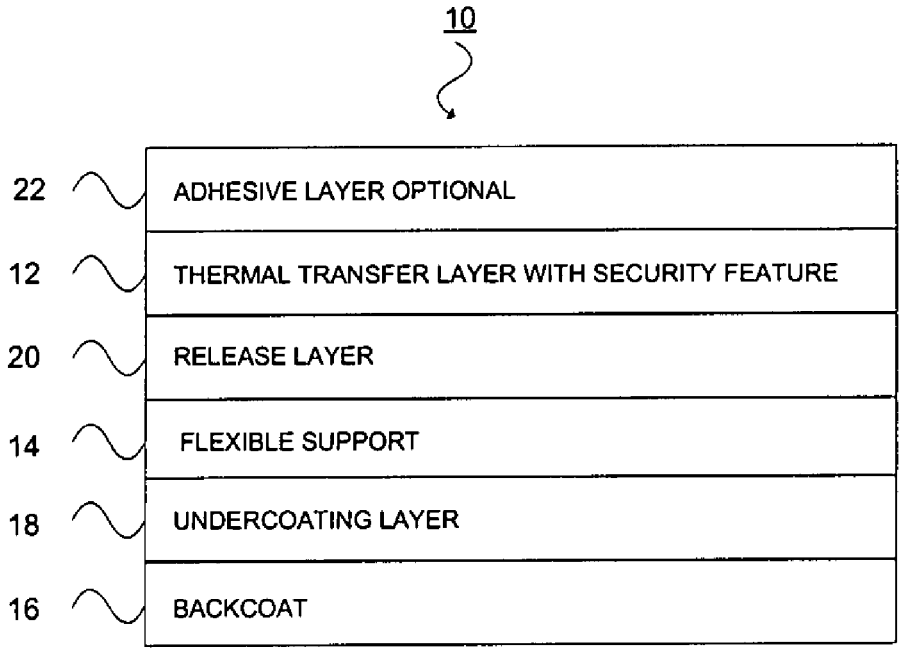
FIG. 1 is a schematic of one preferred thermal transfer ribbon with a thermal transfer layer comprising a security feature; and each of FIGS. 2 through 11 is a schematic of a thermal transfer ribbon adapted to print one or more security features onto a substrate.

In the first section of this specification, a substantial amount of background material will be presented that relates to both the system of the present invention and prior art systems. In the second section of the specification, certain preferred embodiments of applicants' systems will be described.

Description of Certain Relevant Background Art Relating to Taggants

Invisible near infrared fluorescent markers have often been used in certain of the prior art thermal transfer ribbons; these markers are often referred to as "taggants." Such markers are invisible under broad spectrum light and black light but produce fluorescence or fluoresce when excited with appropriate red or near infrared light frequencies. Such near infrared fluorescent markers may be comprised of one or more porphine compounds.

By way of illustration, U.S. Pat. No. 6,926,764 describes a covert system for the detection of infrared taggants that relies on differential absorption of light. In this system, colored marks absorb in the visible range but have lower absorption in the near infrared region (680-900 nanometers). The infrared taggants do not absorb in the visible range but have strong absorption in the near infrared. In this system only printed patterns must have a unique combination of absorption in the visible and infrared regions to be judged authentic.

In one embodiment, the claims of the instant application relate, at least in part, to a thermal transfer ribbon adapted to print one or more security features; some of these security features are described elsewhere in this specification, especially in the section thereof containing certain definitions. The printing of security devices as a means to prevent the copying or counterfeiting of documents has a long history. In recent times, the diversion of products from one market to another has also become problematic. To overcome this problem, printing of security devices onto product packaging and in some cases directly onto parts has been employed. In many cases, product and part labeling requires variable information, such as shipping address, lot codes, serial numbers, barcodes and the like. Digital printing machines such as thermal transfer printers are typically employed to print labels containing such variable information. Such digitally printed labels can be effectively used to interrupt product diversion and counterfeiting if at least a portion of the printed ink comprises a security device or marker.

Security devices and markers are widely described in the art. Such security devices or markers may be overt in nature such that an inspector can easily determine the infrared presence by the appearance or feel of the printed mark and thus quickly validate the authenticity of package or part. Examples of overt security devices include optically variable marks (holograms), intaglio printing, color shifting marks, thermochromic marks, and the like.

Covert security devices cannot be immediately detected with human senses. Such devices require the assistance of a "reader" to detect the infrared presence in a given printing ink or label. Often such security devices are referred to as markers or taggants. Markers and taggants may posses a physical property, such as magnetism, fluorescence, conductivity and the like, or have some other physical or chemical characteristic which can be used by a reader or detector to verify their presence in a printed label without otherwise changing the physical appearance or feel of the printing or label. Covert security devices have the advantage of being less easily detectable without the aid of an external device, making detection more difficult for the counterfeiter or diverter, but they have a disadvantage in that they require less readily available equipment for detection, making it difficult to have a detector at every point along the distribution chain.

Forensic level security markers typically have a unique chemical signature that differentiates the marker from the ink or other material in which it is incorporated. Forensic markers are typically added at a very low level to inks and materials such that they may appear as background noise in an elemental analysis. However, knowledge of the presence of such markers in a substance can enable very specific physical and/or chemical tests. For example, low levels of DNA markers can be amplified if the structure of the DNA is know and markers comprised of unique mixtures of isotopes of a given element can be easily compared with mass spectroscopy to typical background levels. As described above, forensic security markers have the advantage of difficult detectability by the counterfeiter or diverter, and the disadvantage of requiring more specialized equipment for detection.

The incorporation of covert markers in thermal transfer ribbons has been disclosed in, e.g., U.S. Pat. No. 4,628,007, the entire disclosure of which is hereby incorporated by reference into this specification. This patent describes the incorporation of a fluorescent marker in a thermal transfer recording medium comprising a thermally-meltable wax ink layer.

Early applications of such fluorescent markers in thermal transfer ribbons were in the area of printing fluorescent marks or codes for postal applications; see, for example, U.S. Pat. No. 5,089,350, the entire disclosure of which is hereby incorporated by reference into this specification. In this patent, red fluorescent materials are incorporated into a waxy thermal transfer layer for printing directly onto paper articles to enable machine reading of such articles. These markers were often detectable both by the unaided human eye (red to red orange in the visible range) and by fluorescent readers tuned to specific wavelengths typically used to automatically sort mail. The fluorescence of the markers described in this patent are easily observed by exciting such fluorescence with a source of illumination at an optimal wavelength of light (called the excitation wavelength) and then detecting such fluorescence at a different and typically longer wavelength of light (called the emission wavelength). Such a detection scheme can be assembled in which the light used to illuminate the image is filtered out such that only the light emitted by the fluorescent of the marker is seen by the detector. In this way, only marks which fluoresce in the prescribed fashion, and not spurious markings, will be sensed by the detector.

U.S. Pat. No. 6,376,056, the entire disclosure of which is hereby incorporated by reference into this specification, describes fluorescent markers targeted for use in postage meter printers. The daylight fluorescent pigment preferably emits in the wave length range of orange to red, i.e. at approximately 580 to 620 nanometers (with an excitation wavelength of 254 nanometers). This patent cautions against adding non-luminescent pigments to the composition as their presence adversely affects the fluorescent quality, even at levels as low as one percent of the non-luminescent material.

U.S. Pat. No. 6,174,400, the entire disclosure of which is hereby incorporated by reference into this specification, describes near infrared fluorescent security thermal transfer printing and marking ribbons comprising at least one near infrared fluorescent compound in a concentration which provides detectable fluorescence without imparting color to a mark made from said printing media layer, said near infrared fluorescent compound is selected from the group consisting of phthalocyanine compounds. Near infrared fluorescent compounds are used to prevent detection with commonly available "black lights."

Thermal transfer ribbons incorporating visible fluorescent dyes or pigments are disclosed in U.S. Pat. Nos. 4,627,997, 4,657,697, 4,816,344, 5,089,350 and 5,552,231; the entire disclosure of each of these patents is hereby incorporated by reference into this specification. These patents do not disclose ribbons containing marking compositions which are invisible to the human eye. In U.S. Pat. No. 4,627,997, thermal transfer ink coloring agents which make the mark visible to the human eye are selected such that they do not absorb the emission of the fluorescent dye; the preferred method is to separate the visible marking agent into a layer separate from the fluorescing agent to maximize the light production, and hence detectability, of the fluorescing agent. In U.S. Pat. No. 5,089,350, the colorant used to make the mark visible is limited to a range of red/orange that has an L value of 40 to 50; L is the designation of "lightness" in the CIE Lab color value system where higher numbers indicate lighter colors.

When such ribbon is printed onto a specified substrate, a mark is printed that can be detected with the aid of a covert reader. In a preferred embodiment of this invention the mark has a black color.

Elsewhere in this specification, reference is made to certain measurements utilizing the CIELAB Color Coordinate System. In particular, and with regard to at least one preferred embodiment, the optical properties are measured using "Lab" color space. "Lab" is the abbreviated name of two different color spaces, the best known of which is "CIELAB" (also referred to as "CIE 1976 L*a*b*"). Both of these spaces are derived from the "master" space, CIE 1931 color space. CIELAB is calculated using cube roots, and Hunter Lab is calculated using square roots. Reference may be had, e.g. to a web site appearing at http://en.wikipedia.org/wiki/Lab_color_space.

CIELAB has been widely described in the patent literature. Thus, e.g., it is described in both the claims and the disclosures of U.S. Pat. Nos. 5,512,521 (cobalt-free, black, dual purpose enamel glass),U.S. Pat. Nos. 5,668,890, 5,751,484 (coatings on glass), U.S. Pat. No. 5,751,845 (method for generating smooth color corrections in a color space, particular a CIELAB color space),U.S. Pat. No. 5,932,502 (low transmittance glass),U.S. Pat. No. 6,584,903 (color digital front end decomposer output to multiple color spaces), U.S. Pat. No. 6,610,131 (inks exhibiting expanded color-space characteristics), U.S. Pat. No. 6,834,589 (methods of flexographic printing with inks exhibiting expanded color-space characteristics), U.S. Pat. No. 7,019,755 (rendering intent selection based on input color space), and the like. The disclosure of each of these United States patents is hereby incorporated by reference into this specification.

"CIELAB" has also been described in applicants' patent documents, including, e.g., U.S. Pat. Nos. 6,629,792 (thermal transfer ribbon with frosting ink layer), U.S. Pat. No. 6,722,271 (ceramic decal assembly), U.S. Pat. No. 6,796,733, etc.; the disclosure of each of these United States patents is hereby incorporated by reference into this specification. Thus, e.g., it is disclosed in the '733 patent that "The measurements were taken on fired glass samples. The whiteness was calculated according to CIE Lab color space measurement standard of 1976 with a D65 illuminate and a 10 degree observation angle."

In the present invention, when using the CIE Lab color space measurement standard of 1976, it is preferred to as the "rationale" for the CIE (ICI) system of color specification that is described, e.g., at pages 17-2 to 17-5 of George W. McLellan et al.'s "Glass Engineering Handbook," Third Edition (McGraw-Hill Book Company, New York, N.Y., 1984). It is disclosed in the McLellan text that: "The human eye distinguishes in a qualitative manner between radiations of different wavelengths within the visible spectrum. The sensation of color responds to the dominant wavelength of the light. These wavelengths, corresponding to the different colors, are somewhat arbitrary, but they may be given roughly as follows (wavelengths in nanometers): Violet (400-450), Blue (450-490), Green (490-550), Yellow (550-590), Orange (590-630), Red (630-700)."

The McLellan text also discloses that "The eye can also determine in a general manner whether the light is confined to a relatively narrow band of wavelengths or dispersed more broadly across the spectrum. In terms of color, the narrowness of the band is referred to as saturation of hue. White light has no dominant wavelength, as the energy is radiated quite uniformly across the visible spectrum."

The McLellan text also teaches that "Color qualities of surfaces result from the elective absorption characteristics of the surfaces so that some bands of wavelengths are reflected to a greater extent than others. A surface which absorbs the shorter wavelengths but reflects the longer ones will exhibit an orange or red color. It also follows that the color of reflected light is responsive to the color quality of the light source. Objects viewed in the light of an incandescent lamp will appear more red than in the light of a mercury-vapor lamp. These same effects result from the selective absorption of light in a transparent medium . . . . "

Figure 3:
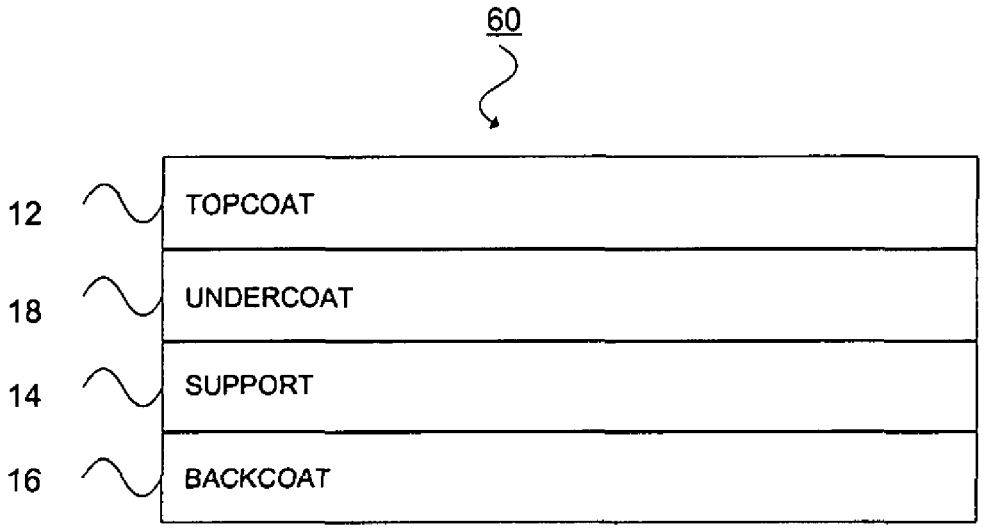

The McLellan text refers (at page 17-4) to certain spectrophotometric curves depicted in a FIG. 17-3, and it discloses that: "Spectrophotometric curves such as A, B, and C of FIG. 17-3 define the color quality of light in a purely scientific manner. These curves will show precision of detail, such as narrow absorption bands, and energy radiated at individual lines of the spectrum which cannot be discriminated by the eye. Other methods of color indication, which conform more nearly with the limitations of the eye, are more adaptable for the purposes of illumination."

Figure 4:
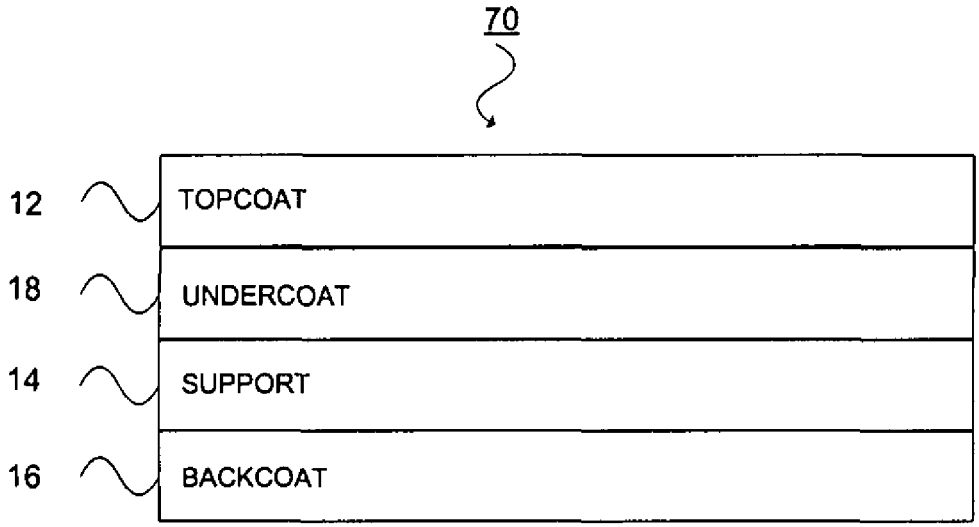

In the last paragraph of page 17-4 of the McLellan text, the CIE system is discussed. It is disclosed that "The CIE (ICI) system of color specification meets this requirement. It is based upon the hypothesis that color sensation results from three distinct nerve responses which have their peak values at different wavelengths. The tristimulus values of this system are shown in FIG. 17-4, the middle curve being identical with the standard luminosity curve (FIG. 17-1). When a spectrophotometric curve of energy is evaluated in terms of the tristimulus values, the three components, which define color quality, can then be expressed in two dimensions, or x and y coefficients."

Figure 5:
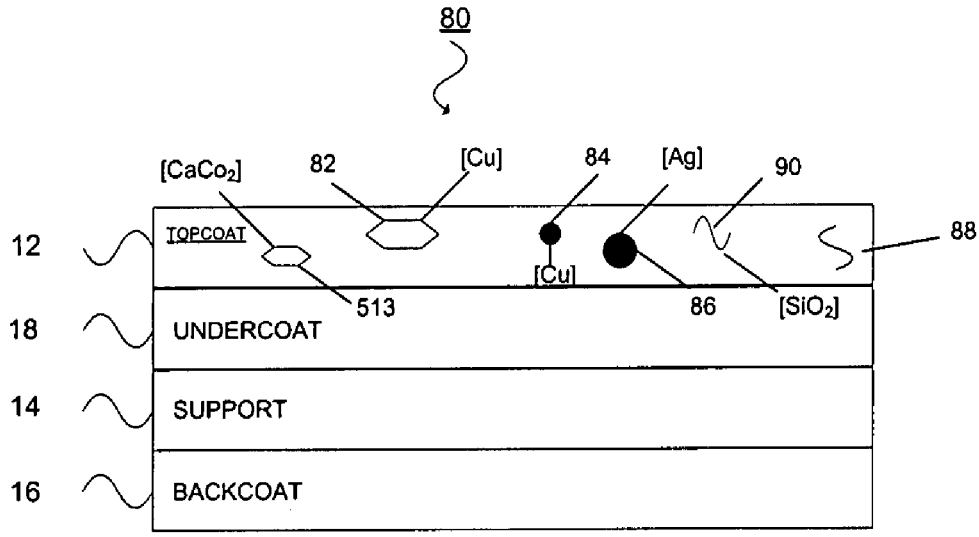

The McLellan text also discloses that: "The whole range of color can in this way be represented by an area on coordinate paper. The locus of the boundary of this area, roughly parabolic in shape (FIG. 17-5), corresponds to the sensations produced by monochromatic light—radiations of a single wavelength. These wavelengths in nanometers are indicated in FIG. 17-5. The rectangle marked 'equal energy,' sometimes called the white point, refers to the radiant energy distributed uniformly across the visible spectrum. The relative position of any point between the equal energy rectangle and the boundary indicates the purity of color, of saturation of hue—the closer to the boundary, the purer, or more saturated, the color of light. The solid line passing near the equal-energy point is the locus of color temperatures of a blackbody. These color temperatures are indicated in kelvins . . . . " L may have values between 0 and 100 and is a measure of the lightness of the color while a and b have values between −80 and +80 and measure the redness or greenness of the color (a) and the yellowness or blueness of the color (b). A "perfect" black body would have a L=a=b=0. There is a range around these values at which a color is perceived as "black", and as with white, there are personal prejudices associated with which directions of departure (towards blue, red, etc.) are preferred. By measuring the Lab associated with numerous "PANTONE" standard color samples perceived as black, an $L \leqq 35$, and a range of $-15 \leqq a \leqq +15$ and $-18 \leqq b \leqq +18$ encompasses all of those samples.

Thermal transfer ribbons incorporating invisible ultraviolet dyes or pigments and visible pigments are disclosed in U.S. Pat. No. 5,516,590, the entire disclosure of which is hereby incorporated by reference into this specification. This patent describes thermal transfer printing ribbons capable of printing security characters and indicia in conjunction with product identification bar codes and other visible printing, such that the security characters and indicia are invisible under broad spectrum light, but fluoresce, and become visible, when exposed to black light. Referring to this patent, printing media layer 12 preferably includes a uniform interspersed distribution of visible black or colored pigments and fluorescent pigments in binding substrate. Visible black or colored pigments include carbon black pigments and other colored pigments. Visible black or colored pigments allow the printed image to appear visibly black or colored, as desired, under broad spectrum light. Fluorescent pigments are inactive under broad spectrum light, but fluoresce, and become visible, when exposed to black light.

U.S. Pat. No. 5,516,590, the entire disclosure of which is hereby incorporated by reference into this specification, discloses that both carbon black pigment at a dry loading of 5 to 15 percent and ultraviolet yellow pigment can be combined in a single ink layer which appears black in broad spectrum light but which fluoresces and becomes visible when exposed to black light. The applicants of the instant invention have not been able to reproduce this effect with such conditions. Even under black light illumination, the composition described in FIG. 1 of such patent does not appear to fluoresce or visibly change appearance when compared to similar compositions which do not contain fluorescent pigments. However, when the embodiment disclosed in FIG. 3 of such U.S. Pat. No. 5,516,590 was reproduced by the applicants, fluorescence of the ultraviolet fluorescent pigments could be easily observed with black light illumination. In this embodiment, the ultraviolet fluorescent pigments were incorporated into a separate thermal transfer layer adjacent to the layer containing the carbon black pigments. Although they do not wish to be bound to any particular theory, applicants hypothesize that when carbon black pigment is incorporated into the same layer as the ultraviolet fluorescent pigments, the carbon black absorbs the ultraviolet light used to excite the ultraviolet fluorescent pigments.

Invisible near infrared fluorescent markers are invisible under broad spectrum light and black light but produce fluorescence or fluoresce when excited with appropriate red or near infrared light frequencies. Such near infrared fluorescent markers may be comprised of one or more porphine compounds. U.S. Pat. No. 6,926,764, the entire disclosure of which is hereby incorporated by reference into this specification, describes a covert system for the detection of infrared taggants which relies on differential absorption of light. In this system, colored marks absorb in the visible range but have lower absorption in the near infrared region (680-900 nanometers). The infrared taggants do not absorb in the visible but have strong absorption in the near IR. In this system only printed patterns must have a unique combination of absorption in the visible and infrared regions to be judged authentic.

Fluorescent markers in thermal transfer ribbons are widely disclosed (for example, see U.S. Pat. No. 4,627,997); and one or more of such fluorescent markers may be used in the system of the present invention. This patent describes "thermal transfer recording medium which comprises a heat-resistant substrate and a thermally meltable inking layer consisting essentially of a coloring agent, waxes and a binder on said substrate, the improvement which comprises; a fluorescent substance consisting of a wax-like substance solid solution or a resin solid solution of a fluorescent dye, said solid solution having a melting or softening point of 50.degree.–140.degree. C., is further contained in said inking layer." The fluorescent markers include organic fluorescent dyes and pigments such as Lumogen L yellow, Lumogen L Brilliant Yellow, Lumogen L Red Orange; Thioflavine (CI-49005); Basic Yellow BG (CI-46040); Fluorescein (CI-45350); Rhodamine B (CI-45170); Rhodamine 6G (CI-45160); Eosine (CI-45380); conventional white fluorescent brightener such, for instance, as CI Fluorescent Brightening Agent 85, 166 and 174; those obtained by rendering the above mentioned fluorescent dyes oil soluble (and simultaneously water insoluble) with organic acids such, for instance, as Oil Pink #312 obtained by rendering Rhodamine B oil soluble and Barifast Red 1308 obtained by rendering Rhodamine 6G oil soluble (produced by Orient Chemical Co.); and those obtained by lake formation of the above fluorescent dyes with metal salts and other precipitants such as, Fast Rose and Fast Rose Conc obtained by lake formation of Rhodamine 6G (produced by Dainichi Seika Kogyo K.K.). Inorganic fluorescent substances include ZnS—Cu mixtures, ZnS—Cu+CdS—Cu mixtures, ZnO—Zn mixtures and the like.

The problem of interference by visible light absorbing colorants on the detection of markers is amplified when the amount of such markers is relatively small. It is desirable to maintain a low marker concentration in a printing composition so as to make it difficult or impossible to isolate and identify the chemical composition of the marker in the composition. Marker concentrations in the parts per million are preferred. However, detection of such markers becomes difficult because the physical properties of the ink composition are dominated by the majority of components in the printing composition. For example, the detection of a fluorescent marker may be compromised if the marker is incorporated into an ink composition in which the other components either absorb the light used to excite the fluorescence of the marker or the light emitted by the marker's fluorescence. When low concentrations of fluorescent markers are employed in the ink composition, interference from the other components is especially problematic.

In one preferred embodiment of the instant invention, the concentration of the taggant(s) in the thermal transfer layers ranges from about 1 part per million to about 30 weight percent, depending upon the sensitivity of the taggant. In one aspect of this embodiment, the concentration of the taggant is from about 1 part per million to about 1,000 parts per million. In another aspect of this embodiment, the taggant concentration is from about 1 to about 20 weight percent, by weight of the layer.

Separation of the fluorescing and the non-fluorescing materials into separate layers in the thermal transfer ribbon construction can help minimize the necessary concentration of the fluorescer that can be detected. This, however, complicates the construction of the thermal transfer ribbon, and other design considerations must be taken into account for this method to be successful. While not wishing to be bound to any particular theory, the applicants believe that the fluorescent agent must still be able to interact with the exciting radiation for the effect to be observed.

U.S. Pat. No. 5,135,569, the entire disclosure of which is hereby incorporated by reference into this specification, alludes to such a case. Here the fluorescing material is separated from the black colorant material in a separate layer of the thermal transfer ribbon. In order to observe the presence or absence of the fluorescent agent, the black layer must be removed from the marked article to determine the authenticity designated by the presence of the fluorescer under black light illumination. By comparison, applicants' preferred system is much simpler.

It is desirable to incorporate security features into products that are as close as possible in appearance and function to standard products so that diverters, counterfeiters, etc. do not detect and counteract the incorporated security feature. Further, this allows the incorporation of the security features potentially without the knowledge of the process operators, any other users in the channel, the purchaser, as well as the counterfeiter or diverter.

For thermal transfer applications, this implies that the thermal transfer ribbon preferably looks like any other ribbon (size, color, and shape similar to a standard ribbon), and that the print (label, tag, etc.) produced by the ribbon also has the characteristics (color and darkness) of the standard, non-secure product.

The majority of thermal transfer ribbons are black in appearance, both the ribbon itself, and the printed image derived from the ribbon. The difficulty of incorporating a fluorescing security material into such ribbons is discussed, e.g., in U.S. Pat. Nos. 6,376,056, 4,627,997, 5,135,569, 6,174,400 and in United States published patent applications 2003/0107639 and 2003/0180482. The entire disclosure of each of these patent documents is hereby incorporated by reference into this specification.

In U.S. Pat. No. 6,376,056, the inventors state "If attempts are made to increase the optical density of the print outs by adding a non-luminescent pigment to the layer of luminescent pigment, one notes that with an addition of extraneous pigments of more than 1%, fluorescence quality is significantly affected. With increasing addition amounts, there is growing impairment of the brilliance of the fluorescent pigments, the fluorescence power, and color purity due to occurring interferences. Still higher addition amounts lead to almost total extinction." They go on to say that, at acceptable levels of non-luminescent pigments for fluorescence detection, the color and density are only minimally changed so no benefit is provided.

In U.S. Pat. No. 4,627,997, the inventors state "It is preferable in the present invention to select a coloring agent which does not absorb the fluorescence of the fluorescent substance or does not absorb it much; transmissions of 40% or more at the emission wavelengths are preferred to avoid decreasing the fluorescence intensity by inclusion of a coloring agent."

In U.S. Pat. No. 5,135,569, the inventors place the fluorescing agent in a separate layer from the colored layer; and the colored layer is removed for detection because of its interference with the fluorescing agent. The inventors state "Problems can still arise when a commercial black ink is to be employed in the printed matter. Such black ink does not fluoresce and will mask the fluorescence of any fluorescent component contained within the black ink."

In U.S. Pat. No. 6,174,400, the inventors also recognize the problem with incorporation of a near infrared fluorescer (NIRF) into a black ink composition, saying only faint images could be discerned. Use of black dye compositions that did not absorb strongly in the near infrared improved the response, but the best solution was to separate the NIRF into a separate layer so that it was not mixed with the black or colored pigments to improve the efficiency of detection.

In published United States patent application 2003/0107639 A1, the inventor resolves the difficulty of detecting fluorescent agents in a combination fluorescent and non fluorescent colorants in the same ink by printing the colorants from separate thermal transfer ribbons in registration with the fluorescent containing ink printed last.

Published United States patent application 2003/0180482 allows the incorporation of "highly transparent fine particles" in the composition in such an amount that does not sacrifice the transparency.

The major obstacle to achieving similarity between secure and non-secure versions of thermal transfer ribbons is that such ribbons typically include carbon black in the ink layer (15 percent or more of the total ink composition by weight is typical), and many of the security taggants function by absorption, emission, or both, of electromagnetic radiation which is absorbed by the carbon black. When the radiation is absorbed by the carbon black, it is not available for excitation of the taggant. Further, even when there is sufficient absorption by the taggant to generate the desired response, the emitted radiation by the taggant can also be absorbed by the carbon black, and thus not be detectable. The excitation issues seem to be the greater challenge.

One of the objects of the present invention is to achieve a "black" look to a thermal transfer ribbon and ink that mimics the original, non-secure product, but has optical "windows" in that black where the absorption of electromagnetic radiation by the "black" is low enough not to interfere the excitation of the security taggant so that its presence can be detected.

This can be achieved in a number of ways. Dyes, or mixtures of dyes, that have the correct optical windows may be incorporated in a thermal transfer ribbon. These must be chosen to achieve a perception of black. If the color balance is not right, the ink will appear to be a shade of color rather than black. If there is insufficient colorant in the system, the ink will appear "gray."

Similarly, combinations of pigments may also be used to create a "black" look with optical windows for the functioning of security taggants.

Black color can be perceived in a range of shades. There are "warm" red or brown shaded blacks as well as "cool" or blue shaded blacks available. One method of describing color is the CIE Lab system.

Description of Thermal Transfer Ribbons which May Utilize the Preferred Transfer Layer.

Certain preferred embodiments of the invention are hereinafter described by reference to FIGS. 1 through 11.

FIG. 1 is a schematic representation of one preferred thermal ribbon 10 comprised of a thermal transfer layer 12 The ribbon depicted in this FIG. 1 is prepared in substantial accordance with the procedure described elsewhere in this specification.

In one embodiment, the thermal transfer layer 12 is preferably comprised of from about 1 to about 50 weight percent of a solid, thermoplastic binder; in one aspect of this embodiment, the thermal transfer layer is comprised of from about 2 to about 20 weight percent of such solid, thermoplastic binder.

As used herein, the term thermoplastic refers to a material which is composed of polymers, resins, rubbers, waxes and plasticizers. One may use any of the thermal transfer binders known to those skilled in the art. Thus, e.g., one may use one or more of the thermal transfer binders disclosed in U.S. Pat. Nos. 6,127,316, 6,124,239, 6,114,088, 6,113,725, 6,083,610, 6,031,556, 6,031,021, 6,013,409, 6,008,157, 5,985,076, and the like. The entire disclosure of each of these United States patents is hereby incorporated by reference into this specification.

By way of further illustration, one may use a thermoplastic binder which preferably has a softening point from about 45 to about 150 degrees Celsius and a multiplicity of polar moieties such as, e.g., carboxyl groups, hydroxyl groups, chloride groups, carboxylic acid groups, urethane groups, amide groups, amine groups, urea, epoxy resins, and the like. Some suitable binders within this class of binders include polyester resins, bisphenol-A polyesters, polvinyl chloride, copolymers made from terephthalic acid, polymethyl methacrylate, vinylchloride/vinylacetate resins, epoxy resins, polyamides, nylon resins, urethane formaldehyde resins, polyurethane, mixtures thereof, and the like.

In one embodiment, the thermoplastic binder is a resin obtained from the Arizona Chemical Corporation of Jacksonville, Fla. One may use one or more of the resins described in such company's U.S. Pat. No. 4,830,671 (ink compositions for inkjet printing), U.S. Pat. No. 5,194,638 (resinous binders for use ink in compositions), U.S. Pat. No. 5,455,326 (inkjet printing compositions), U.S. Pat. No. 5,645,632 (diesters of polymerized fatty acids useful as hot melt inks), U.S. Pat. No. 6,492,458 (polalkylenediamine polyamides), and the like. The entire disclosure of each of these United States patents is hereby incorporated by reference into this specification.

In one embodiment, the Arizona Chemical product used is Uni-Rez 2980, a polyesteramide resin.

In one embodiment, the binder is comprised of polybutylmethacrylate and polymethylmethacrylate, comprising from 10 to 30 percent of polybutylmethacrylate and from 50 to 80 percent of the polymethylacrylate. In one embodiment, this binder also is comprised of cellulose acetate propionate, ethylenevinylacetate, vinyl chloride/vinyl acetate, urethanes, etc. One may obtain these binders from many different commercial sources. Thus, e.g., some of them may be purchased from Dianal America of 9675 Bayport Blvd., Pasadena, Tex. 77507; suitable binders available from this source include "Dianal BR 113" and "Dianal BR 106." Similarly, suitable binders may also be obtained from the Eastman Chemicals Company (Tennessee Eastman Division, Box 511, Kingsport, Tenn.).

Referring again to FIG. 1, the thermal transfer layer 12 may optionally contain from about 0 to about 75 weight of wax and, preferably, 5 to about 20 percent of such wax. In one embodiment, layer 12 is comprised of from about 5 to about 10 weight percent of such wax. Suitable waxes which maybe used include carnuaba wax, rice wax, beeswax, candelilla wax, montan wax, paraffin wax, microcrystalline waxes, synthetic waxes such as oxidized wax, ester wax, low molecular weight polyethylene wax, Fischer-Tropsch wax, and the like. These and other waxes are well known to those skilled in the art and are described, e.g., in U.S. Pat. No. 5,776,280. One may also use ethoxylated high molecular weight alcohols, long chain high molecular weight linear alcohols, copolymers of alpha olefin and maleic anhydride, polyethylene, polypropylene, and the like.

These and other suitable waxes are commercially available from, e.g., the Baker-Hughes Baker Petrolite Company of 12645 West Airport Blvd., Sugarland, Tex.

In one preferred embodiment, carnuaba wax is used as the wax. As is known to those skilled in the art, carnuaba wax is a hard, high-melting lustrous wax which is composed largely of ceryl palmitate; see, e.g., pages 151-152 of George S. Brady et al.'s "Material's Handbook," Thirteenth Edition (McGraw-Hill Inc., New York, N.Y., 1991). Reference also may be had, e.g., to U.S. Pat. Nos. 6,024,950, 5,891,476, 5,665,462, 5,569,347, 5,536,627, 5,389,129, 4,873,078, 4,536,218, 4,497,851, 4,4610,490, and the like. The entire disclosure of each of these United States patents is hereby incorporated by reference into this specification.

Thermal transfer layer 12 may also be comprised of from about 0 to 16 weight percent of plasticizers adapted to plasticize the resin used. Those skilled in the art are aware of which plasticizers are suitable for softening any particular resin. In one embodiment, there is used from about 1 to about 15 weight percent, by dry weight, of a plasticizing agent. Thus, by way of illustration and not limitation, one may use one or more of the plasticizers disclosed in U.S. Pat. No. 5,776,280 including, e.g., adipic acid esters, phthalic acid esters, chlorinated biphenyls, citrates, epoxides, glycerols, glycol, hydrocarbons, chlorinated hydrocarbons, phosphates, esters of phthalic acid such as, e.g., di-2-ethylhexylphthalate, phthalic acid esters, polyethylene glycols, esters of citric acid, epoxides, adipic acid esters, and the like.

In one embodiment, layer 12 is comprised of from about 6 to about 12 weight percent of the plasticizer which, in one embodiment, is dioctyl phthalate. The use of this plasticizing agent is well known and is described, e.g., in U.S. Pat. Nos. 6,121,356, 6,117,572, 6,086,700, 6,060,214, 6,051,171, 6,051,097, 6,045,646, and the like. The entire disclosure of each of these United States patent applications is hereby incorporated by reference into this specification. Suitable plasticizers may be obtained from, e.g., the Eastman Chemical Company.

The thermal transfer layer 12, in one embodiment, is comprised of 50 to 99 weight percent of conductive metal particles. Metal particles such as those disclosed in pending Untied States Patent Applications 20060090600, 20060090598 and 20060207385 may be used.

The thermal transfer layer 12 may also optionally comprise from about 0.001 to about 1 weight percent of a dispersing agent which, in one embodiment, preferably is an anionic dispersing agent. Thus, e.g., one may use DISPERBYK-111, an anionic copolymer with acidic groups that has an acid value of 129 milliequivalents of KOH/gram.

The thermal transfer layer 12 may comprise a taggant. One may use any of the taggants well known to those skilled in the art. Some of these preferred taggants are described below.

The taggant used in thermal transfer layer 12 may be a taggant that exhibits "anti-Stokes fluorescence," as that term is defined in U.S. Pat. No. 6,686,074, the entire disclosure of which is hereby incorporated by reference into this specification The term "anti-Stokes fluorescence" is used in claim 1 of U.S. Pat. No. 6,686,074, that describes: "1. A secured document comprising a composition capable of anti-Stokes fluorescence comprising (a) a gadolinium oxysulfide selected from the group consisting of (1) a composition of the formula (Gd(1-x-y) Ybx Tmy)2 O2 S; and (2) a composition of the formula (Gd(1-x-y)2 O2 S:Ybx Tmy, wherein x and y are numbers greater than 0, wherein the wavelength of the emitted electromagnetic radiation is shorter than the wavelength of the absorbed electromagnetic radiation, and wherein the concentrations of Yb and Tm are adjusted to achieve concentration quenching of anti-Stokes luminescence."

As is disclosed in column 1 of U.S. Pat. No. 6,686,074, "When a phosphor or other luminescent material emits light, in general, it emits light according to Stoke's Law, which provides that the wavelength of the fluorescent or emitted light is always greater than the wavelength of the exciting radiation. While Stokes' Law holds for the majority of cases, it does not hold in certain instances. For example, in some cases, the wavelength is the same for both the absorbed and the emitted radiation. This is known as resonance radiation."

This patent also discloses that: "In other cases, Stoke's Law does not hold where the energy emitted is greater than the energy absorbed. This is known as anti-Stokes emission . . . . Anti-Stokes materials typically absorb IR radiation in the range of about 700 to about 1300 nanometers, and emit in the visible spectrum."

Referring again to FIG. 1, the thermal transfer layer 12 may comprise a taggant that is a non-green anti-stokes luminescent substance, as that term is described in U.S. Pat. No. 6,802,992, the entire disclosure of which is hereby incorporated by reference into this specification. A non-green anti-Stokes luminescent material is described in claim 1 of this patent. In the specification of U.S. Pat. No. 6,802,992, it is disclosed that: "The present invention relates to a non-green anti-Stokes luminescent material, to a process for its production and to its use. Luminescent materials which are capable of emitting in the visible light range when excited with infrared (IR) radiation are known, and are for example used in IR sensor cards for detection and positioning of IR lasers. Depending on the composition of the active lattices and of the dopants used, these materials briefly emit red, green or blue-green light when stimulated with IR radiation. A disadvantage with these materials is the fact that, using IR radiation, only energy stored beforehand—for example by excitation with visible light—is extracted. For IR detection, it is therefore in each case necessary to charge the materials. During continuous IR stimulation, the stored energy furthermore becomes used up, so that the emission of visible light falls off even after an extremely short time and, in the end, ceases. Continuous emission of visible light under IR radiation is therefore not possible with these IR-stimulable materials. Such luminescent materials based on ZnS:Cu,Co; Ca:Sm,Ce or SrS:Sm,Ce are described, for example, in Ullmann's Encyclopedia of Industrial Chemistry, vol. A15, "Luminescent Materials", 1990."

U.S. Pat. No. 6,802,992 also discloses that: "On the other hand, IR-to-visible up-conversion materials, or anti-Stokes luminescent materials, are known which convert IR radiation into visible light without prior charging. These materials use multiphoton excitation of active lattices with dopants from the rare earth metal group, in particular erbium in combination with ytterbium, in order to generate more energetic photons, and therefore visible light, from a plurality of low-energy IR photons. Materials based on fluorides are known, for example YF3:Er, Yb which is described by H. Kuroda et al., J. Phys. Soc. Jpn., vol. 33, 1, pp. 125-141 (1972). Disadvantages with these active lattices are that they are often difficult to produce with the exclusion of oxygen and that there is a tendency, depending on the composition of the active lattice, to instability in practical application, for example in application at high temperatures."

The thermal transfer layer 12 may comprise the anti-stokes luminescent compound of U.S. Pat. No. 6,841,092, the entire disclosure of which is hereby incorporated by reference into this specification. Claim 1 of this patent "A composition capable of anti-Stokes fluorescence, wherein the wavelength of the emitted electromagnetic radiation is shorter than the wavelength of the absorbed electromagnetic radiation . . . . "

Referring again to FIG. 1, the taggant in thermal transfer layer 12 may be a material that exhibits chemiluminescence. At page 254 of Hawley's Condensed Chemical Dictionary, Eleventh Edition (Van Nostrand Reinhold Company, New York, N.Y., 1987), chemiluminescence is defined as "The emission of absorbed energy (as light) due to a chemical reaction of the components of the system. It includes the subclasses bioluminescence and oxyluminescence in which light is produced by chemical reactions involving organisms and oxygen, respectively. Chemiluminescence occurs in thousands of chemical reactions covering a wide variety of compounds, both organic and inorganic. Emission of light by fireflies is a common example.

Referring again to FIG. 1, the taggant in layer 12 may exhibit daylight fluorescence, as that term is defined in U.S. Pat. No. 3,057,806, the entire disclosure of which is hereby incorporated by reference into this specification. Claim 1 of U.S. Pat. No. 3,057,806 refers to a daylight fluorescent crayon. Daylight fluorescence is referred to in column 1 of U.S. Pat. No. 3,057,806, wherein it is disclosed that " . . . daylight fluorescent colors are those which not only selectively reflect a predominant wave band of incident light (subtractive color) but also emit light of substantially the same wave band as the predominantly reflected band so as to give the daylight fluorescent colors a distinctive brightness. Such distinctive brightness is characterized by perceptibility of daylight fluorescent colors at a distance beyond the range of color distinguishability of the brightest subtractive color of the same hue."

Referring again to FIG. 1, the taggant in layer 12 may be a luminescent substance based upon a host lattice doped with at least one rare earth metal. U.S. Pat. No. 6,506,476, the entire disclosure of which is hereby incorporated by reference into this specification, describes (in claim 1 thereof) "1. Printed valuable document with at least one authentication feature in the form of a luminescent substance based upon a host lattice doped with at least one rare earth metal, which largely absorbs and is excitable in the visible region of the spectrum and is transparent at least in parts of the IR spectral region . . . . "

Referring again to FIG. 1, the taggant in layer 12 may be a fluorescent chelate, as that term is defined in U.S. Pat. No. 4,736,425, the entire disclosure of which is hereby incorporated by reference into this specification. Claim 1 of, e.g., U.S. Pat. No. 4,736,425 refers to the " . . . fluorescent properties of chelates . . . . " The thermal transfer layer 12 of thermal transfer ribbon 10 may comprise one or more of such fluorescent chelates, and/or one or more of the fluorescent chelates described in U.S. Pat. No. 4,891,505. Claim 1 of this latter patent describes "1. Apparatus to check a marking product comprising rare earth chelates or substrates . . . , the rare earth ion being present in the chelates arising from at least two different rare-earths, an energy transfer taking place between the two rare-earths and causing a change in fluorescence wavelength of the chelates when exposed to ultraviolet radiation as a function of the temperature of the chelate so made . . . . "

In one embodiment, the thermal transfer layer 12 is comprised of invisible ink as described, e.g., in U.S. Pat. No. 5,212,558, the entire disclosure of which is hereby incorporated by reference into this specification. Claim 1 of such patent describes a thermal transfer film in which invisible ink is disposed. This film is disclosed in column 7 of the patent, where it is taught that: "Thermal transfer film 30 . . . is characterized in that it has a multilayer structure made of a visible ink portion 31 and an invisible ink portion 32. A first separating layer 35 intervenes between the visible ink portion 31 and the invisible ink portion 32."

Referring again to FIG. 1, the thermal transfer layer 12 may comprise a light interference pigment such as, e.g., the pigment described in U.S. Pat. No. 6,210,777, the entire disclosure of which is hereby incorporated by reference into this specification. Claim 1 of such patent describes: a security document comprising " . . . a first light interference pigment." In column 1 of such patent, it is disclosed that: "In a particular case disclosed in U.S. Pat. No. 4,151,666, light-transmissive pigments serving as diffuse reflectors are applied by printing to form a verification pattern in a laminated identification card . . . . In the specification of the same US-P the use of nacreous pigments in verification patterns has been described. Nacresous pigments, also called pearlescent pigments have light-reflection characteristics that change as a function of the viewing or copying angle. The effect of changing color with viewing angle makes the nacreous pigments represent a simple and convenient matter to built in a verification feature associated with a non-copyable optical property." The thermal transfer layer 12 may comprise such a " . . . light interference pigment . . . . "

The taggant in the thermal transfer layer 12 may be a luminescent material such as, e.g., the material described in U.S. Pat. No. 6,802,992, the entire disclosure of which is hereby incorporated by reference into this specification. Claim 1 of such patent describes a "Non-green anti-Stokes luminescent material." This material comprises Yn, erbium, and ytterbium.

Luminescence is the emission of visible or invisible radiation unaccompanied by high temperature of any substance as a result of absorption of exciting energy in the form of photons, charged particles, or chemical change. It is a generic term that includes both fluorescence and phosphorescence. Special types include chemiluminescence, bioluminescence, photoluminescence, and tribololuminescence. Reference may be had, e.g., to page 714 of "Hawley's Condensed Chemical Dictionary," Eleventh Edition, supra.

Referring again to FIG. 1, the thermal transfer layer 12 may comprise magnetic material such as, e.g., the material described in U.S. Pat. Nos. 4,183,989 and 6,146,773, the entire disclosure of each of which is hereby incorporated by reference into this specification. U.S. Pat. No. 4,183,989 discloses a security paper comprised of a "magnetic material" and, additionally either a luminescent material, an x-ray absorbent, or a non-magnetic material. Claim 1 of this patent describes: "1. A security paper which contains a security device lying substantially within the body of the paper and having at least two distinct machine verifiable security features, a first of the security features being a magnetic material and the second feature being a second and different material selected from the group consisting of: a luminescent material, an x-ray absorbent, and a non-magnetic metal."

U.S. Pat. No. 6,146,773 describes a security document provided with a magnetic security element. Claim 1 of this patent describes: "1. A method for producing a security document comprising a security element, said security element comprising a layer of magnetic material, said magnetic material being a crystalline powdery material with a coercivity of between 10 and 250 Oe for a range of remanences, said range of remanences within 100 nWb/m2 to 1000 nWb/m2, said method comprising the steps of: mixing the crystalline powdery material with a binder to yield a magnetic ink; printing the magnetic ink at least in partial areas of a carrier; and combining the carrier with a security document."

The magnetic material used in thermal transfer layer 12 may be coded, as is disclosed in U.S. Pat. No. 6,491,324, the entire disclosure of which is hereby incorporated by reference into this specification. This patent discloses a security element comprised of a layer of "coded magnetic material."

Thermal transfer layers 12, comprised of magnetic pigments, are often black in color. By constructing a thermal transfer ribbon 10 with a thermal transfer layer 12 comprised of magnetic and non-magnetic regions of virtually the same color, a covert code may be embedded in such a ribbon. The magnetic regions, in one embodiment, have a specific size, shape and frequency. When such a thermal transfer layer 12 is thermally printed onto a receiver sheet, the discrete magnetic pattern of the layer is essentially preserved in the print. Such a pattern is not obvious upon visual examination of the printed receiver sheet. However, through covert detection means, such as a magnetic field detector, such a pattern can be verified.

Claim 1 of U.S. Pat. No. 6,491,324 describes: "1. A security element for protecting objects comprising: at least one machine testable magnetic layer; and at least one additional layer, wherein said additional layer is a semitransparent layer in a visual spectral region and comprises a screened layer having opaque screen elements incorporated therein, wherein said semitransparent layer covers the magnetic layer such that said magnetic layer remains at least partly visually recognizable under the semitransparent layer."

The magnetic material in the thermal transfer layer 12 may be "soft," as is described in U.S. Pat. No. 5,697,649, the entire disclosure of which is hereby incorporated by reference into this specification. Claim 1 of this patent describes: "1. An article for use with security documents that comprises a plastic substrate having at least one security feature located thereon, wherein said security feature is a machine detectable security feature comprising a layer of a soft magnetic metal, wherein said soft magnetic metal is an amorphous metal glass having a low magnetic coercivity of from about 50 to about 5000 amperes per meter, and wherein said layer of said soft magnetic metal has a thickness ranging from about 0.10 to 0.50 microns." This soft magnetic metal may advantageously be used in the thermal transfer ribbon of this invention. Particles, flakes and filaments of such soft magnetic metal glasses may be incorporated, e.g., into the thermal imaging layer 12 so long as they do not exceed 20 microns in any one dimension. Such soft magnetic metal glasses would then be thermally printable to a receiver sheet, adding a covert, magnetically detectable security feature along with the digitally printed thermal transfer image.

The magnetic material in thermal transfer layer 12 may a polymeric magnetic material, as disclosed, e.g., in U.S. Pat. No. 5,601,931, the entire disclosure of which is hereby incorporated by reference into this specification. One may use blends of polymeric and non-polymeric magnetic material. The use of such blends of magnetic metal powders and polymeric materials is well known to those skilled in the art. Codes, encrypted text and alphanumerics printed onto receiver sheets with such thermal transfer ribbons are magnetic and can be easily detected using Magnetic Ink Character Recognition (MICR) equipment and other means. Alternatively, or additionally, such magnetic material may be incorporated into the substrate which is printed by the thermal transfer ribbon.

Referring again to FIG. 1, the thermal transfer layer 12 may comprise multi-detectable ink compositions such as, e.g., the ink compositions disclosed in U.S. Pat. Nos. 3,928,226 and 4,015,131, the entire disclosure of each of which is hereby incorporated by reference into this specification. Claim 1 of the former patent describes: "1. A machine-readable marking ink composition having two or more mixed pigments . . . whereby the color of the ink under mixed light is different than the florescent color of the ink when irradiated at the fluorescent wavelength of said fluorescent pigment."

The thermal transfer layer 12 may comprise an optically variable material such as, e.g., the material disclosed in U.S. Pat. No. 7,040,663, the entire disclosure of which is hereby incorporated by reference into this specification. Claim 1 of this patent describes a "document of value" comprised of a security element with an optically variable material that conveys different color effects at different viewing angles, and at least one machine-readable feature substance that does not impair a visually visible optically variable effect of the optically variable material.

The thermal transfer layer may comprise a phosphorescence activator such as, e.g., the activators described in U.S. Pat. No. 4,500,116, the entire disclosure of which is hereby incorporated by reference into this specification. The abstract of this patent describes: "A credential, such as a passport on an identification card, is provided, for example, by impregnation of coating with phosphorescent composition which includes at least two phorescence activators which exhibit different emission characteristics both with respect to wavelength and lifetime so that, when the composition is irradiated, the initial afterglow changes color, for example from green to blue."

Referring again to FIG. 1, the thermal transfer layer 12 may comprise one or more radiant energy reflectors such as, e.g., the material disclosed in U.S. Pat. No. 4,044,231, the entire disclosure of which is hereby incorporated by reference into this specification. This patent discloses a "fraud resistant document" comprised of " . . . a plurality of radiant energy reflectors . . . . " Claim 1 of this patent describes: "1. A fraud resistant document comprising: a main body, a plurality of radiant energy reflectors overlying said main body in a data area for reflecting incident radiant energy of predetermined characteristics, a magnetic recording member overlying said radiant energy reflectors, said member being substantially transparent to said radiant energy and generally opaque to normal visible light whereby said reflectors are at least partially concealed against detection by the naked eye, and a layer of material on the bottom of said magnetic recording member having a lower reflector-receiving surface interfacing with said reflectors, said layer of material being substantially transparent to said radiant energy and said surface having known general microtopographical characteristics, said reflectors comprising thin elements particle deposited onto said reflector-receiving surface, each element having a reflective surface interfacing with said reflector-receiving surface and having substantially the same microtopographical characteristics as said reflector-receiving surface."

The thermal transfer layer 12 may comprise sensible material as is disclosed, e.g., in U.S. Pat. No. 3,639,166, the entire disclosure of which is hereby incorporated by reference into this specification. Claim 1 of this patent discloses a transfer medium comprised of from about 1 to about 45 weight percent of a "sensible material." This "sensible material" is discussed in columns 7 and 8 of the patent, wherein it is disclosed that: "The sensible material used in the present invention can be any material which is capable of being sensed visually, by optical means, by photoelectric means, by magnetic means, by electroconductive means, or by any other means sensitive to the sensible material."

A similar sensible material is disclosed in U.S. Pat. No. 3,663,278, the entire disclosure of which is hereby incorporated by reference into this specification. In the abstract of such patent, there is described: "A thermal transfer medium comprising a base having a transferable coating composition thereon. The coating composition comprises a cellulosic polymer, a thermoplastic resin, a plasticizer, and " . . . about 1 to 4 percent by weight of a sensible material."

The thermal transfer layer 12 may comprise a luminophore moiety such as is disclosed, e.g., in U.S. Pat. No. 4,992,204, the entire disclosure of which is hereby incorporated by reference into this specification. Claim 1 of this patent describes: "1. A method for tagging one or more mixtures of natural or synthetic materials comprising contacting the same with one or a mixture of substantially colorless tagging compounds, each of which is comprised of one or more non-ionic luminophore moieties . . . . "

Referring again to FIG. 1, the thermoplastic material in transfer layer 12 may be tagged with a taggant copolymerized therewith. U.S. Pat. No. 5,461,136, the entire disclosure of which is hereby incorporated by reference into this specification, describes a thermoplastic polymer composition having, as a taggant, copolymerized therewith at least 0.1 parts per million of near IR fluorescing compounds."

Referring again to FIG. 1, the taggant used in thermal transfer layer 12 may be an upconverter phosphor. Reference may be had, e.g., to U.S. Pat. No. 6,132,642, the entire disclosure of which is hereby incorporated by reference into this specification. Such patent discloses a process for preparing "upconverter phosphors." In the abstract of this patent, there is disclosed "A process for preparing phosphor particles having a particle size of 1 micron or less and that are spherical in shape."

In column 1 of this patent, it is disclosed that: "Phosphors typically comprise one or more rare earth metals in a host material. Up-converter phosphors emit light in the visible wavelength radiation range (550-800 nanometers) when excited by long wavelength radiation, e.g., light in the IR wavelength spectrum. This is accomplished by multiple absorption of IR photons and energy transfer between the absorbing and emitting ions."

The taggant used in thermal transfer layer 12 may be an up-conversion material such as, e.g., one or more of the materials disclosed in U.S. Pat. No. 6,802,992, the entire disclosure of which is hereby incorporated by reference into this specification. As is known to those skilled in the art, another term for "anti-Stokes luminescent materials" is "IR-to-visible up-conversion materials." In column 1 of U.S. Pat. No. 6,802,992 it is disclosed that: " . . . IR-to-visible up-conversion materials, or anti-Stokes luminescent materials, are known which convert IR radiation into visible light without prior charging."

The taggant used in thermal transfer layer 12 may, e.g., be a variable afterglow material. U.S. Pat. No. 4,500,116, the entire disclosure of which is hereby incorporated by reference into this specification, discloses a phosphorescent composition whose afterglow, over time, changes color. According to the abstract of such patent, there is provided "A credential . . . which includes at least two phosphorescence activators which exhibit different emission characteristics both with respect to wavelength and lifetime so that, when the composition is irradiated, the initial afterglow changes color, for example from green to blue."

Referring again to FIG. 1, and in the embodiment depicted, a "security feature" is preferably disposed in the thermal transfer layer 12 and/or in an optional release layer (not shown in FIG. 1) These "security features" are discussed in many prior art patents. Thus, e.g., in U.S. Pat. No. 6,930,606, the entire disclosure of which is hereby incorporated by reference into this specification, it is disclosed that: "It is known that secure documents or instruments may be rendered less susceptible to forgery or counterfeiting by including security features in various forms within the body of the document. In fact, the security or integrity of a document or instrument will increase with the number of separate and distinct security features that it employs."

It is also disclosed in U.S. Pat. No. 6,930,606 that: "Many security papers and other items of value include a security device or element, such as a security thread, disposed on or within the document. The security device typically includes one or more security features, such as metallic, magnetic, x-ray absorbent, and/or luminescent security features, that serve to authenticate the security paper and prevent or deter counterfeiting."

It is also disclosed in U.S. Pat. No. 6,930,606 that: "It has long been recognized that while visually detectable or public security features are both necessary and desirable, the use of non-apparent and/or concealed, machine testable security features offer a heightened level of security. If a counterfeiter does not recognize that a particular security feature is present within a document, attempts would not be made to reproduce that feature."

Referring again to FIG. 1, and in one preferred embodiment thereof, the security feature in thermal transfer layer 12 and/or in the optional release layer, is a photochromic dye. There may be one or more such photochromic dyes in layer 12 and/or in the release layer. As is known to those skilled in the art, a photochromic material is a material that changes color when exposed to visible or near visible radiant energy. Reference may be had, e.g., to U.S. Pat. No. 4,166,043 (stabilized photochromic materials), U.S. Pat. No. 4,367,170 (stabilized photochromic materials), U.S. Pat. No. 4,720,356 (photochromic composition resistant to fatigue), U.S. Pat. No. 4,857,438 (photochromic system and layers produced therewith), U.S. Pat. No. 4,880,667 (photochromic plastic article), U.S. Pat. No. 5,698,020 (photochromic dental material), U.S. Pat. No. 5,759,729 (photochromic electrostatic toner compositions), U.S. Pat. No. 5,763,511 (organic photochromic materials), U.S. Pat. No. 5,914,174 (photochromic resin compositions), U.S. Pat. No. 5,959,761 (incorporating photochromic molecules in light transmissible articles), U.S. Pat. No. 5,975,696 (process for rendering plastic substrate photochromic), U.S. Pat. No. 6,004,486 (photochromic spiroxazines), U.S. Pat. No. 6,034,193 (photochromic organic materials), U.S. Pat. No. 6,083,427 (stabilized matrix for photochromic articles), U.S. Pat. No. 6,096,246 (photochromic naphthopyrans), U.S. Pat. No. 6,114,437 (polycarbonate articles with photochromic properties), U.S. Pat. No. 6,171,525 (process for the production of a photochromic object), U.S. Pat. No. 6,451,236 (method of making photochromic thermoplastics), U.S. Pat. No. 6,616,964 (method and preparation for the photochromic marking and/or securing the authenticity of articles). U.S. Pat. No. 6,639,039 (photochromic coating composition comprising nanoscales particles), U.S. Pat. No. 6,853,471 (photochromic synthetic resin object with permanently increased contrast), U.S. Pat. No. 6,933,325 (high index curable photochromic composition), and the like. The entire disclosure of each of these United States patents is hereby incorporated by reference into this specification.

Referring again to FIG. 1, and in one preferred embodiment thereof, the security feature in thermal transfer layer 12 and/or in the optional release layer, may be a thermochromic material, that is a material that changes its optical properties upon a change of its temperature. Such materials are well known to those skilled in the art. Reference may be had, e.g., to U.S. Pat. No. 4,424,990 (thermochromic compositions), U.S. Pat. No. 4,620,941 (thermochromic compositions), U.S. Pat. No. 5,873,932 (reversible thermochromic compositions), U.S. Pat. No. 5,879,438 (reversible thermochromic compositions) U.S. Pat. No. 5,919,404 (reversible thermochromic compositions), U.S. Pat. No. 6,908,505 (thermochromic compositions of color formers and Lewis acids) and the like. The entire disclosure of each of these United States patents is hereby incorporated by reference into this specification.

U.S. Pat. No. 6,908,505 is illustrative of these thermochromic materials. There is disclosed and claimed in this patent: "1. A thermochromic composition comprised of at least one color former and at least one Lewis acid introduced into a polymer containing material, wherein said polymer containing material is transparent, or substantially transparent, below a lower critical solution temperature (LCST), said polymer containing material reversibly becoming non-transparent above the lower critical solution temperature."

Referring again to FIG. 1, and in one preferred embodiment thereof, the security feature in thermal transfer layer 12 and/or in the optional release layer, is a mechanochromic material. As used in this specification, the term "mechanochromic" means that the optical absorption of the material in the visible portion of the spectrum can be manipulated by mechanical means, such as stretching and, preferably, is reversible.

One example of a mechanochromic material is disclosed in U.S. Pat. No. 4,721,769, the entire disclosure of which is hereby incorporated by reference into this specification. As is disclosed in such patent, "The diacetylene group, —C.t-bd.C—C.tbd.C—, is a highly reactive functionality that, in the correct solid-state geometry, can be topochemically polymerized using heat, chemical radicals, or radiation into a fully conjugated polymer with extensive pi-electron delocalization along its main chain backbone. See Wegner, G. (1979) "MOLECULAR METALS", W. E. Hatfield, ed., Plenum Press, New York and London, 209-242. Since the polymerization is topochemical, the kinetics of the reaction and the structure of the final product can be directly attributed to the geometric arrangement of the reacting groups in the solid-state. See Baughman, R. H., J. POLYM. SCI. POLYM. PHYS. ED., 12, 1511 (1974)."

U.S. Pat. No. 4,721,769 also discloses that: "The fully extended unsaturated backbone of the polydiacetylenes gives rise to many of the novel properties of these materials, such as their highly anisotropic optical, electrical, dielectric, and mechanical properties. In particular, polydiacetylenes have been found to exhibit large nonlinear optical susceptibilities comparable to inorganic semiconductors making them attractive materials for optical signal processing. See Muller, H., Eckhardt, C. J., Chance, R. R., and Baughman, R. H., CHEM. PHYS. LETT., 50, 22 (1979). This is a direct consequence of the strong variations in the polarizability of the backbone which result from the one-dimensional nature of this system. Also, in some cases, it is possible to prepare large area nearly defect-free single crystals of polydiacetylenes which offer unique optical properties. See Baughman, R. H., Yee, K. C., J. POLYM. SCI. MARCROMOL. REV., 13, 219 (1978)."

U.S. Pat. No. 4,721,769 also discloses that: "An advantage of these diacetylene segmented copolymers is that upon cross-polymerization the resultant product retains elastomeric properties. As a result of this, cross-polymerized diacetylene copolymers have been produced which exhibit reversible mechanochromic properties, i.e., the optical absorption characteristics of the material can be manipulated by mechanical means such as stretching. Also, it is possible to produce cross-polymerized elastomeric-diacetylene copolymers which exhibit thermochromic properties, i.e., the color of the material can be changed upon heating or cooling."

U.S. Pat. No. 4,721,769 also discloses that: "Certain segmented copolymers of this invention exhibit thermochromic properties. "Thermochromic" as used herein refers to a reversible color change upon heating or cooling which is observed in some of the diacetylene-segmented copolymers of this invention."

U.S. Pat. No. 4,721,769 also discloses that: "Certain segmented copolymers of this invention exhibit mechanochromic behavior. By "mechanochromic" it is meant that the optical absorption of the material in the visible portion of the spectrum can be manipulated by mechanical means, such as stretching. This property has heretofore never been seen in polydiacetylenes; it is unique to diacetylene segmented copolymers. See for example, FIG. 3."

Referring again to FIG. 1, and in one preferred embodiment thereof, the security feature in thermal transfer layer 12 and/or in the optional release layer, is an electrochromic material that changes its color when positively or negatively charged. These materials are well known to those skilled in the art and are described, e.g., U.S. Pat. No. 4,325,611 (electrochromic material and electro-optical display using same), U.S. Pat. No. 4,562,056 (electrochromic material and lubricant), U.S. Pat. No. 4,669,830 (electrochromic material and lubricant), U.S. Pat. No. 4,750,817 (organic electrochromic material), U.S. Pat. No. 4,842,382 (new cathodic electrochemical material), U.S. Pat. No. 5,204,937 (neural data-processing net with electrochromic material regions), U.S. Pat. No. 5,288,381 (method of producing electrochromic material), U.S. Pat. No. 5,768,004 (oxidatively coloring electrochromic material), U.S. Pat. No. 6,127,516 (electrochromic material based upon a conducting ladder polymer), and the like. The entire disclosure of each of these United States patents is hereby incorporated by reference into this specification. Reference also may be had, e.g., to United States published patent applications 20030099849 (electrochromic material and method for making the same), and 20050179012 (electrochromic material with improved lifetime), the entire disclosures of each of which are hereby incorporated by reference into this specification.

Referring again to FIG. 1, and in one preferred embodiment thereof, the security feature in thermal transfer layer 12 and/or in the optional release layer, is a chemochromic material that changes its optical properties when a chemical reaction occurs that liberates a specified chemical moiety. These chemochromic materials are well known and are disclosed, e.g., in U.S. Pat. No. 6,277,589 (chemochromic sensor), U.S. Pat. No. 6,448,068 (chemochromic sensor), and U.S. Pat. No. 7,008,795 (chemochromic sensor); the entire disclosure of each of these United States patents is hereby incorporated by reference into this specification. Reference also may be had to published United States patent applications 2001/0041351 and 2004/0057873, the disclosure of each of which is hereby incorporated by reference into this specification.

Referring again to FIG. 1, and in one preferred embodiment thereof, the security feature in thermal transfer layer 12 and/or in the optional release layer, is one or more quantum dots. These quantum dots are described in, e.g., U.S. Pat. No. 6,633,370. Reference also may be had, e.g., to U.S. Pat. No. 5,229,320 (method of forming quantum dots), U.S. Pat. No. 5,965,212 (method of producing metal quantum dots), U.S. Pat. No. 5,989,947 (method of producing quantum structures), U.S. Pat. No. 6,235,618 (method for forming nanometer-sized silicon quantum dots), U.S. Pat. No. 6,329,668 (quantum dots for optoelectronic devices), U.S. Pat. No. 6,375,737 (method of self assembly silicon quantum dots), U.S. Pat. No. 6,541,788 (mid IR and near IR light upconverter using self-assembled quantum dots), U.S. Pat. No. 6,573,527 (quantum semiconductor device including quantum dots and a fabrication process thereof), U.S. Pat. No. 6,596,555 (forming of quantum dots), 6,645,885 (indium nitride and indium gallium nitride quantum dots), U.S. Pat. No. 6,734,105 (method for forming silicon quantum dots), U.S. Pat. No. 6,774,014 (spherical quantum dots), U.S. Pat. No. 6,794,265 (method of forming quantum dots of Group IV semiconductor materials), 6,859,477 (quantum dots having proximity-placed acceptor impurities), 7,022,628 (formation of quantum dots using metal thin film or metal powder), U.S. Pat. No. 7,065,285 (polymeric compositions comprising quantum dots), and the like. The entire disclosure of each of these United States patents is hereby incorporated by reference into this specification.

Referring again to FIG. 1, and in one preferred embodiment thereof, the security feature in thermal transfer layer 12 and/or in the optional release layer, is a taggant. These taggants are well known and have been discussed elsewhere in this specification. Reference also may be had, e.g., to U.S. Pat. No. 4,359,399 (taggants with explosive induced magnetic susceptibility), U.S. Pat. No. 4,652,395 (taggant composition), U.S. Pat. No. 5,301,044 (marking material containing a taggant), U.S. Pat. No. 5,760,394 (isotropic taggant method and composition), U.S. Pat. No. 6,007,744 (polymerizable dyes as taggants), U.S. Pat. No. 6,025,200 (method for remote detection of volatile taggant), U.S. Pat. No. 6,528,318 (scatter controlled emission for optical taggants and chemical sensors), U.S. Pat. No. 6,610,351 (Raman-active taggants and their recognition), U.S. Pat. No. 6,644,917 (smart coating system with chemical taggants for coating condition assessment), U.S. Pat. No. 6,647,649 (microparticle taggant system), U.S. Pat. No. 6,899,827 (inorganic optical taggant), U.S. Pat. No. 6,989,525 (method for using very small particles as obscurants and taggants), U.S. Pat. No. 7,055,691 (plastic packaging having embedded micro-particle taggants), and the like. The entire disclosure of each of these United States patents is hereby incorporated by reference into this specification.

By way of further illustration of suitable taggants, reference may be had, e.g., to published United States patent applications 2002/0025490 (Raman-active taggants and their recognition), 2002/0129523 (microparticle taggant system), 2003/0109049 (sensors and taggants utilizing scatter controlled emission), 2003/0118440 (smart coating system with chemical taggants for coating condition assessment), 2004/0058058 (Raman-active taggants and their recognition), 2004/0067360 (microstructured taggant particles), applications, and methods of making the same), 2004/0098891 (microparticle taggant systems), 2004/0227112 (method for using very small particles as obscurants and taggants), 2005/0092408 (inorganic optical taggant), 2005/0181511 (method of use of taggants), 2005/0189255 (plastic packaging having embedded micro-particle taggants), Ser. No.2005/0227068 (taggant fibers), 2005/025599 (erasable taggant distribution channel validation method and system), 2006/0014045 (security taggants in adhesive plastic film laminate), 2006/0038979 (nanoparticles as covert taggants in currency, bank notes, and related documents), 2006/0037222 (taggants for products and method of taggant identification), and the like. The disclosure of each of these published United States patent applications is hereby incorporated by reference into this specification.

Referring again to FIG. 1, and in one preferred embodiment thereof, the security feature in thermal transfer layer 12 and/or in the optional release layer, is an iridescent material. As is known to those skilled in the art, iridescence is the rainbow exhibition of colors, usually caused by interference of light of different wavelengths reflected from superficial layers in the surface of a material. The preparation of iridescent materials is well known to those skilled in the art. Reference may be had, e.g., to U.S. Pat. No. 3,388,198 (iridescent filament), U.S. Pat. No. 3,400,036 (article having iridescent surface and method of making same), U.S. Pat. No. 3,481,663 (iridescent articles), U.S. Pat. No. 3,493,410 (high luster iridescent nacreous pigment), U.S. Pat. No. 3,549,405 (iridescent resinous film bodies), U.S. Pat. No. 3,576,707 (multilayered iridescent articles), U.S. Pat. No. 3,698,930 (process for the preparation of iridescent films and filaments), U.S. Pat. No. 3,733,371 (iridescent composition and method of its preparation), U.S. Pat. No. 3,745,097 (iridescent chromium coating), U.S. Pat. No. 3,944,661 (iridescent flakes), U.S. Pat. No. 3,969,433 (iridescent composition), U.S. Pat. No. 4,138,516 (geometric iridescent image), U.S. Pat. No. 4,184,872 (iridescent pigments), U.S. Pat. No. 4,980,220 (iridescent plastics and process for producing the same), U.S. Pat. No. 5,089,318 (iridescent film with thermoplastic elastomeric components), U.S. Pat. No. 5,393,354 (iridescent chromium coatings), U.S. Pat. No. 5,451,449 (colored iridescent film), U.S. Pat. No. 5,635,283 (trading card with iridescent substrate), U.S. Pat. No. 5,741,590 (iridescent fabrics), U.S. Pat. No. 56,314,906 (boat structure including iridescent particles), U.S. Pat. No. 6,602,585 (shrinkable iridescent film), and the like. The entire disclosure of each of these United States patents is hereby incorporated by reference into this specification.

Referring again to FIG. 1, and in one preferred embodiment thereof, the security feature in thermal transfer layer 12 and/or in the optional release layer, may be expandable microspheres such as, e.g., expandable thermoplastic polymer beads.

As is known to those skilled in the art, expandable thermoplastic polymer beads are micro spheres each comprising a thermoplastic polymer shell and a blowing agent as entrapped therein. When such expandable beads are heated at a temperature high enough to induce a sufficient degree of expansion for a certain length of time, expanded thermoplastic polymer beads are obtained. For example, when expandable micro sphere beads measuring about 15 microns in diameter and having a true specific weight of about 1.3 kilograms per liter are expanded by heating, expanded micro spheres measuring about 60 microns and having a true specific weight of about 0.03 kilograms per liter may be obtained. By formulating those expanded micro spheres in various paints, coating agents, molding compounds, putty, FRP, adhesives, sealants, water-proofing materials, etc. the weights of final products can be decreased.

Expandable microspheres are disclosed in many prior art patents. Reference may be had, e.g., to U.S. Pat. No. 3,914, 360 (expansion of expandable synthetic resinous microspheres), U.S. Pat. No. 4,179,546 (method for expanding microspheres and expandable composition), U.S. Pat. No. 4,200,679 (micro-bits of expanded flexible polyurethanes), U.S. Pat. No. 4,207,378 (expanded styrene-polymers and polyolefin micro-bits and their preparation), U.S. Pat. No. 4,304,873 (preparation of expanded flexible polyurethane foam micro-bits), U.S. Pat. No. 4,610,923 (laminated fabric structure containing microspheres), U.S. Pat. No. 4,902,722 (mixture of unexpanded and expanded hollow polymeric microspheres), U.S. Pat. No. 6,225,361 (expanded hollow micro sphere composite beads and method for their production), U.S. Pat. No. 6,864,297 (polymer microspheres reinforced with long fibers), U.S. Pat. No. 7,033,527 (highly porous ceramics made from preceramic polymer and expandable microspheres), and the like. The entire disclosure of each of these United States patents is hereby incorporated by reference into this specification.

Reference may also be had to published United States patent applications 2001/0021417 (microspheres with improved thermal resistance), 2002/20104632 (opacity enhancement of tissue products with thermally expandable microspheres), 2004/0176486 (foam insulation made with expandable microspheres), 2004/0176487 (method and expansion device for preparing expanded thermoplastic microspheres), 2004/0249005 (microspheres), 2006/0000569 (microspheres), 2006/0102307 (microspheres), and the like. The entire disclosure of each of these published United States patent applications is hereby incorporated by reference into this specification.

The disclosure of published United States patent application 2006/0102307 is of interest, and some of it is presented below.

"Expandable thermoplastic microspheres comprising a thermoplastic polymer shell and a propellant entrapped therein are commercially available under the trademark EXPANCEL® and are used as a foaming agent in many different applications."

Published United States patent application US2006/0102307, the entire disclosure of which is hereby incorporated by reference into this specification, also discloses that: "In such microspheres, the propellant is normally a liquid having a boiling temperature not higher than the softening temperature of the thermoplastic polymer shell. Upon heating, the propellant evaporates to increase the internal pressure at the same time as the shell softens, resulting in significant expansion of the microspheres. The temperature at which the expansion starts is called Tstart, while the temperature at which maximum expansion is reached is called Tmax. Expandable microspheres are marketed in various forms, e.g. as dry free flowing particles, as an aqueous slurry or as a partially dewatered wet-cake."

Published U.S. patent application US2006/0102307 also discloses that: "Expandable microspheres can be produced by polymerising ethylenically unsaturated monomers in the presence of a propellant. Detailed descriptions of various expandable microspheres and their production can be found in, for example, U.S. Pat. Nos. 3,615,972, 3,945,956, 5,536,756, 6,235,800, 6,235,394 and 6,509,384, and in EP 486080."

Published U.S. patent application US2006/0102307 also discloses that: "The invention thus concerns use of thermally expandable microspheres comprising a thermoplastic polymer shell and from about 17 to about 40 wt %, preferably from about 18 to about 40 wt %, most preferably from about 19 to about 40 wt %, particularly most preferably from about 20 to about 35 wt % of a propellant entrapped in said polymer shell, and having a volume-average diameter from about 17 to about 35 μm, preferably from about 18 to about 35 μm, more preferably from about 19 to about 35 μm, most preferably from about 20 to about 30 μm, particularly most preferably from about 21 to about 30 μm, in the production of paper or non-woven for Increasing the bulk thereof."

Published U.S. patent application US2006/0102307 also discloses that: "The term expandable microspheres as used herein refers to expandable microspheres that have not previously been expanded, i.e. unexpanded expandable microspheres."

Published U.S. patent application US2006/0102307 also discloses that: "The thermoplastic polymer shell of the expandable microspheres is suitably made of a homo- or co-polymer obtained by polymerising ethylenically unsaturated monomers. Those monomers can, for example, be nitrile containing monomers such as acrylonitrile, methacrylonitrile, α-chloroacrylonitrile, α-ethoxyacrylonitrile, fumaronitrile or crotonitrile; acrylic esters such as methyl acrylate or ethyl acrylate; methacrylic esters such as methyl methacrylate, isobornyl methacrylate or ethyl methacrylate; vinyl halides such as vinyl chloride; vinyl esters such as vinyl acetate other vinyl monomers such as vinyl pyridine; vinylidene halides such as vinylidene chloride; styrenes such as styrene, halogenated styrenes or α-methyl styrene; or dienes such as butadiene, isoprene and chloroprene. Any mixtures of the above mentioned monomers may also be used."

Published U.S. patent application 2006/0102307 also discloses that "The propellant is normally a liquid having a boiling temperature not higher than the softening temperature of the thermoplastic polymer shell and may comprise hydrocarbons such as propane, n-pentane, isopentane, neopentane, butane, isobutane, hexane, isohexane, neohexane, heptane, isoheptane, octane or isooctane, or mixtures thereof. Aside from them, other hydrocarbon types can also be used, such as petroleum ether, or chlorinated or fluorinated hydrocarbons, such as methyl chloride, methylene chloride, dichloroethane, dichloroethylene, trichloroethane, trichloroethylene, trichlorofluoromethane, perfluorinated hydrocarbons, etc. Preferred propellants comprise isobutane, alone or in a mixture with one or more other hydrocarbons. The boiling point at atmospheric pressure is preferably within the range from about −50 to about 100° C., most preferably from about −20 to about 50° C., particularly most preferably from about −20 to about 30° C."

Published U.S. patent application 2006/0102307 also discloses that: "part from the polymer shell and the propellant the microspheres may comprise further substances added during the production thereof, normally in an amount from about 1 to about 20 wt %, preferably from about 2 to about 10 wt %. Examples of such substances are solid suspending agents, such as one or more of silica, chalk, bentonite, starch, crosslinked polymers, methyl cellulose, gum agar, hydroxypropyl methylcellulose, carboxy methylcellulose, colloidal clays, and/or one or more salts, oxides or hydroxides of metals like Al, Ca, Mg, Ba, Fe, Zn, Ni and Mn, for example one or more of calcium phosphate, calcium carbonate, magnesium hydroxide, barium sulphate, calcium oxalate, and hydroxides of aluminium, iron, zinc, nickel or manganese. If present, these solid suspending agents are normally mainly located to the outer surface of the polymer shell. However, even if a suspending agent has been added during the production of the microspheres, this may have been washed off at a later stage and could thus be substantially absent from the final product." In one embodiment, the microspheres may comprise one or more taggant materials.

Referring again to FIG. 1, and in one preferred embodiment thereof, the security feature in thermal transfer layer 12 and/or in the optional release layer, is a magnetic taggant such as, e.g., the magnetic taggant disclosed in U.S. Pat. No. 6,212,504, the entire disclosure of which is hereby incorporated by reference into this specification. These magnetic taggants are well known. Reference may be had, e.g., to such U.S. Pat. No. 6,212,504, which discloses that the magnetic taggant is " . . . a marking, done with a substance having magnetic remanence, which can be added to a document or item to impart a special property which can be sensed or detected without destruction. Often this involves a magnetically-loaded printing-ink that can be placed on an object or item."

Referring again to FIG. 1, the security feature in thermal transfer layer 12 (such as, e.g., a photochromic dye) may be present, e.g., at a concentration of from about 1 to about 25 weight percent, by total weight of such thermal transfer layer. Such security feature (e.g., such photochromic dye) is preferably homogeneously dispersed in one embodiment. In another embodiment, the security feature is non-homogeneously dispersed in the layer 107. In yet another embodiment, there are "gaps" in such layer 12.

Referring again to ribbon 10, it will be seen that such ribbon 10 preferably comprises a support 14 that, preferably, is a flexible support. In one embodiment, such flexible support is preferably comprised of biaxially oriented polyester film with has a thickness of from about 1.5 to about 15 microns.

In one embodiment, support 14 is a flexible material that comprises a smooth, tissue-type paper such as, e.g., 30-40 gauge capacitor tissue. In another embodiment, substrate 12 is a flexible material consisting essentially of synthetic polymeric material, such as poly(ethylene terephthalate) polyester with a thickness of from about 1.5 to about 15 microns which, preferably, is biaxially oriented. Thus, by way of illustration and not limitation, one may use polyester film supplied by the Toray Plastics of America (of 50 Belvere Avenue, North Kingstown, R.I.) as catalog number F53. Thus, e.g., polyester film other than poly(ethylene terephthalate) film may also be used.

Substrate 12 may be any substrate typically used in thermal transfer ribbons such as, e.g., the substrates described in U.S. Pat. No. 5,776,280; the entire disclosure of which is hereby incorporated by reference into this specification.

By way of further illustration, substrate 12 may be any of the substrate films disclosed in U.S. Pat. No. 5,665,472, the entire disclosure of which is hereby incorporated by reference into this specification. Thus, e.g., one may use films of plastic such as polyester, polypropylene, cellophane, polycarbonate, cellulose acetate, polyethylene, polyvinyl chloride, polystyrene, nylon, polyimide, polyvinylidene chloride, polyvinyl alcohol, fluororesin, chlorinated resin, ionomer, paper such as condenser paper and paraffin paper, nonwoven fabric, and laminates of these materials. These materials, and their properties, are well known to those skilled in the art and are described, e.g., in the "Modern Plastics Encyclopedia '92'" (Mid-October 1991 issue, Volume 68, Number 11, published by Modern Plastics, Box 481, Highstown, N.J.).

Referring again to FIG. 1, and in the embodiment depicted, the thermal transfer ribbon 10 is comprised of a backcoat 16, The preparation of backcoats on thermal transfer ribbons is well known and is described, e.g., in one or more of Daniel J. Harrison's patent publications, and/or in U.S. Pat. No. 3,900,323 (opaque backcoat), U.S. Pat. No. 4,950,641 (thermal transfer printing dyesheet and backcoat composition therefor), U.S. Pat. No. 5,821,028 (thermal transfer image receiving material with backcoat), U.S. Pat. No. 5,952,107 (backcoat for thermal transfer ribbons), U.S. Pat. No. 6,077,594 (thermal transfer ribbon with self generating silicone resin backcoat), U.S. Pat. No. 6,245,416 (water soluble silicone resin backcoat for thermal transfer ribbons), and the like. The entire disclosure of each of these United States patents is hereby incorporated by reference into this specification.

Referring again to FIG. 1, polyester film may be supplied pre-coated with a heat resistant backcoating suitable for thermal transfer printing. Such pre-backed polyester is supplied, e.g., by Toray Plastics of America (of 50 Belvere Avenue, North Kingstown, R.I.) as catalog number F531.

Referring again to FIG. 1, and affixed to the bottom surface of flexible substrate 14 is heat resistant backing layer 16, which is similar in function to the "backside layer" described at columns 2-3 of U.S. Pat. No. 5,665,472, the entire disclosure of which is hereby incorporated by reference into this specification. Without wishing to be bound to any particular theory, applicants believe that the function of this backcoating layer 16 is to prevent blocking between a thermal backing sheet and a thermal head and, simultaneously, to improve the slip property of the thermal backing sheet.

The heat resistant backing layer 16 preferably has a coating weight of from about 0.02 to about 1.0 grams per square meter. Backing layer 16, and the other layers which form the ribbons of this invention, may be applied by conventional coating means. Thus, by way of illustration and not limitation, one may use one or more of the coating processes described in U.S. Pat. No. 6,071,585 (spray coating, roller coating, gravure, or application with a kiss roll, air knife, or doctor blade, such as a Meyer rod), U.S. Pat. No.5,981,058 (meyer rod coating), U.S. Pat. Nos. 5,997,227, 5,965,244, 5,891,294, 5,716,717, 5,672,428, 5,573,693, 4,304,700, and the like. The entire disclosure of each of these United States patents is hereby incorporated by reference into this specification.

Thus, e.g., backing layer 16 may be formed by dissolving or dispersing the above binder resin containing additive (such as a slip agent, surfactant, inorganic particles, organic particles, etc.) in a suitable solvent to prepare a coating liquid. Coating the coating liquid by means of conventional coating devices (such as Gravure coater or a wire bar) may then occur, after which the coating may be dried.

One may form a backing layer 16 of a binder resin with additives such as, e.g., a slip agent, a surfactant, inorganic particles, organic particles, etc.

Binder resins usable in the layer 16 include, e.g., cellulosic resins such as ethyl cellulose, hydroxyethylcellulose, hydroxypropylcellulose, methylcellulose, cellulose acetate, cellulose acetate butyrate, and nitrocellulose. Vinyl resins, such as polyvinylalcohol, polyvinylacetate, polyvinylbutyral, polyvinylacetal, and polyvinylpyrrolidone also may be used. One also may use acrylic resins such as polyacrylamide, polyacrylonitrile-co-styrene, polymethylmethacrylate, and the like. One may also use polyester resins, silicone-modified or fluorine-modified urethane resins, and the like.

In one embodiment, the binder comprises a cross-linked resin. In this case, a resin having several reactive groups, for example, hydroxyl groups, is used in combination with a crosslinking agent, such as a polyisocyanate, an epoxy, an oxazoline and the like.

One may apply backing layer 16 at a coating weight of from about 0.01 to about 2 grams per square meter, with a range of from about 0.02 to about 0.4 grams per square meter being preferred in one embodiment and a range of from about 0.5 to about 1.5 grams per square meter being preferred in another embodiment.

Backcoating layer 16, and the other layers which form the ribbons of this invention, may be applied by conventional coating means. Thus, by way of illustration and not limitation, one may use one or more of the coating processes described in U.S. Pat. No. 6,071,585 (spray coating, roller coating, gravure, or application with a kiss roll, air knife, or doctor blade, such as a Meyer rod), U.S. Pat. No. 5,981,058 (meyer rod coating), U.S. Pat. Nos.5,997,227, 5,965,244, 5,891,294, 5,716,717, 5,672,428, 5,573,693, 4,304,700, and the like. The entire disclosure of each of these United States patents is hereby incorporated by reference into this specification.

In one embodiment, a backcoating layer 16 is prepared and applied at a coat weight of 0.05 grams per square meter. This backcoating 16 may be comprised of or consist essentially of a polydimethylsiloxane-urethane copolymer that is sold as ASP-2200 by the Advanced Polymer Company of New Jersey.

One may apply backcoating 16 at a coating weight of from about 0.01 to about 2 grams per square meter, with a range of from about 0.02 to about 0.4 grams per square meter being preferred in one embodiment and a range of from about 0.5 to about 1.5 grams per square meter being preferred in another embodiment.

Referring again to FIG. 1, the thermal transfer ribbon 10 may optionally comprise an undercoating layer 18 This undercoat layer 18 is preferably comprised of at least about 75 weight percent of one or more of the waxes and thermo plastic binders described elsewhere in this specification, and it preferably has a coating weight of from about 0.1 to about 2.0 grams per square meter.

Referring again to FIG. 1, and in the preferred embodiment depicted therein, it will be seen that substrate 14 may contains an optional release layer 20 coated onto the top surface of the substrate. The release layer 20, when used, facilitates the release of the thermal transfer layer 12 from substrate 14 when a thermal ribbon 10 is used to digitally print.

Release layer 20 preferably has a thickness of from about 0.2 to about 2.0 microns and typically is comprised of at least about 50 weight percent of wax. Suitable waxes which may be used include, e.g., carnuaba wax, rice wax, beeswax, candelilla wax, montan wax, paraffin wax, microcrystalline waxes, synthetic waxes such as oxidized wax, ester wax, low molecular weight polyethylene wax, Fischer-Tropsch wax, and the like. These and other waxes are well known to those skilled in the art and are described, e.g., in U.S. Pat. No. 5,776,280, the entire disclosure of which is hereby incorporated by reference into this specification.

In one embodiment, at least about 75 weight percent of layer 20 is comprised of wax. In one aspect of this embodiment, the wax used is preferably carnuaba wax.

Minor amounts of other materials may be present in layer 20. Thus, one may include from about 5 to about 20 weight percent of heat-softening resin which softens at a temperature of from about 60 to about 150 degrees Centigrade. Some suitable heat-softening resins include, e.g., the heat-meltable resins described in columns 2 and of U.S. Pat. No. 5,525,403, the entire disclosure of which is hereby incorporated by reference into this specification. In one embodiment, the heat-meltable resin used is polyethylene-co-vinylacetate with a melt index of from about 40 to about 2500 dg. per minute.

Referring again to FIG. 1, it will be seen that ribbon 10 may optionally comprise an adhesive layer 22. These adhesive layers are well known with respect to thermal transfer ribbons. Reference may be had, e.g., to several patents assigned to the Fujicopian corporation that describe and claim such adhesive layers, including, e.g., U.S. Pat. No. 5,525,403 (thermal transfer printing medium), U.S. Pat. No. 5,605,766 (thermal transfer recording medium), U.S. Pat. No. 5,700,584 (thermal transfer recording medium), U.S. Pat. No. 6,080,479 (thermal transfer recording medium), U.S. Pat. No. 6,231,973 (thermal transfer recording medium), U.S. Pat. No.6,562,442 (metallic thermal transfer recording medium), U.S. Pat. No. 6,623,589 (color thermal transfer recording medium), and the like. The entire disclosure of each of these United States patents is hereby incorporated by reference into this specification.

Figure 2:
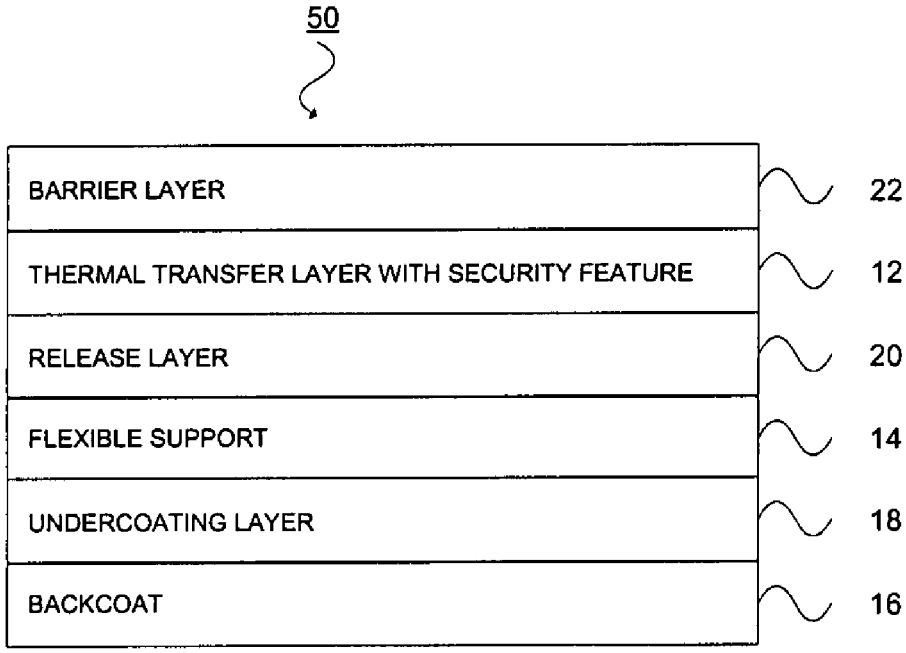

FIG. 2 is a schematic illustration of a thermal transfer ribbon 50 that may be made in accordance with the process of this invention. Although a particular process is described elsewhere in this specification to prepare this thermal transfer ribbon 50, other "prior art" processes also may be used.

Illustrative of the "prior art" processes that may be used to prepare such thermal transfer ribbons are, e.g., certain patent publications naming Daniel J. Harrison as an inventor. By way of illustration, such patent publications include U.S. Pat. No. 5,244,861 (receiving element for use in thermal dye transfer), U.S. Pat. No. 5,369,077 (thermal dye transfer receiving element), U.S. Pat. No. 5,466,658 (thermal dye receiving element for mordanting ionic dyes), U.S. Pat. No. 5,604,078 (receiving element for use in thermal dye transfer), U.S. Pat. No. 5,627,128 (thermal dye transfer system with low TG polymeric receiver mixture), U.S. Pat. No. 5,627,169 (stabilizers for receiver used in thermal dye transfer), U.S. Pat. No. 5,748,204 (hybrid imaging system capable of using ink jet and thermal dye transfer imaging technologies on a single image receiver), U.S. Pat. No. 5,753,590 (thermal dye transfer assemblage with low Tg polymeric receiver mixture), U.S. Pat. No. 5,795,844 (dye sets for thermal imaging having improved color gamut), 5,830,824 (plasticizers for dye-donor element used in thermal dye transfer), U.S. Pat. No. 5,888,013 (re-application of a dye to a dye donor element of thermal printers), U.S. Pat. No. 5,945,376 (thermal dye transfer assemblage with low Tg polymeric receiver mixture), U.S. Pat. No. 6,481,353 (process for preparing a ceramic decal), U.S. Pat. No. 6,629,792 (thermal transfer ribbon with frosting ink layer), U.S. Pat. No.6,666,596 (re-application of a dye to a dye donor element of thermal printers), U.S. Pat. No. 6,694,885 (thermal transfer system for fired ceramic decals), U.S. Pat. No. 6,722,271 (ceramic decal assembly), U.S. Pat. No.6,766,734 (transfer sheet for ceramic imaging), U.S. Pat. No. 6,796,733 (thermal transfer ribbon with frosting ink layer), U.S. Pat. No. 6,854,386 (ceramic decal assembly), U.S. Pat. No. 6,908,240 (thermal printing and cleaning assembly), as well as published United States patent applications 20010041084 (re-application of dye to a dye donor element of thermal printers), 20030200889 (thermal transfer system for fired ceramic decals), 20040003742 (transfer sheet for ceramic imaging), 20040136765 (thermal transfer ribbon with frosting ink layer), 20040149154 (ceramic decal assembly), 2005005618 (ceramic decal assembly), 20050128280 (thermal printing and cleaning assembly), 20050129445 (thermal printing and cleaning assembly), 20050129446 (thermal printing and cleaning assembly), 20050145120 (thermal transfer assembly for ceramic imaging), 20050150412 (thermal transfer assembly for ceramic imaging), and 200505016677 (thermal transfer assembly for ceramic imaging), The entire disclosure of each of these United States patents and published patent applications is hereby incorporated by reference into this specification.

By way of further illustration, one may use one or more of the thermal transfer processes, ribbons, reagents, and/or devices disclosed in U.S. Pat. No. 4,627,997 (thermal transfer recording medium), U.S. Pat. No. 4,472,479 (light barrier fluorescent ribbon), U.S. Pat. No.4,816,344 (preparation of fluorescent thermal transfer ribbon), U.S. Pat. No. 4,891,352 (thermally-transferable fluorescent 7-aminocarbostyrils), U.S. Pat. No. 5,089,350 (thermal transfer ribbon), 5,135,569 (ink composition containing fluorescent component and method of tagging articles therewith), U.S. Pat. No. 5,328,887 (thermally transferable fluorescent compounds), U.S. Pat. No. 5,516,590 (fluorescent security thermal transfer printing ribbons), U.S. Pat. No. 5,486,022 (security threads having at least two security detection features), U.S. Pat. No. 5,516,590 (fluorescent security thermal transfer printing ribbons), U.S. Pat. No. 5,583,631 (anti-counterfeit security device including two security elements), U.S. Pat. No. 5,601,931 (object to be checked for authenticity), U.S. Pat. No. 5,786,587 (enhancement of chip card security), U.S. Pat. No. 5,803,503 (magnetic metallic safeguarding thread with negative writing), U.S. Pat. No. 5,844,230 (information card), U.S. Pat. No. 5,949,050 (magnetic cards having a layer being permanently magnetized in a fixed configuration), U.S. Pat. No. 6,174,400 (near IR fluorescent security thermal transfer printing and marking ribbons), U.S. Pat. No. 6,255,948 (security device having multiple security features and method of making same), U.S. Pat. No. 6,376,056 (thermo-transfer ribbon for luminescent letters), U.S. Pat. No. 6,491,324 (safety document), U.S. Pat. No. 6,633,370 (quantum dots, semiconductor nanocrystals, and semiconductor particles used as fluorescent coding elements), U.S. Pat. No. 6,686,074 (secured documents identified with anti-stokes fluorescent compositions), U.S. Pat. No. 6,802,992 (non-green anti-stokes luminescent substance), U.S. Pat. No.6,841,092 (anti-stokes fluorescent compositions and methods of use), U.S. Pat. No. 6,926,764 (ink set, printed articles, a method of printing, and a colorant), U.S. Pat. No. 6,930,606 (security device having multiple security detection features), U.S. Pat. No. 7,037,606 (security element), and European patent publication EP 1 619 039 (fluorescent latent image transfer film). The entire disclosure of each and every one of these patent documents is hereby incorporated by reference into this specification.

Referring again to FIG. 2, the release layer 20 maybe omitted and the thermal transfer layer 12 may be directly contiguous with substrate 14.

Referring again to FIG. 2, the thermal transfer ribbon 50 is also comprised of a thermal transfer layer 12. The preparation of such thermal transfer layers is well known and is described, e.g., in one or more of Daniel J. Harrison's published patent documents. Reference also may be had, e.g. to U.S. Pat. No. 4,684,271 (thermal transfer ribbon including an amorphous polymer), U.S. Pat. No. 4,744,685 (thermal transfer ribbon and method of making same), U.S. Pat. No. 4,816,344 (preparation of fluorescent thermal transfer ribbon), U.S. Pat. No.4,894,283 (reusable thermal transfer ribbon), U.S. Pat. No. 4,895,465 (thermal transfer ribbon especially for impressions on rough paper), U.S. Pat. No. 4,898,486 (thermal transfer ribbon, especially for impressions on rough paper), U.S. Pat. No. 4,923,749 (thermal transfer ribbon), U.S. Pat. No. 4,938,617 (thermal transfer ribbon with adhesion layer), U.S. Pat. No. 5,017,428 (multiple impression thermal transfer ribbon), U.S. Pat. No. 5,047,291 (magnetic thermal transfer ribbon), U.S. Pat. No. 5,084,359 (magnetic thermal transfer ribbon), U.S. Pat. No. 5,098,350 (magnetic thermal transfer ribbon), U.S. Pat. No. 5,352,672 (holographic thermal transfer ribbon), U.S. Pat. No. 5,552,231 (thermal transfer ribbon), U.S. Pat. No. 5,681,379 (thermal transfer ribbon formulation), U.S. Pat. No. 5,843,579 (magnetic thermal transfer ribbon with aqueous ferrofluids), U.S. Pat. No. 5,866,637 (magnetic thermal transfer ribbon with non-metallic magnets), U.S. Pat. No.5,932,643 (thermal transfer ribbon with conductive polymers), U.S. Pat. No. 5,939,207 (thermal transfer ribbon for high density/high resolution bar code applications), U.S. Pat. No. 6,031,021 (thermal transfer ribbon with thermal dye color palette), U.S. Pat. No. 6,077,594 (thermal transfer ribbon with self generating silicone resin backcoat), U.S. Pat. No. 6,149,747 (ceramic marking system with decals and thermal transfer ribbon), U.S. Pat. No. 6,303,228 (thermal transfer ribbon and base film thereof), U.S. Pat. No. 6,629,792 (thermal transfer ribbon with frosting ink layer), and the like. The entire disclosure of each of these United States patents is hereby incorporated by reference into this specification.

Thermal transfer layer 12 is one of the layers preferably used to produce the digitally printed image. In one embodiment of the process of the invention, a multiplicity of ribbons 10 or 50, each one of which preferably contains a thermal transfer layer 12 with different colorant(s), taggant(s) and binder(s), are digitally printed to produce said image. What these ribbon(s) have in common is that they all preferably contain both binder, taggant and colorant material of the general type and in the general ratios described for layer 12. The concentrations of colorant, taggant and binder, and the types of colorant, taggant and binder, need not be the same for each ribbon. What is preferably the same, however, are the types of components in general and their ratios.

Referring again to FIG. 2, and in one preferred embodiment thereof, thermal transfer layer 12 is comprised of one or more thermoplastic binder materials in a concentration of from about 0 to about 75 percent, based upon the dry weight of colorant, taggant and binder in such layer 12. In one embodiment, the binder is present in a concentration of from about 15 to about 35 percent. In another embodiment, the layer 12 is comprised of from about 15 to about 75 weight percent of binder. One may use any of the thermal transfer binders of layer 12 described elsewhere in this specification.

In one embodiment a mixture of two synthetic resins is used. Thus, e.g., one may use a mixture comprising from about 40 to about 60 weight percent of polymethyl methacrylate and from about 40 to about 60 weight percent of vinylchloride/vinylacetate resin. In this embodiment, these materials collectively comprise the binder; in one aspect of this embodiment, the binder consists essentially of these materials.

Referring again to FIG. 2, in addition to the binder, the layer 12 may optionally contain from about 0 to about 75 weight of wax. Waxes suitable for incorporation in thermal transfer layer 12 are described elsewhere in this specification.

Referring again to FIG. 2, in addition to the wax layer 12 is comprised of from about 0 to about 12 weight percent of the plasticizer. Plasticizers suitable for softening the thermal transfer layer 12 are disclosed elsewhere in this specification.

Referring again to FIG. 2, layer 12 may be further comprised on one or more colorants. Suitable colorants include, e.g., carbon black. The carbon black of layer 12 may preferably be a "low structure" carbon black having a dibutyl phthalate absorption value of 40 to 400 milliliters/100 grams; preferably, 40 to 50 milliliters/100 grams, and, most preferably, 48 milliliters/100 grams. A carbon black having a low oil absorption value reduces the melt viscosity of the ink. The particle size of the carbon black is preferably within the range of about 30 to 60 nanometers. This range of particle size provides a top layer having acceptable melt viscosity and darkness. The amount of carbon black pigment in the top ink layer should be between about 0 and 30 percent by weight.

In one preferred embodiment, carbon blacks are utilized that produce good results in the thermal transfer ribbon of the present invention, Preferably, there is used one or more carbon blacks such as, e.g., carbon black grades such as Printex 140U Special Black 250, Special Black 350, Special Black 550, Printex 25, Printex 45, Printex 55, Printex 75, Printex 85, Printex 95, Aerosperse 3, Aerosperse 5, Aerosperse 7, Aerosperse 11 and Aerosperse 15 all supplied by Degussa Corporation of 150 Springside Drive, Akron, Ohio 44333.

The thermal transfer ribbon 50 may be similar to the thermal transfer ribbon disclosed in U.S. Pat. No. 6,468,636, the entire disclosure of which is hereby incorporated by reference into this specification. According to this U.S. Pat. No. 6,468,636, a preferred thermal transfer ribbon has a structure comprising a substrate and a color layer containing a binder resin and color material as essential components and formed on the substrate, in which the color layer contains the color material at an amount of 10-25 weight percent and the color material comprises at least one carbon black (referred to as "first carbon blacks") having the DBP oil absorption of 50-150 milliliters per 100 grams and the BET specific surface area of 50-250 square meters per gram and at least one carbon black (referred to as "second carbon black") having the DBP oil absorption of 350-500 milliliters per 100 grams and the BET specific surface area of 800-1300 square meters per gram. The first carbon black is excellent in dispensability in solution while the second carbon black can easily form a grain structure and obtain a high electrical conductivity.

In this preferred thermal transfer ribbon, the above two kinds of the first and second carbon blacks are combined so as to reduce the total amount of carbon black, so that adequate anti-static property can be obtained even if the total amount of the carbon black is relatively small. As a result, there can be obtained a thermal transfer ribbon excellent in the uniformity of coated layer and the printing sensitivity or the like as well as the antistatic property. Further, when the mixing ratio of the first and second carbon black is controlled so as to set a ratio of a weight of the first carbon black to a weight of the second carbon black within a range of 95:5-80:20 percent, and/or when the binder resin for constituting the color layer is mainly formed of the ethylene-vinyl acetate copolymer (EVA) containing the vinyl acetate (VA) component at 19-28 percent and the color layer is formed by a solvent coating method using an organic solvent into which the EVA copolymer is dissolved, so that a coated layer having an improved uniformity can be obtained. As a result, there can be obtained a thermal transfer ribbon being excellent in the anti-static property, the durability (such as the anti-abrasion) property, the alcohol resistance, and the like and having a good printing sensitivity, and being capable of forming an image with high quality.

As described above, in the thermal transfer ribbon, two kinds of the first carbon black excellent in dispersibility in a solution and the second carbon black having a high electrical conductivity are combined, so that a sufficient anti-static property can be imparted to the ribbon even if the total amount of the carbon black contained in the color layer is small. Accordingly, the dispersibility of the carbon black in the coating liquid for color layer is not lowered, so that there can be provided a thermal transfer ribbon being excellent in the uniformity, the anti-abrasion property, the printing sensibility and being applicable to a high-speed printing type thermal transfer printer.

Referring again to FIG. 2, other dyes and pigments may also be used as colorants in thermal transfer layer 12. According to U.S. Pat. No. 5,279,655, the entire disclosure of which is hereby incorporated by reference into this specification, one may advantageously utilize thermal transfer ink compositions containing coloring agents and vehicles, comprising, as a triphenylmethane dye or a lake pigment.

Various non-volatile oily substances can be used as the dissolution medium for dye or the dispersion medium for pigment. Examples of the oily substance include, for instance, vegetable oils such as rapeseed oil, castor oil and soybean oil; animal oils such as beef foot oil; higher fatty acids such as isostearic acid and oleic acid (all the higher fatty acids exemplified as X.sup. —in the above can be used). One kind of or mixtures of two or more kinds of these can be used.

Examples of the pigment-dispersing agent include, for instance, sorbitan fatty acid ester, polyoxyethylene sorbitan fatty acid ester, polyoxyethylene sorbitan alkyl ether, glycerin fatty acid ester, propylene glycol fatty acid ester, polyethylene glycol fatty acid ester, polyoxyethylene alkyl ether, hardened castor oil derivative and polyoxyethylene castor oil. One kind of or mixtures of two or more kinds of these can be used.

Examples of the viscosity-adjusting agent include, for instance, mineral oils such as motor oil; and synthetic oils such as olefin-polymerized oil (e.g. ethylene hydrocarbon oil, butylene hydrocarbon oil, and the like), diester oils (e.g. dioctyl phthalate, dioctyl sebacate, di(1-ethylpropyl) sebacate, dioctyl azelate, dioctyl adipate, and the like), and silicone oils (e.g. linear dimethyl polysiloxane having a low viscosity, and the like). One kind of or mixtures of two or more kinds of these can be used.

In the liquid ink composition of U.S. Pat. No. 5,279,655, the entire disclosure of which is hereby incorporated by reference into this specification, the above-mentioned coloring agent, dye-dissolution or pigment-dispersion medium, pigment-dispersing agent and viscosity-adjusting agent are usually added in the below-mentioned ranges, on the basis of the total amount of the ink composition.

Referring again to FIG. 2, and in the preferred embodiment depicted therein, layer 12 may also be comprised of inorganic colorants which also work well in this embodiment of applicants' process preferably each contain at least one metal-oxide. Thus, a blue colorant can contain the oxides of a cobalt, chromium, aluminum, copper, manganese, zinc, etc. Thus, e.g., a yellow colorant can contain the oxides of one or more of lead, antimony, zinc, titanium, vanadium, gold, and the like. Thus, e.g., a red colorant can contain the oxides of one or more of chromium, iron (two valence state), zinc, gold, cadmium, selenium, or copper. Thus, e.g., a black colorant can contain the oxides of the metals of copper, chromium, cobalt, iron (plus two valence), nickel, manganese, and the like. Furthermore, in general, one may use colorants comprised of the oxides of calcium, cadmium, zinc, aluminum, silicon, etc.

Suitable colorants, such as inorganic colorants, are well known to those skilled in the art. See, e.g., U.S. Pat. Nos. 6,120,637, 6,108,456, 6,106,910, 6,103,389, 6,083,872, 6,077,594, 6,075,927, 6,057,028, 6,040,269, 6,040,267, 6,031,021, 6,004,718, 5,977,263, and the like. The disclosure of each of these United States patents is hereby incorporated by reference into this specification.

By way of further illustration, some of the colorants which can be used in this embodiment of the product and process of this invention include those described in U.S. Pat. Nos. 6,086,846, 6,077,797 (a mixture of chromium oxide and blue cobalt spinel), U.S. Pat. No. 6,075,223 (oxides of transition elements or compounds of oxides of transition elements), U.S. Pat. No. 6,045,859 (pink coloring element) U.S. Pat. No. 5,988,968 (chromium oxide, ferric oxide), U.S. Pat. No.5,968,856 (glass coloring oxides such as titania, cesium oxide, ferric oxide, and mixtures thereof), U.S. Pat. No. 5,962,152 (green chromium oxides), U.S. Pat. Nos. 5,912,064, 5,897,885, 5,895,511, 5,820,991 (coloring agents for ceramic paint), U.S. Pat. No. 5,702,520 (a mixture of metal oxides adjusted to achieve a particular color), and the like. The entire disclosure of each of these United States patents is hereby incorporated by reference into this specification.

The particle size distribution of the colorant used in layer 12 should preferably be within a relatively narrow range. It is preferred that the colorant have a particle size distribution such that at least about 90 weight percent of its particles are within the range of 0.2 to 20 microns.

In one embodiment, the colorant used preferably has a refractive index greater than 1.4 and, more preferably, greater than 1.6;

FIG. 2 depicts a thermal transfer ribbon 50 comprised of a barrier layer 22. The barrier layer 22 serves as a buffer between thermal transfer layer 12 and the substrate on to which it may be printed. This may prove to be particularly useful when the substrate might interfere with the detection of the security feature incorporated into the thermal transfer layer 12.

By way of illustration, claim 1 of U.S. Pat. No. 4,472,479 describes a "barrier material," disclosing "1. An improved fluorescent printing ribbon wherein a transparent fluorescent material forms a layer comprising dyes and one of a wax and a polyester resin and is applied to a ribbon base, the improvement comprising a barrier material of reflective particles included with said layer comprising finely divided material which (a) has a metallic color, (b) is reflective, (c) does not shift the wavelength of fluorescent light, and (d) blocks absorption of incident light into the media upon which the fluorescent layer and barrier material are transferred during printing."

FIG. 3 depicts a thermal transfer ribbon 60 whose thermal transfer layer 12 ("topcoat") comprises a human-readable colorant such as, e.g., a visible-light-absorbing colorant that is visible to the naked eye.

Thermal transfer ribbon 60 also preferably comprises a security feature, such as, e.g., an ultraviolet fluorescent material, and/or an upshifting fluorescent material, and/or an infrared fluorescing material.

FIG. 4 depicts a thermal transfer ribbon 70 that contains one security feature in the undercoat 18 (such as a ultraviolet fluorescent agent, an infrared fluorescent agent, or an upshifting fluorescent agent) as well as one or more security features in the topcoat/thermal transfer layer 12 (such as a visible light absorbing taggant and a thermochromic agent and/or a photochromic agent and/or a magnetochromic agent and/or a color shifting agent and/or an iridescent agent, etc.). In one aspect of this embodiment, the agent(s) in layers 18 and/or 12 are present at a relatively low concentration that is forensically undetectable.

In one embodiment, the taggant used in layer 12 and/or 18 is a rare earth oxide material that is detectable by complicated analytical means but not by simple prior art readers.

FIG. 5 depicts a thermal transfer ribbon 80 that, in the preferred embodiment depicted, contains one or more different elemental moieties and/or inorganic compounds in its thermal transfer layer 12; in one aspect of this embodiment, such "elemental moieties" and/or compounds are of different sizes and/or concentrations and/or shapes.

Thus, and referring to thermal transfer ribbon 80, it will be seen that copper in the form of platelets 82, and/or copper in the form of nanoparticles 84, and/or silver particles 86, and/or threads 88, and/or silica based microfibers 90, may be present in the topcoat (TC) and can vary in concentration(s).

Referring again to FIG. 5, it will be seen that undercoat layer 18 may optionally be present in the thermal transfer ribbon 80.

Figure 6:
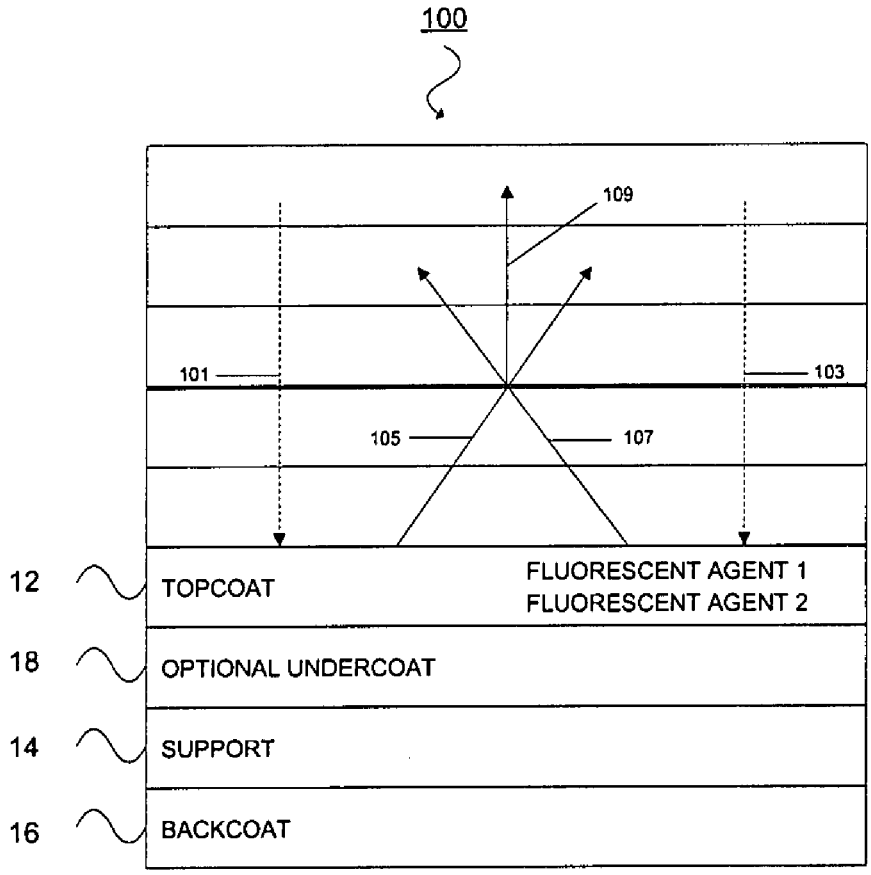

FIG. 6 depicts a thermal transfer ribbon 100 comprised of an optional undercoat layer 18 and a topcoat comprised of two different fluorescent agents.

The first such fluorescing agent, "Fluorescence Agent 1, " is made visible by a first energy source and emits a different wavelength than the second such fluorescing agent, "Fluorescing Agent 2" when it is exited by a second energy source. When energy sources 101 and 103 impinge upon thermal transfer layer 12, spectra 105 and 107 are emitted that, upon mixing, producing a distinctive appearance 109. For example, those skilled in the art of additive color theory will understand that if Fluorescence agent 1 emits blue light and Fluorescence agent 2 emits green light and the relative intensity of the two fluorescence agents is approximately the same then the combined color which would be perceived by the viewer would be cyan. Conversely, green and red emitting fluorescent agents combined would appear yellow and blue and red emitting fluorescent agents combined would appear magenta to the viewer. The FIG. 6 depicts this phenomenon is an overly simplistic manner that does not necessarily have any relationship to reality but is meant to illustrate the known phenomenon of the mixing of energy to produce unique energy patterns.

Figure 7:
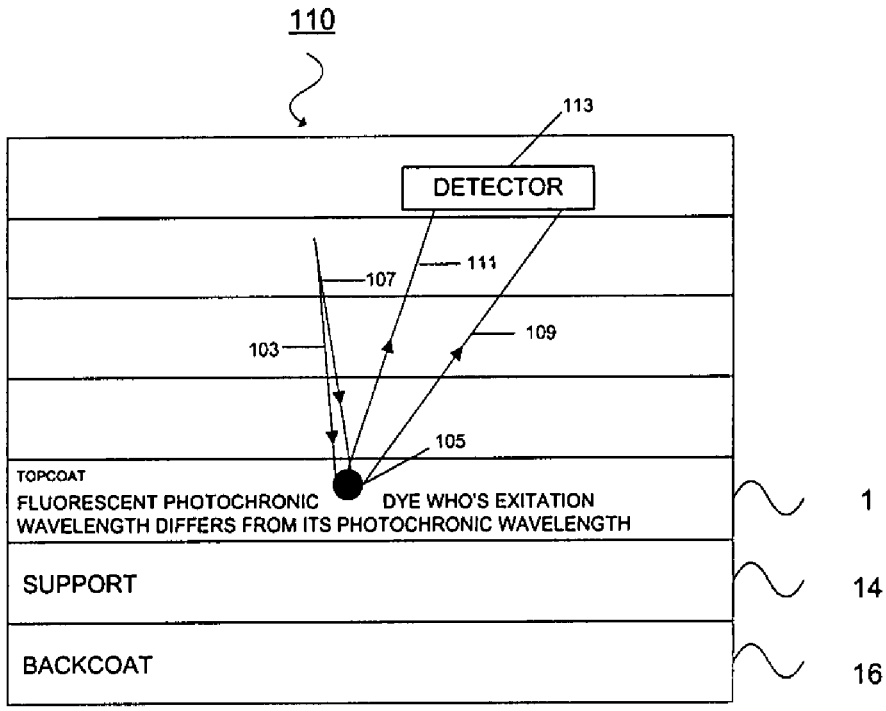

Referring to FIG. 7, the first source of energy 103 excites the photochromic material 105 in layer 1 and causes it to preferably activate and develop a visible color, thus becoming a visible light absorbing dye. The second source of energy 107, which may be applied after energy 103 or simultaneously therewith, preferably acts to illuminate the activated photochromic dye. The activated photochromic dye will absorb a portion of the radiation from this illuminating source of energy 107 and the resultant reflected radiation will appear colored. The presence of such color is both observable by the human eye and may be detected in detector 113. So, as a result of these phenomena, a visible indicia is produced (the change in color of the photochromic dye), and an invisible indicia. In one aspect of this embodiment, the photochromic dye absorbs visible light and provides one or more human readable indicium.

Figure 8:
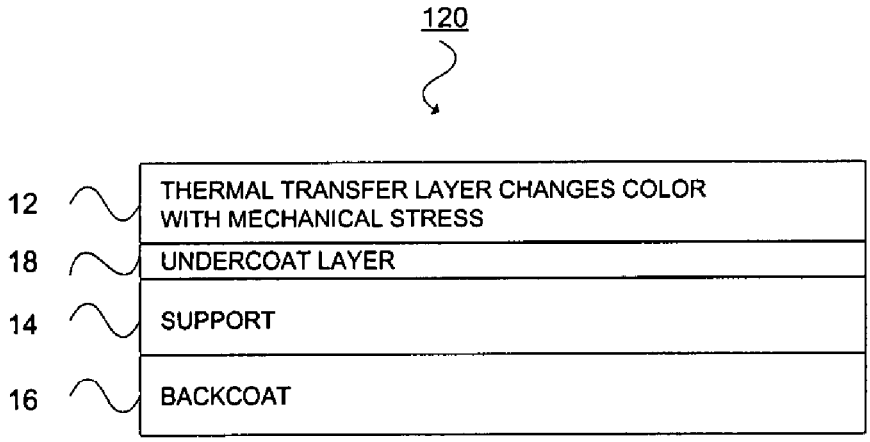

FIG. 8 depicts a thermal transfer ribbon 120 whose thermal transfer layer 12 changes color upon the application of mechanical stress. This property can be caused by the presence of a "mechanical stress dye" in the topcoat that, upon the elongation and/or compression of the topcoat (caused, e.g., by a change in extension of the receiver onto which the mechanochromic thermal transfer layer had been printed) changes color. Certain organic dyes are very sensitive to their chemical environments and alter their light absorbing characteristics in accordance with these environments. Those skilled in the art will understand that these dyes experience solvatochromic shifts. The morphology of certain organic polymers, especially elastomers and thermoplastics, are known to change when they are mechanically stressed, for example they may crystallize. If solvatochromic dyes are dissolved in such polymer, then these dyes change in color due to the application of mechanical stress.

Figure 9:
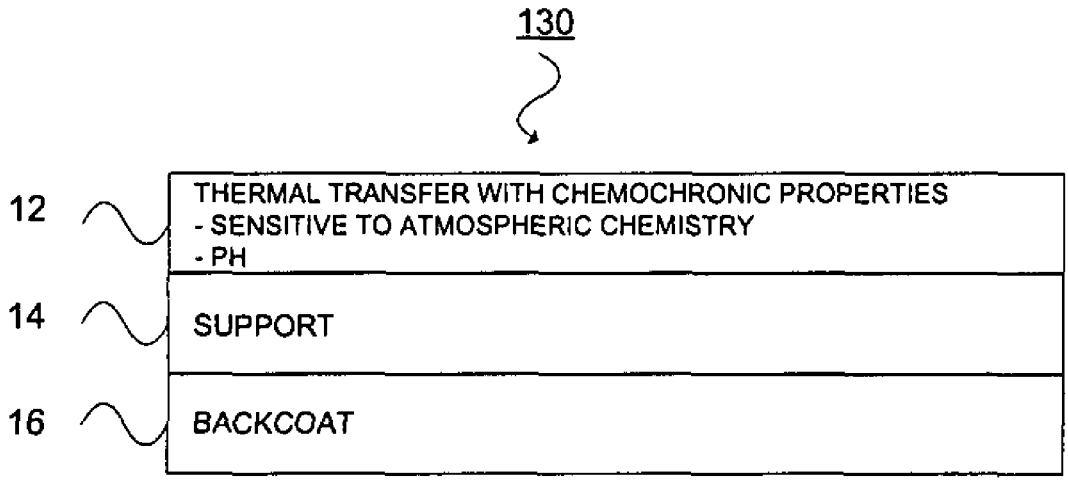

FIG. 9 depicts a thermal transfer ribbon 130 whose thermal transfer layer 12 is comprised of a chemochromic dye that is sensitive, e.g., to atmospheric conditions, pH, etc. In one aspect of this embodiment, the thermal transfer layer 12 is comprised of a component that can readily be collected and identified. This component may be readily mechanically or chemically extracted from the thermally printed image in which it resides. Additionally or alternatively it will produce collectible vapors, and/or it will have a radioactive tag (such as carbon 13), etc. Such components have a chemical fingerprint which can be readily detected with forensic methods and uniquely identified in an effort to authenticate the printed item.

Figure 10:
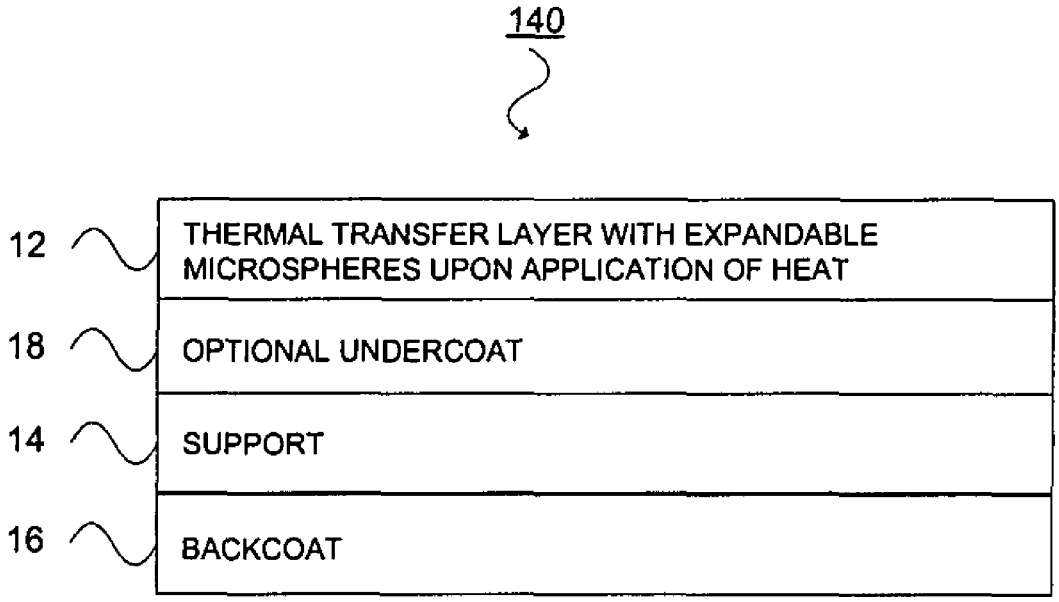

FIG. 10 illustrates a thermal transfer ribbon 140 that contains an optional undercoat 18 and a thermal transfer layer 12 comprised of expandable microspheres. Some of these expandable microspheres 12 are described elsewhere in this specification.

In one embodiment, the expandable microspheres have thermoplastic polymer shells and are filled with liquid petroleum products, for example, isobutylene, and/or other materials that vaporize upon the application of heat. In one aspect of this embodiment, the microspheres expand to about 100 times their original size when heated. The expansion temperature, in one embodiment, is selected such that it is above the thermal printing temperature such that after printing the little or no thermal expansion has occurred. However, upon application of heat above the thermal transfer temperature, expansion will occur such that a significant change in the texture and appearance of the printed image results. This is a valuable authentication or security device, for it provides a tactile change that is easily sensed by blind persons who could not detect a color change, for example. Thus, when the ink in the thermal transfer layer 12 is heated, such microspheres expand substantially, and the texture of the ink changes. In one aspect of this embodiment, the microspheres not only expand, but they burst.

As will be apparent, when the microspheres in layer 12 expand substantially, and especially when the material inside of them vaporizes, the refractive index of the microspheres is changed, the size of the microspheres is changed, and the opacity of the thermal transfer layer 12 is also changed. Furthermore, the thickness of the thermal layer 12 also changers.

Figure 11:
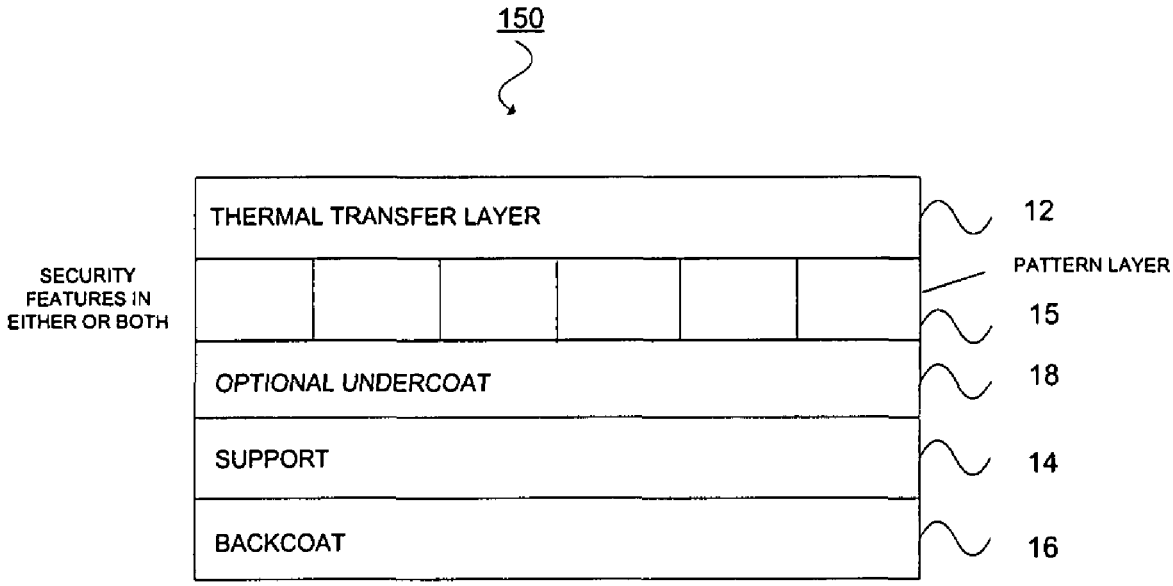

In one preferred embodiment, depicted in FIG. 11, the thermal transfer layer 12 has disposed beneath it, and contiguous with it, a patterned layer 15. Such thermal transfer ribbons 150, in one embodiment, preferably contain random or discrete patterns of one or more security devices within a contiguous layer. Upon printing the patterned thermal transfer layer 152, the pattern of the security device(s) is preserved in the printed image. Thus, not only may the presence of the security device be found in the printed image, but the required pattern of the device may also be detected. For example a fluorescent dye may be patterned within a thermal transfer layer in a repeating pattern of the word "Valid". When this thermal transfer layer is printed to a receiver sheet and the fluorescent agent is excited with an appropriate light source, it will emit light which can be observed and the pattern of such fluorescence will either the partial or complete word "Valid", depending upon the size of the printed image relative to the size of the patterned work "Valid" in the thermal transfer layer 15. One or more of the security features mentioned elsewhere in this specification may be in such thermal transfer layer 12 and/or such patterned layer 15.

In one preferred embodiment, the security feature that may be used in one or more of FIG. 1 et seq. is essentially colorless in the absence of strong light (i.e., it has an absorbance of less than 0.1 in layer 12). In the presence of strong light (such as 365 nanometers) the security feature becomes visible.

In one preferred embodiment, the security feature is a taggant that is presented in the thermal transfer layer 12 at a concentration of from about 1 part per billion parts (of the thermal transfer ink) to about 25 parts per hundred (of the thermal transfer ink). In one aspect of this embodiment, at least 98 weight percent of the thermal transfer layer 12 is comprised of thermal transfer ink. In one aspect of this embodiment, the security feature is a taggant that is present in a concentration of less than 1 part per million (by weight of the ink in the thermal transfer layer.) In another aspect of this embodiment, the taggant is a labile material that is resistant to analysis by the most common analytical techniques. Without knowing what chemical signatures to look for, the taggant would be present at levels in which many other chemical contaminates are present. Specific knowledge of the composition, concentration and distribution of the taggant in the thermal transfer layer would be required to detect its presence. Without such specific knowledge, a counterfeiter would have to reproduce all of the low concentration materials in a given sample. At concentrations around 1 part per million, this is a daunting task.

In one preferred embodiment, a taggant is used that is comprised of a rare earth oxysulfide (such as, e.g., lanthanum oxysulfide).

Security Features that May be Printed with the Thermal Transfer Ribbon

Many different security features may be printed onto a substrate with applicants' thermal transfer ribbon. Thus, by way of illustration, one may print an antenna onto such substrate, similar to the antenna disclosed in published United States patent application 2003/0038174, the entire disclosure of which is hereby incorporated by reference into this specification. This patent application describes and claims (in claim 1 thereof): "An improved identification card comprising: . . . at least one antenna affixed to said first side of said core layer, at least one integrated circuit chip electrically connected to said antenna . . . . "

One may print one or more covert compositions onto the substrate, as is disclosed in U.S. Pat. No. 3,960,755, the entire disclosure of which is hereby incorporated by reference into this specification. Claim 1 of this patent describes: "A slightly wood permeable, covert composition of matter for the marking and identification of wooden water craft . . . . "

The term "covert" means "concealed or secret." Reference may be had, e.g., to page 309 of "The Random House College Dictionary," Revised Edition Deluxe (Random House, Inc., New York, N.Y., 1984)

The covert compositions of U.S. Pat. No. 3,960,755 preferably meet the following requirements: " . . . . They should be substantially invisible to the naked eye . . . . The mark formed thereby should have a definite and controllable lifetime, i.e., about 12 hours to 6 weeks . . . . They should be non-toxic to humans, animals, and fish . . . . They should be capable of being easily dispensed mechanically above or below the surface of the water and . . . . They should be very adherent to the object with which they are in contact." (See column 1 of U.S. Pat. No. 3,960,755.)

One may print covert variable information onto the substrate, as is disclosed in published United States patent application 2003/0173406, the entire disclosure of which is hereby incorporated by reference into this specification. This patent application discloses "Covert Variable Information on Identification Documents . . . . "

Material which can be used to convey such "covert variable information" may be used in the undercoat 18 in combination with the thermal transfer layer 12 of the thermal transfer ribbon. For example, the undercoat of the thermal transfer ribbon may be comprised of a thermally releasable contiguous layer on the ribbon support 16. This undercoat 18 thermally transfers with thermal transfer layer 12 upon application to a receiver sheet through the action of the digital thermal printer. This releasable layer may be further comprised of a patterned fluorescent taggant. After transfer to a receiver sheet, the undercoat 18 will be present on the top most surfaces of the printed image. The thermally printed image itself may represent an overt bar code, encrypted text code, or other printed variable information. In addition to this overt information, the covert variable information may be revealed by shining a light on the digitally printed image which will excite the fluorescent taggant which has been patterned in the undercoat 18, causing a fluorescence to occur which may be either human readable or machine readable. This covert fluorescent pattern thus may be used to assess the authenticity of the digital image.

Another example of printing covert variable information would be to use two separate thermal transfer ribbons. One such ribbon would preferably be comprised of a thermal transfer layer 12 comprised of a fluorescent taggant material, the other thermal transfer ribbon would preferably be comprised of a thermal transfer layer 12 with an overt colorant. Both of these thermal transfer ribbons could then be used to print on a receiver sheet such that the overt and cover thermal transfer layers thermally printed onto the receiver sheet were overlaid. While the overt image could be visually observed, the covert image, comprised of variable information could only be discerned with the aid of a lamp capable of exciting the fluorescent taggant.

In yet another embodiment, an optically variable image of variable data could be thermally printed with a thermal transfer ribbon comprised of an optically variable taggant. The thermally printed optically variable covert image could then be overlayed with other indicia (fixed or variable) on a receiver. In a preferred embodiment the optically variable image of a variable indicium is aligned and printed directly over the same non-optically variable indicium that had been printed at that location. When the non-optically variable image is viewed at a first angle, the non-optically variable image of a variable indicium is visible while the thermally printed optically variable image is not, and when the image is viewed at a second angle, the thermally printed optically variable image becomes visible in the same location.

The thermal transfer ribbon can be used to print a diffraction layer onto a substrate such as, e.g., the diffraction layer disclosed in U.S. Pat. No. 4,631,222, the entire disclosure of which is hereby incorporated by reference into this specification. This United States patent discloses an embossing foil comprised of a "transfer layer means" that includes a "diffraction layer." Claim 1 of this patent describes: "1. An embossing foil comprising a backing foil having first and second surfaces, and on said first surface of said backing foil a transfer layer means which is releasable therefrom, said transfer layer means including: a diffraction layer having first and second surfaces, and comprised of, at least in part, a protective lacquer, said diffraction layer having a portion thereof configured to provide an optical diffraction structure; and a magnetic layer having first and second surfaces and comprising a dispersion of magnetizable particles in a binding agent, said first surface of said diffraction layer being disposed towards said first surface of said backing foil, and said second surface of said diffraction layer lacquer being disposed towards said first surface of said magnetic layer."

Such embossing foil may be used in the thermal transfer layer 12 of the thermal transfer ribbon. Alternatively, the thermal transfer layer 12 may be used in conjunction with a separate "diffraction layer."

The thermal transfer ribbon(s) may be used to print a diffraction grating/hologram onto the substrate similar to the device(s) disclosed in U.S. Pat. No. 5,044,707, the entire disclosure of which is hereby incorporated by reference into this specification. Claim 1 of this patent describes: "1. A document having visual information thereon protected from alteration, comprising a hologram or diffraction grating device firmly attached to said document over at least a portion of said visual information, said device comprising: a substantially transparent layer having a surface relief pattern formed in a surface thereof facing the document and its said visual information with substantially completely reflective material attached thereto in a discontinuous pattern there across in a manner that the device, when illuminated with light, allows viewing of both the visual information on the document through said layer and a light image or pattern reconstructed from said surface relief pattern in reflection from portions thereof to which said reflective material is attached, and said reflective material additionally being arranged in a shape or pattern of visual information separate from that of the reconstructed image or pattern and also separate from the document visual information."

Some or all of the thermal transfer layer 12 may be " . . . substantially transparent . . . . " Alternatively, a "diffraction grating layer" may be used in conjunction with such thermal transfer layer 11 and/or in layer 18.

The thermal transfer ribbon(s) may be used to print an electroconductive material onto a substrate such as, e.g., the material disclosed in U.S. Pat. No. 7,037,606, the entire disclosure of which is hereby incorporated by reference into this specification. This patent disclosed a security feature with both electroconductive and electronconductive material. Either or both of these materials may be incorporated into applicants' thermal transfer layer 12 and used to print a substrate. Such thermal transfer layers could be used to print overt information such a bar code, encrypted text, alphanumerics and the like. The authenticity of the printed overt information could be detected through covert means, such as testing its electrical conductivity. Claim 1 of this patent describes: "1. A security element comprising a carrier material equipped with a first coating of magnetic material forming a first code and a second coating of electroconductive material forming a second code and having in addition a third, optically readable code formed at least in certain areas by a third coating of nonanometersagnetic, nonelectroconductive material and covering at least partial areas of the security element not covered by a least one of the first coating or the second coating, said three coatings not being distinguishable from each other with the naked eye, wherein the optically readable code and at least one of the first and second coating are perceptible with the naked eye."

The thermal transfer ribbon(s) may be used to print an embedded electronic circuit such as, e.g., the circuit described in U.S. Pat. No. 6,918,535, the entire disclosure of which is hereby incorporated by reference into this specification. This patent describes a safety paper with an embedded electronic circuit that is used to create forgery-proof securities (such as bank notes). Claim 1 of this patent describes: "1. A safety paper with a) a structure in the form of an electronic circuit (1, 4, 7) making possible a contactless checking of an authenticity feature, b) the circuit (1, 4, 7) comprising an electronic circuit chip and a pattern (7) connected therewith and serving as a sending/receiving antenna that, c) the electronic circuit, in response to a received input signal, is operative to emit emits an output signal indicating the presence of the authenticity feature, d) the and whose pattern (50, 50') serving as a sending/receiving antenna has the form of being formed as a dipole antenna comprised of two conductor strips (50, 50') extending along a common straight line, e) which at facing ends thereof are contacted with connecting areas (70, 70') of the circuit chip (40), f) the conductor strips and are formed by portions of a thin insulating polymer substrate strip that have been made conductive, between whose g) the circuit chip is positioned on an insulating portion, delimited between the facing ends of the conductor strips (50, 50'), the circuit chip (40) is positioned, wherein h) the circuit chip (40) is formed on a thin-ground semiconductor substrate which is arranged on the insulating portion of the polymer substrate strip."

The device produced by the thermal transfer ribbon may comprise such embedded circuit. Alternatively, the thermal transfer ribbon may be used to print some or all of the components of such embedded circuits.

In one embodiment, the heat provided during the thermal printing process is used to form a security feature, in whole and/or in part, on the substrate being printed. Thus, e.g., one may form a multiplicity of "direct thermal" compositions, such as leuco dyes, on the substrate. Thus, e.g., one may form one or more of the direct thermal compositions during thermal printing described, e.g., in U.S. Pat. No. 5,527,758 (direct thermal imaging process with improved tone reproduction), U.S. Pat. No. 5,559,075 (recording material for direct thermal imaging), U.S. Pat. No. 5,582,953 (direct thermal recording process), U.S. Pat. No. 5,652,195 (heat-sensitive material suited for use in direct thermal imaging), U.S. Pat. No. 5,682,194 (direct thermal imaging), U.S. Pat. No. 5,734,411 (method for making an image by direct thermal imaging), U.S. Pat. No. 5,759,752 (direct thermal imaging material containing a protective layer), U.S. Pat. No. 5,888,283 (high solids direct thermal ink composition), U.S. Pat. No. 6,124,236 (direct thermal printable film), and the like. The entire disclosure of each of these United States patents is hereby incorporated by reference into this specification.

The thermal transfer ribbon may comprise a transparent fluorescent material and/or reflective particles and may be similar, in some respects to the fluorescent printing ribbon of U.S. Pat. No. 4,472,479, the entire disclosure of which is hereby incorporated by reference into this specification. Claim 1 of this patent describes a fluorescent printing ribbon and, in particular, "1. An improved fluorescent printing ribbon wherein a transparent fluorescent material forms a layer comprising dyes and one of a wax and a polyester resin and is applied to a ribbon base, the improvement comprising a barrier material of reflective particles included with said layer comprising finely divided material which (a) has a metallic color, (b) is reflective, (c) does not shift the wavelength of fluorescent light, and (d) blocks absorption of incident light into the media upon which the fluorescent layer and barrier material are transferred during printing." The thermal transfer layer 12 may comprise one or more of such transparent fluorescent materials. Alternatively, or additionally, such materials may be present in layer 18.

Column 1 of U.S. Pat. No. 4,472,479 discloses that: "Fluorescent ribbons are generally employed to allow the coding of documents which can subsequently be read electronically (optically) in order to allow machine sorting of the documents. The preparation of the ribbon with transferable fluorescent material is accomplished by depositing a layer of fluorescent material and waxes on the surface of a thin film of plastic. Thin film plastic materials most often used as ribbon carriers are polyethylene or Mylar."

One may prepare fluorescent thermal transfer ribbons in accordance, e.g., with the processes disclosed in U.S. Pat. Nos. 4,816,344 and 6,174,400, the entire disclosure of each of which is hereby incorporated by reference into this specification. U.S. Pat. No. 4,816,344 describes in claim 1 thereof "A method for the preparation of a fluorescent thermal transfer sheet . . . . " At columns 1-2 of this patent, it is disclosed that: "In the machine processing of various types of information contained on tickets, tags, labels, postage imprints and the like, it is generally known to employ detectors which are responsive to shape relationships and/or colors, and in many cases to the fluorescence of an ink which may be excited, for example, by ultraviolet light. Fluorescent inks and dyes have long been known such as, for example, those disclosed in U.S. Pat. Nos. 2,681,317, 2,763,785, 3,230,221, 3,412,104, 3,452,075, and 3,560,238. The fluorescent inks and the methods of making and using them . . . generally entail the use of a fluorescent ink which, when irradiated, will fluoresce and emit radiation within the wavelength for the particular fluorescent color of that dye or ink. It is known, for example, in the postage meter art to provide a red fluorescent ink for machine reading of processed mail."

Claim 1 of U.S. Pat. No. 6,174,400 describes: "1. A thermal transfer ribbon comprising a ribbon backing element and at least one printing media coated on the backing element layer comprising at least one near IR fluorescent compound in a concentration which provides detectable fluorescence without imparting color to a mark made from said printing media layer . . . . " The thermal transfer layer 12 may comprise a ". . . near IR fluorescent compound in a concentration which provides detectable fluorescence without imparting color to a mark made from said printing media layer . . . . "

The thermal transfer ribbon(s) may be used to print halftone patterns onto the substrate such as, e.g., the halftone patterns described in U.S. Pat. Nos. 6,752,432 and 6,991,260, the entire disclosure of which is hereby incorporated by reference into this specification.

U.S. Pat. No. 6,752,432 describes in its claim 1 "An information-bearing laminar assembly, comprising an information-bearing inner layer . . . having imagewise halftone pattern of microholes formed thereon . . . the microholes having sufficiently small structural dimensions such that, under unassisted visual inspection, the imagewise halftone pattern is (a) substantially imperceptible when the information-bearing laminar assembly is viewed in reflection, and (b) substantially perceptible when the information-bearing laminar assembly is viewed in transmission."

U.S. Pat. No. 6,991,260 also relates to halftone patterns. Claim 1 of this pattern describes: "1. A security feature for a document comprising a first pattern having a first partial image and a first background pattern, said first pattern being on a first surface of said document, and a second pattern having a second partial image and a second background pattern, said second pattern on a second surface of said document, said second surface of said document being opposite said first surface of said document, said document being sufficiently transparent wherein said first pattern and said second pattern are see-through such that said first pattern and said second pattern can be viewed al a substantially perpendicular angle, superimposed upon each other from said first surface of said document, wherein if said first pattern is aligned with said second pattern, said first partial image and said second partial image form a complete image, if said first pattern is misaligned with said second pattern, said complete image disappears, wherein lines in the first pattern and lines in the second pattern have substantially the same; and wherein the first pattern and the second pattern have tolerances of a fraction of a millimeter." Claim 2 of this patent describes: "The security feature for a document of claim 1 wherein said first pattern and said second pattern are halftones."

These "halftone security features" can be produced by the thermal transfer ribbon of this invention by printing at least two images onto a receiving sheet with one or more thermal transfer ribbons. Any one printing pass would not be sufficient to discern the entire image. Only by the recombination of separate image elements printed with multiple printing passes may the entire image be made recognizable. In a preferred embodiment, one of the printing passes could be made with a thermal transfer ribbon comprised of a fluorescent taggant. Only when the entire printed image is exposed to a lamp which would excite the fluorescent taggant, causing it to emit visible radiation would the entire image become visible.

Half tone printing patterns may be printed using thermal transfer printers in much the same way as they are used to print the photographs in a newspaper. The picture elements of the image are translated into a set of dots of variable size. The placement, spacing and size of these dots, when printed on a receiving sheet form a crude representation of the original image. In fact, once the original image is converted into a digital halftone image computer file, it may then be easily reproduced with a thermal transfer printer onto a receiver sheet.

One may use the thermal transfer ribbon(s) to print an invisible pattern of threads onto a substrate similar, e.g., to the thread pattern disclosed in U.S. Pat. No. 5,639,126, the entire disclosure of which is hereby incorporated by reference into this specification. This patent discloses a security feature comprised of an invisible pattern of security threads. Claim 1 of this patent describes: "1. A security thread having a width, suitable for at least partial incorporation in and for use on a security document or means for identification, which comprises the following deposited or laminated layers: at least one layer of a plastic substrate; a layer of a first security detection feature; and a layer of a second security detection feature, wherein said first security detection feature comprises identifying marks or indicia, wherein said second security detection feature comprises a generally invisible, optionally repeating pattern which comprises at least one very thin conductive region and at least one electrically isolating region, in optionally alternating sequence, and wherein said electrically isolating region(s) extends across the entire width of said thread."

The invisible patterns described in U.S. Pat. No. 5,639,126 may be utilized in applicants' thermal transfer ribbon so long as these threads preferably have a width smaller than 5 microns and a length shorter than 20 microns. Such threads may be randomly distributed in a thermal transfer layer 12 or may be incorporated a specific orientation such as the parallel to the long axis of the thermal transfer ribbon. Multiple threads may be incorporated into such a thermal transfer ribbon having a specific spacing and lengths relative to each other. In one embodiment, the size and distribution of such threads is consistent with the size and shape of the image to be printed with such thermal transfer ribbons. Unless the threads are capable of cleanly breaking at an interface between a thermally printed and unprinted area, such threads should be completely contained within the thermally printed area. Such a process requires the alignment of the thermal transfer ribbon and the receiver sheet to ensure proper positioning of the threads into the areas to be printed. Alternatively, or additionally, such patterned threads may be incorporated into the substrate which is printed by the ribbon Again, alignment of the ribbon and receiver often is necessary, should the combination of thermally transferred ink and receiver sheet incorporated thread create a unique combinatorial security effect.

The thermal transfer ribbon(s) may be used to print one or more microdots onto a substrate similar to, e.g., the microdots disclosed in U.S. Pat. No. 6,708,618, the entire disclosure of which is hereby incorporated by reference into this specification. This patent discusses such a "microdot." Such a security feature may comprise applicants' thermal ribbon layer 12 and may be printed onto a substrate; such microdots may be easily incorporated into the thermal transfer layer 12 as long as long as they preferably do not exceed 20 microns in any one dimension. Preferably, the microdots are thin, flake-like security devices with a thickness less than 1 micron. Such dots are easily transferred to a receiver sheet in the thermal printing process. Once imaged, these dots are incorporated into the printed image, providing a covert security element which is not be visible to the human eye and cannot be copied using conventional scanners or xerographic copiers. Only with the aid of high magnification microscopes can the presence of such microdots be detected.

The thermal transfer ribbon(s) may be used to print multiple security features onto a substrate, many of which are disclosed in U.S. Pat. No. 6,255,948, the entire disclosure of which is hereby incorporated by reference into this specification. This patent discloses and claims devices with multiple security features. Some or all of these multiple security features are "thermally printable," i.e., they can be incorporated into applicants' thermal transfer ribbon and printed upon a substrate.

In one embodiment, multiple thermal transfer layers 12 are applied to a given thermal transfer ribbon. Each of these thermal transfer layers may be comprised of different security devices, for example hard or soft magnetic particles, electrically conductive particles, metals, etch resistant polymers, fluorescent materials, pigmented or dyed waxes or resins and the like. These security devices may be applied uniformly across the thermal transfer layer 12 or they may be applied in discrete patterns within a given thermal transfer layer. The security device patterns within any one layer may be aligned with the security device patterns in another layer. When such a thermal transfer ribbon, comprised of multiple thermal transfer layers 12, is thermally printed onto a receiver, the relative registration of the security devices within the layers will be maintained in the printed image.

The thermal transfer ribbon(s) may be used to print negative writing onto a substrate similar to the negative writing patterns disclosed in U.S. Pat. No. 5,999,047, the entire disclosure of which is hereby incorporated by reference into this specification. This patent discloses a security document comprised of patterns that are visually readable in transmitted light. Claim 1 of this patent describes: "1. A security document having a security element comprising a transparent carrier film, said transparent carrier film including at least one electrically conductive metal layer, the metal layer being provided with recesses in the form of indicia visually readable at least in transmitted light, and said transparent carrier film further including a magnetic substance disposed in selected partial areas having gaps there between on top of the metal layer with said indica being located in said gaps, wherein said magnetic substance is readable by machine and said indicia are readable by visual inspection."

The thermal transfer ribbon(s) may be used to print quantum dots onto a substrate such as, e.g., the quantum dots described in U.S. Pat. No. 6,633,370, the entire disclosure of which is hereby incorporated by reference into this specification. This patent describes (in its claim 1) " . . . a quantum dot radius . . . . " "Semiconductor quantum dots" are described in column 1 of this patent, wherein it is disclosed that: "Semiconductor quantum dots are simple inorganic solids typically consisting of a hundred to a hundred thousand atoms. They emit spectrally resolvable energies, have a narrow symmetric emission spectrum, and are excitable at a single wavelength. Semiconductor quantum dots have higher electron affinities than organic polymers, such as those used as hole conductors in current display technology. They offer a distinct advantage over conventional dye molecules in that they are capable of emitting multiple colors of light. In addition, semiconductor quantum dots are size tunable, and when used as luminescent centers for electron hole recombination for electroluminescent illumination, their emission color is also size tunable . . . . "

A quantum dot security device is disclosed in U.S. Pat. No. 6,692,031, the entire disclosure of which is hereby incorporated by reference into this specification. Claim 1 of this patent describes: "1. An anti-counterfeit device comprising quantum dots applied to a substrate in a pattern, the quantum dots having sizes, compositions and structures which at least partially determine the fluorescence properties of the quantum dots such that the pattern of quantum dots produces fluorescence signatures upon illumination with excitation light, the fluorescence signatures having a relatively narrow emission spectrum, a relatively long fluorescence lifetime, and a fluorescence spectrum peak correlated to quantum dot diameter."

The thermal transfer ribbon(s) may be used to impart spectral emissivity variability properties to a substrate similar to the properties described, e.g., in U.S. Pat. No. 7,044,386, the entire disclosure of which is hereby incorporated by reference into this specification. This patent describes (in claim 1 thereof) a method for encoding information on surfaces that involves utilizing at least two patterns with different intrinsic emissivities. In particular, claim 1 of this patent describes: "1. A method for encoding information on surfaces, comprising: providing a surface; applying to the surface a first pattern using a first surface modification that emits energy based on a first intrinsic emissivity value at a given temperature; and applying to the surface a second pattern using a second surface modification that emits energy based on a second intrinsic emissivity value that differs from the first intrinsic emissivity value at the given temperature; the first and second patterns forming an information-encoding sequence of transitions of differential emissivity along a scan path over the patterns that encodes a given set of information; whereby an emissivity sensor that is sensitive to transitions in intrinsic emissivity, when scanned along the scan path over the patterns, will detect emissivity transitions that encode the given set of information regardless of whether any light is present."

The thermal transfer ribbon(s) may be used to print a transparent label such as, e.g., the label disclosed in U.S. Pat. No. 5,514,860, the entire disclosure of which is hereby incorporated by reference into this specification. This patent discloses a document authentication system utilizing a transparent label. As is indicated in the abstract of this patent, "This invention relates to a document authentication concept wherein a transparent tape having encoded text thereon is applied to the document. The encoded text printed with the transparent tape is printed with invisible ink so that the message thereon is not visible to the unaided eye. Preferably, the ink is visible in the IR range."

A Preferred Thermal Transfer Printing Medium

In one preferred embodiment, there is provided a thermal transfer printing medium that contains a thermal transfer layer which contains a first taggant and colorant, wherein: (a) the first taggant comprises a fluorescent compound with an excitation wavelength selected from the group consisting of wavelengths of less than 400 nanometers, wavelengths of greater than 700 nanometers, and mixtures thereof. When the thermal transfer layer is printed onto a white polyester substrate with a gloss of at least about 84, a surface smoothness Rz value of 1.2, and a reflective color represented by a chromaticity (a) of 1.91 and (b) of −6.79 and a lightness (L) of 95.63, when expressed by the CIE Lab color coordinate system, and when such printing utilizes a printing speed of 2.5 centimeters per second and a printing energy of 3.2 joules per square centimeter, a printed substrate with certain properties is produced. The printed substrate so produced has a reflective color represented by a chromaticity (a) of from −15 to 15 and (b) from −18 to 18, and the printed substrate has a lightness (L) of less than about 35, when expressed by the CIE Lab color coordinate system. When the printed substrate is illuminated with light source that excites the first taggant with an excitation wavelength selected from the group consisting of wavelengths of less than 400 nanometers, wavelengths greater than 700 nanometers, the printed substrate produces a light fluorescence with a wavelength of from about 300 to about 700 nanometers.

In the examples that are described elsewhere in this specification, some preferred thermal transfer ribbons are specifically described. These thermal transfer ribbons generally comprise a taggant that, preferably, is a fluorescent taggant. Such fluorescent taggants are well known and are described, e.g., in claim 1 of U.S. Pat. No. 4,652,395, the entire disclosure of which is hereby incorporated by reference into this specification. Such claim 1 describes: "1. A film-forming, viscous composition comprising a liquid diluent containing from 30 to 90 parts by weight of a film-forming resin in which is dispersed solid, discrete fluorescent taggant particles in an amount from 0.1 oz. to 5 pounds per gallon of said composition, said particles being insoluble in the diluent and being formed of fluorescent dyed powder dispersed in a solid transparent plastic binder resin and being readily discernible when the film is exposed to ultraviolet light."

In this embodiment, the taggant preferably comprises a fluorescent compound with an excitation wavelength selected from the group consisting of wavelengths of less than 400 nanometers, wavelengths of greater than 700 nanometers, and mixtures thereof. The term "excitation wavelength" has been discussed elsewhere in this specification, and it is well known to those skilled in the art. Reference may be had, e.g., to U.S. Pat. No. 7,094,364 (method of authenticating polymers, authenticatable polymers, and methods of making authenticatable polymers), U.S. Pat. No. 7,129,506 (optically detectable security feature), U.S. Pat. No. 7,256,398 (security markers for determining composition of a medium), and the like. The entire disclosure of each of these United States patents is hereby incorporated by reference into this specification.

In one aspect of this embodiment, the taggant is a phosphor that may be, e.g., an up-converting phosphor or a down-converting phosphor. These materials are well known and are described, e.g., in U.S. Pat. No. 3,980,887 (silicon sensitized rare earth oxysulfide phosphors), U.S. Pat. No. 4,113,648 (terbium-activated rare earth oxysulfide phosphors with controlled decay), U.S. Pat. No. 5,217,647 (method for preparing rare earth oxysulfide phosphor), U.S. Pat. No.5,783,106 (lithium doped terbium activated gadolinium oxysulfide phosphor), U.S. Pat. No. 5,879,587 (terbium activated rare earth oxysulfide phosphor with enhanced green:blue emission ratio), U.S. Pat. No. 5,879,588 (terbium-activated gadolinium oxysulfide phosphor with reduced blue emission), and the like. The entire disclosure of each of these United States patents is hereby incorporated by reference into this specification. Such taggants may be soluble or insoluble in the thermal transfer layer 12 or the undercoat layer 18. If such taggants are insoluble they may be dispersed in such layers as discrete particles. Such particles should have a particle size of less than 20 microns. Preferably, the particle size of such taggant particles is such that 90 percent of the particles are smaller than 15 microns.

In one aspect of this embodiment, the thermal transfer layer 12 is comprised of at least two colorants. In one embodiment, at least one of such colorants is a color shifting pigment. These materials are described, e.g., in U.S. Pat. No. 6,565,770, the entire disclosure of which is hereby incorporated by reference into this specification. As is disclosed in such patent, "Various color-shifting pigments, colorants, and foils have been developed for a wide variety of applications . . . . Such pigments, colorants, and foils exhibit the property of changing color upon variation of the angle of incident light, or as the viewing angle of the observer is shifted . . . . For example, U.S. Pat. No. 5,135,812 to Phillips et al., which is incorporated by reference herein, discloses color-shifting thin film flakes having several different configurations of layers such as transparent dielectric and semi-transparent metallic layered stacks. In U.S. Pat. No. 5,278,590 to Phillips et al., which is incorporated by reference herein, a symmetric three layer optical interference coating is disclosed which comprises first and second partially transmitting absorber layers which have essentially the same material and thickness, and a dielectric spacer layer located between the first and second absorber layers. Color-shifting platelets for use in paints are disclosed in U.S. Pat. No. 5,571,624 to Phillips et al., which is incorporated by reference herein."

In one preferred embodiment, the thermal transfer layer 12 has a thickness of less than about 15 microns and, preferably, less than about 5 microns. In one aspect of this embodiment, the thickness of the thermal transfer layer is less than about 3 microns. Put another way, in this aspect, there is less than about 1.8 grams per square meter of ink in the thermal transfer layer.

In one embodiment, the total amount of colorant in thermal transfer layer 12 is from about 1 to about 50 weight percent. When at least two such colorants are present, the colorants each have different optical properties.

In one preferred embodiment, at said excitation wavelength of said first taggant, the absorbance of light at said excitation wavelength by each of said first colorant and second colorant is sufficiently low such that said thermal transfer layer has a light transmittance of at least about 10 percent. In one aspect of this embodiment, said thermal transfer layer has a light transmittance of at least about 20 percent. In a further aspect of this embodiment, said thermal transfer layer has a light transmittance of at least about 30 percent.

EXAMPLES

The following examples are presented to illustrate certain aspects of the claimed invention but are not to be deemed limitative thereof. Unless otherwise specified, all parts are by weight, and all temperatures are in degrees Celsius.

Example 1

This example illustrates the preparation of a thermal transfer ribbon that contains an essentially colorless photochromic dye that, upon exposure to 400 nanometer ultraviolet light or sunlight, becomes brightly colored and fades back to colorless when removed from the source of radiation. In addition, the thermal transfer layer of the ribbon of this example is comprised of an invisible ultraviolet fluorescing pigment with an excitation wavelength of 365 nanometers that, when exposed to this wavelength, fluoresces with an intense, bright color until removed from the source of radiation. Additionally, such thermal transfer layer also is comprised of taggant material that is incorporated in low concentrations and designed to be detectable by reader assemblies specific to the composition of the taggant. In particular, for this example, an up-shifting phosphor taggant and infrared laser detector were selected. The infrared laser detector signals only the presence of the taggant in the transferred image and has no effect on either the photochromic taggant or the UV fluorescent pigment.

A coloring ink system having the following composition was prepared: 30 grams of Emulsion 36A (a proprietary 35 percent solids aqueous blend of Carnauba and Paraffin wax manufactured by ChemChor Emulsions and Specialty Additives of Chester, N.Y.), 7.5 grams of Dow DL-238NA (a 50% solids styrene-butadiene dispersion sold by Dow Reichhold Specialty Latex, LLC, Research Triangle Park, North Carolina), 5.0 grams of Invisible Yellow AIT-4466 (a 50% solids aqueous dispersion sold by DayGlo Color Corporation of Cleveland, Ohio), 3.0 of grams Palatinate Purple (sold by Keystone Aniline Corporation, Chicago, Ill.), 0.10 grams of up-shifting phosphor LUC-O-08 (sold by Lorad Chemical Corporation of St. Petersburg, Fla.) and 0.40 grams of Chemwet 29 fluoro surfactant (manufactured by ChemChor Emulsions and Specialty Additives of Chester, N.Y.). To this mixture were added an additional 4.0 grams of tap water and 25 grams of ceramic grinding media, and the mixture was placed on a roller mill for 10 minutes to ensure a uniform coating dispersion.

The LUC-O-08 upshifting phosphor had an excitation wavelength of 1000 nanometers or 1 micron. This taggant fluoresced brightly green when illuminated with a 1 milliwatt infrared (1 micron wavelength) laser pen Model SP401 (sold by Power Technology, Inc. Little Rock, Ark.). A backcoated, 4.5 micron thick polyester (PET) film substrate F531 was supplied by Toray Plastics, North Kingstown, Rhode, Island. The coloring ink system was applied to the faceside of the polyester film using a meyer rod and dried using a hot air gun for one minute to achieve a final moisture content of less than 0.5 percent with a dry final coat weight of 5.0 grams per square meter.

The thermal transfer ribbon produced by the procedure of this example was printed using a Zebra 140 XIII plus printer (Zebra Technologies, Vernon Hills, Ill.) onto a glossy white Gerber Scotchcal vinyl receiver at a printing speed of 5 inches per second and a printer energy setting of 25. The image consisted of a solid filled square one inch on a side, text and a 2 dimensional barcode.

The transferred images from such printing produced an essentially colorless transparent mark that, when exposed to direct sunlight or a source of ultraviolet radiation of 400 nanometers, immediately darkened to a deep purple color. When exposed to an ultraviolet radiation source at 365 nanometers, the mark shifted color to produce a dramatic fluorescent bright yellow green, over-riding the deep purple shade of the photo chrome. The printed barcode was readable when illuminated with ultraviolet light with an LDS 4620 2D barcode reader with a 365 nm Interchangeable Illumination/Optics Assembly supplied by Indata Systems of Skaneateles, N.Y. With daylight only illumination, the bar code could not be read. Finally the image mark was illuminated with an infrared laser pen Model SP401, and a visible green fluorescence was easily observed due to the presence of the up-shifting phosphor taggant material.

Example 2

A solution "A" was made by mixing 41.77 grams of solvent-grade 2-butanone and 28.13 grams solvent-grade toluene and heating the mixture to 70 degrees Celsius. After reaching this temperature, 8.7 grams of VY200 co-polyester (purchased from Bostik) and 1.68 grams Dynapoll 411 polyester (purchased from Degussa Corp, 65 Challenger Rd., Ridgefield, N.J.) were added and stirred until completely dissolved. To this solution were added 1.16 grams of 382 ES-HMW bisphenol-A fumarate polyester (purchased from Reichhold Chemical, Triangle Research Park, North Carolina); and 17.36 grams of BR87 polymethylmethacrylate (purchased from Dianal America Corporation) was added and stirred until completely dissolved and then cooled to room temperature.

An ink was prepared by mixing 59.21 grams of Solution "A," 0.42 grams of Solsperse 24000 dispersant (purchased from Noveon, Inc. Cleveland, Ohio) and 27.74 grams of an advanced optical effect pigment Dynacolor BG (Englehard Corp., Appearance and Performance Technologies, Iselin, N.J.) After mixing to reach a stable dispersion, there were added 12.90 grams of X7328 polyethylene wax dispersion (purchased from Gifuseratsuku Company of Japan). The mixture was mixed until homogenous.

A backcoated polyester substrate film was used as described in Example 1. The ink of this example was applied onto the face side of the polyester substrate by means of a Meyer rod coating bar, at a concentration sufficient to yield a dry weight of 7.5 grams per square meter. The coated polyester substrate was then dried with a hot infrared gun for one minute until it contained less than about 1 percent of solvent.

The ribbons produced in this example were printed in accordance with the procedure described in Example 1. The printed images exhibited an optically variable behavior such that they displayed a change in color from blue to green when the angle of viewing the image was changed from 180 degrees to 90 degrees.

Example 3

In this example a solution "B" was made by dissolving 6.58 grams of KeyFluor Red IR dye (Keystone Aniline Corp, Chicago, Ill.) in 94.32 grams of 2-butanone. Solution "B" was then added at 11.50 grams to 87.0 grams of the solution "A" described in Example 1 and stirred until homogenous. To this ink were then added 1.5 grams of an up-converting phosphor LUC-O-08 (Lorad Chemical Corporation, St. Petersburg, Fla.). Fifty grams of ceramic media were added to the ink, and the ink was allowed to roll on a ball mill roller for 30 minutes to aid in homogeneity. The media was then filtered out of the ink, and an ink ribbon was coated and printed as described in Example 1.

The thermally printed colored images of this example displayed three different effects. First noted was an optically variable change in visual color from blue to green when the angle of viewing the image was changed from 180 degrees to 90 degrees in normal lighting conditions, as described in Example 2. Second these images fluoresced a red color when illuminated with a 365 nanometer ultraviolet lamp. This color was not visible when viewed in daylight. Finally, when the image mark was illuminated with a 1 micron infrared laser, a visible green fluorescence was easily observed due to the presence of the up-shifting phosphor taggant material.

Example 4

The procedure of Example 3 was substantially followed with the exception that the thermally printed color images were printed on an Atlantek Model 200 Thermal Response Test System Printer (Atlantak Corporation of Wakefield, R.I., a division of Zebra Corporation of Vernon Hills, Ill.) at a printing speed of 2.5 centimeters per second, a voltage of 21 volts, using a 300 dots per inch Kyocera model KST-216-8 MPD1 printhead with a resistance of 1329 ohms. With a printing line time of 3 milliseconds, the printing energy was 3.2 joules/square centimeter.

As observed in Example 3, the thermally printed colored images of this example were optically variable and changed in visual color from blue to green when the angle of viewing the image was changed from 180 degrees to 90 degrees in normal lighting conditions. The image fluoresced a red color when illuminated with a 365 nanometer ultraviolet lamp. This color was not visible when viewed in daylight. Finally, when the image mark was illuminated with a 1 micron infrared laser, a visible green fluorescence was easily observed due to the presence of the up-shifting phosphor taggant material.

Example 5

An expandable microsphere ink was prepared by mixing 39.57 grams of hot toluene with 6.294 grams of the methacrylate Dianal BR113 (Dianal America, Pasadena, Tex.), 1.54 grams of the ethylene vinyl acetate Elvax 250 (Dupont, Wilmington, Del.), and 0.48 grams of the polyamide gellant, Sylvagel 6000 (Arizona Chemical). These components were allowed to dissolve completely and then cooled to ambient temperature. Subsequently, 3.3 grams of dioctyl pthalate (Chemcentral, Chicago, Ill.), 0.796 grams of the Disperbyk 2001 (Byk-Chemie, Wallingford, Conn.), and 48.012 grams of the Advancell EHM301 Thermoexpandable Microspheres (23-29 microns and an expansion initiation temperature of 140-150 Celsius sold by Sekisui Chemical Co. Ltd. of Japan) were added to the mixture. To the mixture was added 50 grams of ceramic milling media (0.3 millimeter). The mixture was milled on a Red Devil paint shaker until a 7 hegman grind (particle size of 0-5 microns) was achieved. The ceramic media was filtered out using a 400 micron nylon filter bag.

A backcoated polyester substrate film as described in Example 1 was used. The expandable microsphere ink of this example was then coated via a Meyer rod at to a dry coatweight of 5.0 grams per square meter onto the face side of the polyester film.

A cover coated flexible substrate was prepared as an image receiving substrate for the expandable microsphere thermal transfer ribbon. A 90 gram per square meter basis weight paper made from bleached softwood and hardwood fibers was used as the base substrate. The surface of the paper was sized with starch. A release layer was applied to both sides of the sized paper base substrate by extrusion coating a polyethylene (Epolene, from Eastman Chemical Corporation of Kingsport, Tenn.) at a coatweight of 20 grams per square meter.

A releasable covercoat coating was prepared by coating an aqueous emulsion of Joncryl 617 (a styrene/acrylic polymer sold by Johnson Polymers, Racine, Wis.) via a Meyer rod onto faceside of the polyethylene coated paper substrate. The dry coat weight of the Joncryl was 15 grams per square meter using a Meyer rod. The coated paper was then allowed to dry at ambient temperature for 16 hours. The cover coating had sufficient adhesion to the polyethylene substrate that the expandable microsphere thermal transfer layer could be printed directly onto the cover coating. After printing, the cover coating and expandable microsphere ink were releasable from the polyethylene coated paper substrate.

The expandable microsphere ribbon of this example was then printed onto a cover coat of the polyethylene coated paper substrate with a Zebra 140 xiii printer at a printing speed of 2 inches per second and a printing darkness setting of 30 to create an imaged decal.

This printed side of the imaged decal was then laminated via a double sided pressure sensitive adhesive tape to a vinyl receiver (Scotchcal, 3M Corp, Minneapolis, Minn.). The paper backing was then peeled away from the vinyl receiver leaving the expandable micro-sphere thermal transfer ink adhesively attached to the vinyl receiver. The Joncryl cover-coat was in turn attached to the top side of the expandable microsphere thermal transfer layer.

The imaged vinyl label was measured with a caliper and had a thickness of 0.23 millimeters. The imaged vinyl receiver was then placed in a 150° C. oven for 1 minute. After heat treatment it had a thickness of 0.29. This change in imaged thickness was attributed to the thermal expansion of the expandable microsphere and was discernable by tactile perception using a finger rub across the printed and unprinted areas of the receiver. This image remained intact after abrading or rubbing with the finger.

Example 6

The expandable micro-sphere ink ribbon of Example 5 was printed directly onto a vinyl receiver (Scotch Cal, 3M Corp, Minneapolis, Minn.) using the Zebra 140 xiii printer at 2 inches per second and a printer energy level of 30.

The imaged vinyl label was measured and had a thickness of 0.23 millimeters. This imaged vinyl label was then heat treated in a 150 degree Celsius oven for 2 minutes. After heat treatment it had a height of 0.47 millimeters. This change in imaged height is discernable by tactile perception using a finger and rubbing it. This image is very fragile and easily abraded by rubbing with the finger.

Example 7

An undercoating ink was prepared; a wax dispersion was made by adding 62.9 grams of toluene (Chemcentral, Tonawanda, N.Y.) to an aluminum can at room temperature, along with 0.7 grams of antistatic material Larostat 264A (BASF Corp, Mount Olive, N.J.), 12.6 grams of Polywax 850 (Baker Petrolite, Sugar Land, Tex.), and 40 grams of ceramic milling media (0.6-0.8 millimeters) and milled using a Red Devil paint shaker until a 7 hegman grind (maximum particle size of 0-5 microns) was achieved.

In a separate temperature controlled jacketed vessel, a wax solution was made: 21.3 grams of toluene were heated to 85 degrees Celsius and mixed using an electric mixer operated at 5,000 revolutions per minute. 1.98 grams of ethylene vinyl acetate Elvax 410 (Dupont, Wilmington, Del.) and 1.91 grams of fictionalized wax Ceramer 1608 (Baker Petrolite, Sugar Land, Tex.) were added while mixing and allowed to melt and dissolve into the toluene. The temperature of the jacketed vessel was decreased until the solution reached 50 degrees Celsius. An undercoating ink was prepared in which the wax solution was added into the above wax dispersion while mixing with electric mixer at 200 revolutions per minute. The ceramic media was filtered out by passing the mixture through a 400 micron nylon filter bag.

A backcoated polyester film was utilized as described in Example 1. The undercoating ink was applied via a plastic pipette onto the face side of the polyester film and drawn down using a #7 Meyer rod at an average wet coverage of 3.43 grams per square meter to form an undercoated polyester film. The toluene was allowed to dry in a solvent safety hood, resulting in a dry coating coverage of 0.57 grams per square meter.

A black thermal transfer ink was prepared; a millbase was made by adding 76 grams of toluene to a half-pint aluminum paint can while mixing using an electric blade mixer, 10.36 grams of hydrocarbon resin Piccotex LC (Hercules, Inc, Wilmington, Del.) and 4.8 grams of acrylic copolymer Dianal MB-2543 (Dianal America, Inc., Pasadena, Tex.) were then added and allowed to mix until dissolved at room temperature. To this solution were added 1.01 grams of dispersing agent Solsperse 24000 (Noveon, Inc. Cleveland, Ohio) and 0.25 grams of dispersing agent Solsperse 5000 (Noveon, Inc. Cleveland, Ohio) and mixed to suspension. To this, 7.58 grams of carbon black Special Black 250 (Degussa Corp., Akron, Ohio were added and mixed to suspend. The can was removed from mixing, and 50 grams of ceramic milling media (0.6-0.8 millimeter) were added and the can sealed. The mixture was milled using a Red Devil paint shaker until a 7 hegman grind (maximum particle size of 0-5 microns) was achieved.

The ceramic media was filtered out by passing the mixture through a 400 micron nylon filter bag. A 10 gram sample of this ink was taken, and to this sample 0.012 grams of LUC-O-08 upshifting phosphor (supplied by Lorad Chemical Corporation of St. Petersburg, Fla.) were added and shaken to disperse. This black ink was applied onto the undercoated side of the polyester film via the drawdown procedure previously described using a #5 Meyer rod for an average wet coverage of 7.5 grams per square meter and allowed to dry resulting in a dry coverage of 1.80 grams per square meter.

The transmission density of this coated film was tested using an X-Rite (Grandville, Mich.) model 361T to be 1.94. This coated film was then cut to be 110 millimeters wide by 200 millimeters long, and wound onto a 1" ID, 110 millimeters wide cardboard core and was printed onto white TC390 print media (Avery Fasson North America, Plainesville, Ohio) using a Zebra 140Xii Thermal Transfer Printer at a printing speed of 2 inches per second and a darkness setting of 10. The resulting image was tested for reflective density using a MacBeth (Grandville, Mich.) model RD914 densitometer to be 2.01. This image was tested for color using the Spectraflash SF600 (Datacolor International, Lawrenceville, N.J.), showing an L* value of 26.06, an a* value of 0.25, and a b* value of 0.33. The image was also illuminated at the excitation wavelength (1000 nanometers) of the LUC-O-08 taggant with a 1 milliwatt infrared (1 micron wavelength) laser pen Model SP401 (Power Technology, Inc. Little Rock, Ark.), with a failing result as no green glow could be seen when the infrared laser light from the pen was directed onto the thermally printed black ink on the white polyester film.

The percent transmission of the thermal transfer layer at a wavelength of 1000 nanometers (corresponding to the excitation wavelength of the taggant) was 2. The percent transmission of the thermal transfer layer in the wavelength range of green light (corresponding to the emission wavelength of the LUC-O-08 taggant) was also 2.

Although not wishing to be bound to any particular theory, applicants hypothesize that the failing result is attributed to the presence of excessive carbon black pigment in the coating. The applicants believe that the carbon black absorbs the 1000 nanometer infrared laser light from the pen which no longer is available to excite the taggant.

Example 8

The procedure described in Example 7 was substantially followed, except that the carbon black pigments used in the black thermal transfer ink were replaced with three colored pigments and one colored dye: 2.28 grams of pigment irgalite Blue GLVO, 2.68 grams of pigment Scarlet RT, 2.28 grams of pigment Yellow 8GN (all from CIBA Specialties, Tarrytown, N.Y.) and 0.34 g of black dye Morfast 101 (Keystone Aniline Corp., Chicago, Ill.) were added to the ink which was then milled and filtered as described in Example 6. The resulting black ink was coated over the undercoat layer and the transmission density was measured to be 1.21. The coated film was printed and the resulting reflective density was 1.57. The color of the image was tested using the aforementioned Spectraflash SF600, resulting in the following color values: L* of 28.67, a* of 1.03 and b* of −2.49. This printed image was then illuminated with the infrared laser pen and a green glow could be clearly observed.

The percent transmission of the thermal transfer layer at 1000 nanometers was 20. The percent transmission of the thermal transfer layer in the wavelength range of green light was 14.

Although they do not wish to be bound to any particular theory, the applicants hypothesize that the replacement of carbon black (with panchromatic light absorption) with colorants of lower light absorption at 1000 nanometers (the excitation wavelength for the taggant) increased the light transmission through the thermal transfer layer, enabling the light from the infrared laser pen to excite the upshifting phosphor in this example. Careful selection of such pigments allows a black color to be achieved in the thermal transfer layer.

Example 9

The procedures described in Example 8 were substantially followed except for the coloring pigments: In this example, 2.45 grams of Chromophtal Blue A3R, 2.33 grams of Chromophtal Magenta ST, 2.45 grams of Chromophtal Yellow GR (all from CIBA Specialties, Tarrytown, N.Y.) and 0.34 grams of Morfast Black were added to the ink which was then milled and filtered as described in Example 7. The resulting black ink was coated over the undercoat layer, and the transmission density of the thermal transfer ribbon was measured to be 0.87. The coated ribbon was printed in accordance with the process described in Example 6 and the resulting reflective density was measured to be 1.36. The color of the image was tested using the aforementioned Spectraflash SF600, resulting in the following color values: L* of 34.39, a* of −1.24, and b* of −2.69. This printed image was then illuminated with the infrared laser pen and a green glow could be clearly observed.

The percent transmission of the thermal transfer layer at 1000 nanometers was 30. The percent transmission of the thermal transfer layer in the wavelength range of green light was 25.

Example 10

The procedures described in Example 8 were substantially followed except for the coloration: For this example, no pigments nor dispersants were used and instead 4.06 grams of Oil Black BT dye (Spectra Colors Corp., Kearny, N.J.) was mixed to dissolve into the resin and Toluene solution. This ink was coated onto the undercoated film as previous. The transmission density of this thermal transfer ribbon was measured to be 1.38. The coated film was printed and the resulting reflective density was measured to be 1.83. The color of the image was tested using the aforementioned Spectraflash SF600 resulting in the following color values: L* of 22.37, a* of 0.92, and b* of −1.18. This printed image was then illuminated with the infrared laser pen and a green glow could be clearly observed.

The percent transmission of the thermal transfer layer at 1000 nanometers was 15. The percent transmission of the thermal transfer layer in the wavelength range of green light was 5.

Surprisingly, it has been found that the percent transmission at the emission wavelength of the taggant need not be very high so long as the percent transmission at the excitation wavelength of the taggant is high enough to excite fluorescence in the taggant. In this example, the percent transmission of light in the wavelength range of green light (around 510 nanometers) was only 5 percent, yet the green fluorescence of the excited taggant was still easily seen. In Example 6 the percent transmission in the wavelength range of green light was similar at 2 percent, yet the green fluorescence could not be seen in this example. The more significant difference between these two examples was the percent transmission at 1000 nanometers. For Example 6 the percent transmission at 1000 nanometers was 2 percent while in Example 9 it was 15 percent.

These results are not obvious in view of the prior art. Thus, e.g., it is disclosed in U.S. Pat. No. 4,627,997 that: "It is preferable in the present invention to select a coloring agent which does not absorb the fluorescence of the fluorescent substance or does not absorb it much; transmissions of 40% or more at the emission wavelengths are preferred to avoid decreasing the fluorescence intensity by inclusion of a coloring agent."

We claim:

1. A thermal transfer printing medium comprised of a thermal transfer layer, wherein:

(a) said thermal transfer layer is comprised of a first colorant and a first taggant, wherein said first taggant comprises a fluorescent compound with a first excitation wavelength, and wherein said first excitation wavelength is selected from the group consisting of wavelengths of less than 400 nanometers, wavelengths of greater than 700 nanometers, and mixtures thereof;

(b) said thermal transfer layer has a light transmittance of at least about 10 percent when illuminated by light having said first excitation wavelength of said first taggant;

(c) when said thermal transfer layer is printed onto a white polyester substrate with a gloss of at least about 84, a surface smoothness Rz value of 1.2, and a reflective color represented by a chromaticity (a) of 1.91 and (b) of −6.79 and a lightness (L) of 95.63, when expressed by the CIE Lab color coordinate system, and when such printing utilizes a printing speed of 2.5 centimeters per second and a printing energy of 3.2 joules per square centimeter, a printed substrate is produced wherein:

1. said printed substrate has a reflective color represented by a chromaticity (a) of from −15 to 15 and (b) from −18 to 18, and said printed substrate has a lightness (L) of less than about 35, when expressed by the CIE Lab color coordinate system; and
2. when said printed substrate is illuminated with light source that excites said first taggant with said first excitation wavelength, said printed substrate produces a light fluorescence with a wavelength in the range of from about 300 to about 700 nanometers.

2. The thermal transfer medium as recited in claim 1, wherein said first taggant is an oxysulfide phosphor.

3. The thermal transfer medium as recited in claim 1, wherein said thermal transfer layer is comprised of said first colorant and a second colorant.

4. The thermal transfer medium as recited in claim 3, wherein said thermal transfer layer has a thickness of less than about 15 microns.

5. The thermal transfer medium as recited in claim 3, wherein said thermal transfer layer has a thickness of less than about 10 microns.

6. The thermal transfer medium as recited in claim 3, wherein said thermal transfer layer has a thickness of less than about 5 microns.

7. The thermal transfer medium as recited in claim 5, wherein the absorbance of light at said first excitation wavelength by each of said first colorant and said second colorant in said thermal transfer layer is low enough such that said thermal transfer layer has a light transmittance of at least about 20 percent.

8. The thermal transfer medium as recited in claim 5, wherein the absorbance of light at said first excitation wavelength by each of said first colorant and said second colorant in said thermal transfer layer is low enough such that said thermal transfer layer has a light transmittance of at least about 30 percent.

9. The thermal transfer layer as recited in claim 7, wherein said thermal transfer layer is comprised of less than about 5 weight percent of carbon black.

10. The thermal transfer layer as recited in claim 7, wherein said thermal transfer layer is comprised of less than about 1 weight percent of carbon black.

11. The thermal transfer layer as recited in claim 7, wherein at least about 90 weight percent of said first taggant is comprised of particles smaller than 15 microns.

12. The thermal transfer medium as recited in claim 11, wherein said first colorant is a pigment.

13. The thermal transfer medium as recited in claim 11, wherein said first colorant is a color-shifting pigment.

14. The thermal transfer medium as recited in claim 11, wherein said first colorant is a dye.

15. The thermal transfer medium as recited in claim 11, wherein said thermal transfer medium is comprised of said thermal transfer layer, a flexible support disposed beneath said thermal transfer layer, and a transferable undercoating layer disposed between said flexible support and said thermal transfer layer.

16. The thermal transfer medium as recited in claim 15, wherein said undercoating layer is comprised of said second taggant, and wherein said second taggant is comprised of a fluorescent substance with has an emission wavelength that differs by at least 50 nanometers from the emission wavelength of said first taggant.

17. The thermal transfer medium as recited in claim 15, wherein said first taggant is an up-shifting phosphor.

18. The thermal transfer medium as recited in claim 17, wherein said first colorant is a pigment.

19. The thermal transfer medium as recited in claim 17, wherein said transferable undercoat layer is comprised of a second taggant.

20. The thermal transfer medium as recited in claim 19, wherein said second taggant is a photochromic substance.

21. The thermal transfer medium as recited in claim 19, wherein said second taggant is a thermochromic substance.

22. The thermal transfer medium as recited in claim 19, wherein said second taggant is a chemochromic substance.

23. The thermal transfer medium as recited in claim 19, wherein said second taggant is a mechanochromic substance.

* * * * *